US005340938A

United States Patent [19]

Sugita et al.

[11] Patent Number: 5,340,938

[45] Date of Patent: Aug. 23, 1994

[54] TONE GENERATION APPARATUS WITH SELECTIVE ASSIGNMENT OF ONE OF TONE GENERATION PROCESSING MODES TO TONE GENERATION CHANNELS

[75] Inventors: Kunihiro Sugita; Hiroshi Iwase, both of Tokyo, Japan

[73] Assignee: Casio Computer Co., Ltd., Tokyo, Japan

[21] Appl. No.: 687,722

[22] Filed: Apr. 18, 1991

[30] Foreign Application Priority Data

Apr. 23, 1990 [JP] Japan ..... 2-107286
Jun. 29, 1990 [JP] Japan ..... 2-172195
Jun. 29, 1990 [JP] Japan ..... 2-172196

[51] Int. Cl.[5] ..... G10H 7/04

[52] U.S. Cl. ..... 84/605; 84/622; 84/659

[58] Field of Search ..... 84/604–607, 84/622, 624, 625, 659–661, 629, 622

[56] References Cited

U.S. PATENT DOCUMENTS 4,018,121 4/1977 Chowning .
4,297,933 11/1981 Nishimoto .
4,389,915 6/1983 Bione ..... 84/DIG. 4
4,392,405 7/1983 Franz et al. ..... 84/DIG. 4
4,554,857 11/1985 Nishimoto ..... 84/624 X
4,655,115 4/1987 Nishimoto ..... 84/DIG. 10
4,658,691 4/1987 Ishiboshi ..... 84/624 X
4,706,538 11/1987 Yoshida ..... 84/DIG. 2
4,709,611 12/1987 Takagi et al. .
4,719,833 1/1988 Katoh et al. ..... 364/419
4,726,276 2/1988 Katoh et al. .
4,747,332 5/1988 Uchiyama et al. ..... 84/DIG. 2
4,813,326 3/1989 Hirano et al. .
4,893,538 1/1990 Masaki et al. ..... 84/605
4,907,484 3/1990 Suzuki et al. ..... 84/661
5,076,133 12/1991 Toda ..... 84/624
5,094,136 3/1992 Kudo et al. ..... 84/624 X
5,159,142 10/1992 Ishida ..... 84/624 X
5,164,530 11/1992 Irose ..... 84/624

FOREIGN PATENT DOCUMENTS 0201998 11/1986 European Pat. Off. .
0377459A2 7/1990 European Pat. Off. .
2513127 10/1975 Fed. Rep. of Germany .
58-102296 6/1983 Japan .
61-12279 4/1986 Japan .

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

In an apparatus capable of generating a tone by a plurality of different tone generation processing modes, the respective tone generation processing modes are arbitrarily assigned in units of tone generation channels so as to efficiently utilize the tone generation channels. In particular, as one of the tone generation processing modes, a waveform readout processing such as a PCM method is used. As another processing mode, a tone generation processing mode for converting an output obtained by mixing a modulation signal in a carrier signal at an arbitrary ratio in accordance with a predetermined functional relationship to generate a tone signal is used. In this mode, when the mixing ratio is set to be a predetermined value, the tone signal has a sine or cosine wave. Various tones such as a tone including a single sine or cosine wave component, a tone including harmonic components of high orders, and the like can be widely synthesized, and can be desirably assigned to the tone generation channels. The tone signals synthesized by the two tone generation processing modes are mixed at a predetermined mixing ratio which changes over time, and the mixed signal is output as a mixed tone signal, thereby allowing generation of a tone which changes complicatedly and dramatically.

18 Claims, 34 Drawing Sheets (PRIOR ART)

FIG. 9A K=0
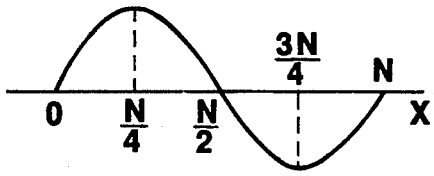
FIG. 9B K=1
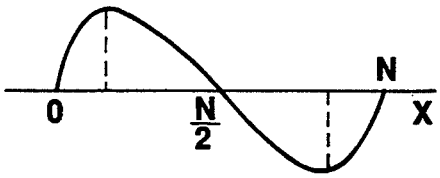
FIG. 9C K=3
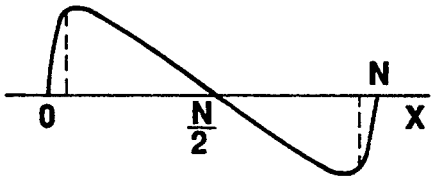
FIG. 9D K=5
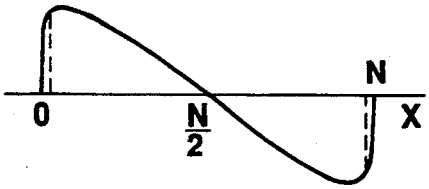
FIG. 9E K=7
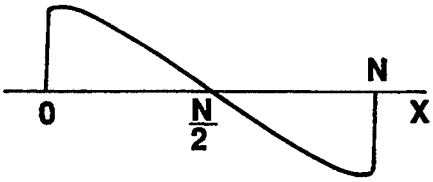

SAW
(NO MODULATION)

SAW
(MODULATION:
SMALL)

SAW
(MODULATION:
LARGE)

DUAL SINE

SQUARE

PULSE

SAWPULSE

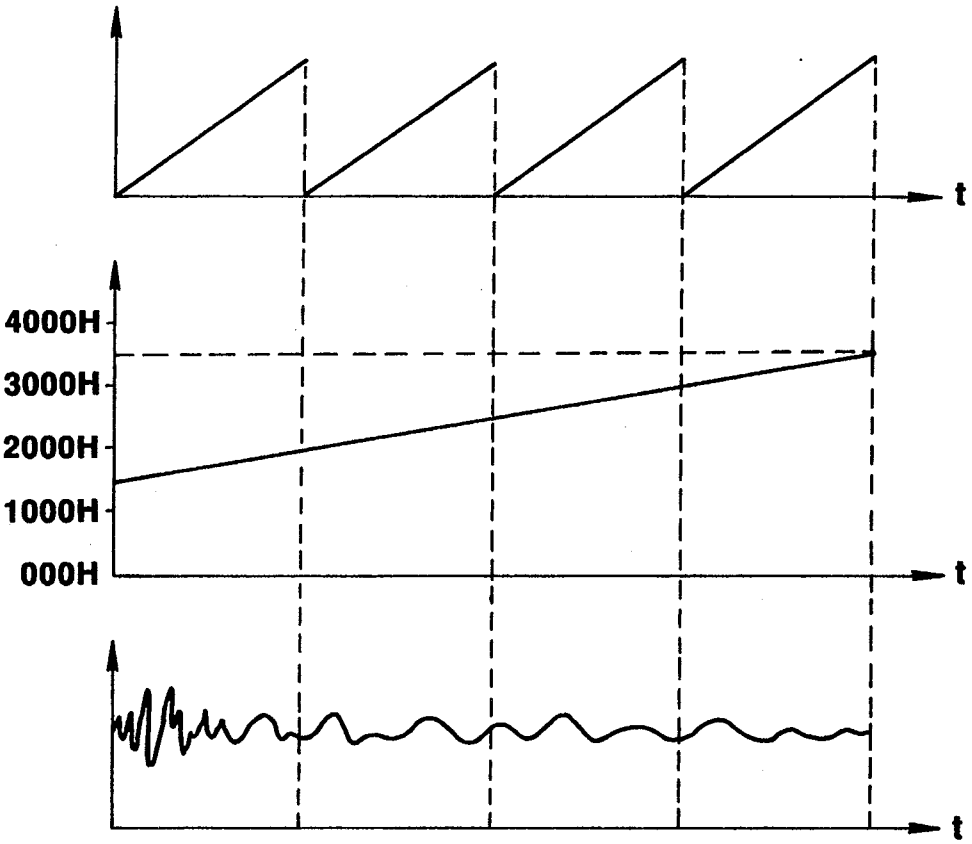
FIG. 20A PH
FIG. 20B ωct(P)
FIG. 20C Op

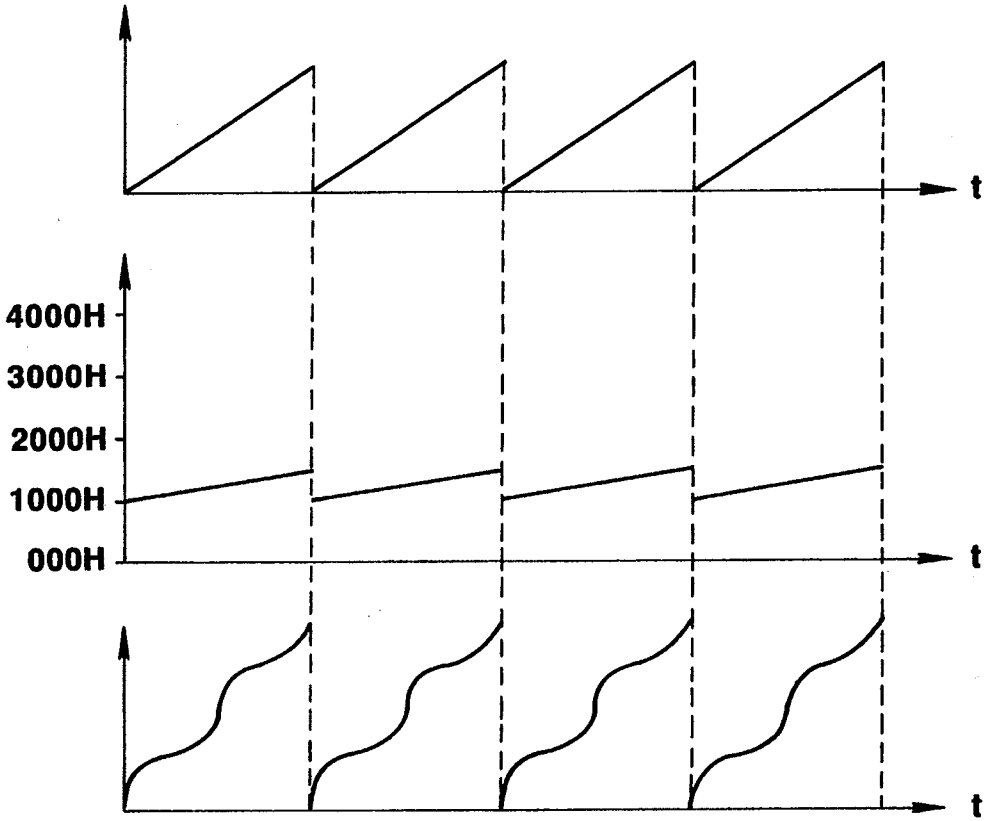
FIG.21A PH
FIG.21B ωct(M)
FIG.21C Wc

PH, ωct(P), ωct(M), Wc
Op, Wc+WM, OM
ep, eM, E

φ1
φ2
D
D-1
S0
S1
S2
A
B
30
31
0
1
2
3
29

ωct0~ωct9

ωct10

A0~A9

D0~D9

Wc0~Wc9

Wc0~Wc10

| A (HEX) | | D | |
|---|---|---|---|
| 0 | $E_1$ | ENVELOPE | ON |
| 1 | | ENVELOPE | OFF |
| 2 | | ATTACK TIME | AT |
| 3 | | INITIAL LEVEL | IL |
| 4 | | DECAY TIME | DT |
| 5 | | SUSTAIN LEVEL | SL |
| 6 | | RELEASE TIME | RT |
| 7 | $E_2$ | ENVELOPE | ON |
| 8 | | ENVELOPE | OFF |
| 9 | | ATTACK TIME | AT |
| A | | INITIAL LEVEL | IL |
| B | | DECAY TIME | DT |
| C | | SUSTAIN LEVEL | SL |
| D | | RELEASE TIME | RT |
| E | $E_3$ | ENVELOPE | ON |
| F | | ENVELOPE | OFF |
| 10 | | ATTACK TIME | AT |
| 11 | | INITIAL LEVEL | IL |
| 12 | | DECAY TIME | DT |
| 13 | | SUSTAIN LEVEL | SL |
| 14 | | RELEASE TIME | RT |

TONE GENERATION APPARATUS WITH SELECTIVE ASSIGNMENT OF ONE OF TONE GENERATION PROCESSING MODES TO TONE GENERATION CHANNELS

BACKGROUND OF THE INVENTION

1. Field of the Invention

The present invention relates to a tone waveform generation apparatus capable of efficiently mixing a plurality of tone generation processing modes.

2. Description of the Related Art

Tones of acoustic instruments have complicated harmonic structures. For example, the frequencies and amplitudes of harmonics always vary, and in some instruments, harmonics include those of fractional orders. In addition, tones have noise components unique to respective instruments (e.g., shock noise upon attacking of a piano). Such harmonics and noise components characterize tone colors of instruments.

In order to faithfully reproduce such tones by an electronic musical instrument, or in order to create tones of an unprecedented feeling, various tone generation processing methods are employed in the electronic musical instrument.

These processing methods include many methods, such as a PCM method, a frequency modulation (FM) method, a phase modulation method, a harmonic addition method, and the like. When these methods are appropriately combined, the above-mentioned object can be accomplished to some extent. For example, since the harmonic structure is complicatedly varied in an attack portion, the PCM method is employed. For the following sustain portion (steady portion), the PCM method may be switched to another method since a memory having a large storage capacity is required if the PCM method is employed.

For example, in Published Unexamined Japanese Patent Application No. 58-102296, a tone waveform for an attack portion is generated by the PCM method, and a tone waveform for the following portion is generated by the FM method, thus obtaining tones.

This method will be described below.

When the depression of a given key is detected, numerical value data corresponding to a pitch of the ON key is repetitively accumulated to obtain an accumulated value whose value changes at a speed corresponding to the pitch. Thereafter, waveform data of an attack portion is read out from a PCM waveform memory using the accumulated value as an address, and an envelope of the attack portion shown in FIG. 1A is given to the readout waveform data.

On the other hand, the accumulated value, and another constant are input to an FM tone generator, thus obtaining a tone waveform. Thereafter, an envelope shown in FIG. 1B is given to the tone waveform. The tone waveform obtained by the PCM method and the tone waveform obtained by the FM method are added to each other to generate a total waveform signal of a tone having an attack portion, a sustain (steady) portion, and a release (decay) portion of a tone, as shown in FIG. 1C.

As the first prior art of an FM method which can be utilized in the above-mentioned method using a combination of the PCM method and the FM method, an FM method described in, e.g., U.S. Pat. No. 4,018,121, or the like is known. This method basically defines a waveform output e given by the following equation as a tone waveform:

$$e=A\cdot\sin\{\omega_c t+I(t)\sin\omega_m t\} \quad (1)$$

With this method, a carrier frequency $\omega_c$ and a modulation frequency $\omega_m$ are selected at a proper ratio, a modulation index (modulation depth function) I(t) which can be changed over time is set, and an amplitude coefficient A which can be similarly changed over time is set, thereby generating a tone which has complicated harmonic characteristics, and whose harmonic characteristics can be changed over time. Therefore, an electronic musical instrument using this method can synthesize a tone similar to that of an acoustic instrument, and can obtain a very unique synthesized tone.

As the second prior art of the FM method, a method described in Published Examined Japanese Patent Application No. 61-12279 is known. This method adopts a triangular wave arithmetic operation in place of the sine arithmetic operation of equation (1), and defines a waveform output e given by the following equation as a tone waveform:

$$e=A\cdot T\{\alpha+I(t)T(\theta)\} \quad (2)$$

where $T(\theta)$ is the triangular wave function generated by a modulation wave phase angle $\theta$. With this method, a carrier wave phase angle $\alpha$ and the modulation wave phase angle $\theta$ are appropriately advanced, and a modulation index I(t) and an amplitude coefficient A are appropriately set, thus generating a tone waveform.

A tone of an acoustic instrument such as a piano includes a fundamental wave component based on a pitch frequency, and harmonic components at frequencies as integer multiples of the pitch frequency, and a harmonic component of a considerably higher order may be present. Furthermore, the tone often includes harmonic components of fractional orders. Tones having good sound quality are generated by these harmonic components. In a decay process of a tone of an acoustic instrument, the amplitudes of harmonic components are decreased in the order of higher orders, and finally, a single sine wave component corresponding to a pitch frequency remains. Some tones include only single sine wave components. Furthermore, when a key of, e.g., a piano is strongly depressed, a tone including many harmonic components of high orders can be generated. Contrary to this, when a key is very weakly depressed, a tone including only a single sine wave component can be generated.

Since the first prior art of the FM method is based on modulation using a sine wave, when a value of the modulation index I(t) in equation (1) is changed to be closer to 0 over time, a process for decaying a tone to only a single sine wave component, or generation of a tone consisting of only a single sine wave component can be realized, as in a tone of an acoustic instrument. However, frequency components of a tone generated by equation (1) are concentrated on harmonic components of low orders (having low frequencies). Thus, even when deep modulation is executed with a large modulation index I(t), harmonic components of high orders (having high frequencies) cannot satisfactorily appear. Therefore, the first prior art cannot generate a tone having good sound quality, and sound quality of a tone which can be generated is limited. For example, even when the modulation index I(t) can be controlled to have a large value, the levels of harmonic components of high orders which can be generated are limited, and a tone including many harmonics of high orders cannot be generated. As a result, if the first prior art of the FM method is applied to the method of synthesizing a tone while switching the PCM method and the FM method, a desired tone cannot be obtained.

In contrast to this, since the second prior art of the FM method is based on modulation using a triangular wave which originally includes many harmonics, a tone in which harmonic components of high orders are clearly present as frequency components can be easily generated. However, since equation (2) does not include a term of a single sine wave component, a process for decaying a tone to only a single sine wave component, or generation of a tone consisting of only a single sine wave component like in, e.g., a decay portion after an ON event of a high-note key of a piano cannot be realized. Therefore, even when the modulation index I(t) can be controlled to have a small value (e.g., 0), no control for generating only a single sine wave component can be performed, and hence, a soft tone cannot be generated. As a result, even when the second prior art of the FM method is applied to the method of synthesizing a tone while switching the PCM method and the FM method, a desired tone cannot be obtained.

On the other hand, a polyphonic type electronic musical instrument which can use a plurality of tone synthesis methods is known. In a conventional electronic musical instrument of this type, tone generation channels are predetermined in units of tone synthesis methods, and a plurality of tone generators perform time-divisional operations to generate tones of the respective channels. For this reason, each tone generator cannot generate a tone from a channel other than those assigned in advance. For example in a 16-tone polyphonic electronic musical instrument, assume that the PCM method is assigned to the first to eighth channels, and the FM method is assigned to the ninth to 16th channels. In this case, for example, the sixth channel cannot produce a tone generated by the FM method. Even when the FM method is not used at all, the PCM method can only be used in eight channels, resulting in poor efficiency.

When different tone generation methods are merely mixed in an electronic musical instrument, a circuit arrangement is complicated, thus inevitably increasing cost. For example, in each of the above-mentioned prior arts, a portion common to the two methods includes only a circuit for obtaining numerical value data corresponding to a pitch of an ON key, and a circuit for accumulating the numerical value data. Thus, other circuits, i.e., an FM tone generator, a PCM waveform memory, two envelope generators for giving envelopes to the corresponding tone waveforms, multipliers, and the like constitute an uncommon circuit arrangement.

Furthermore, in an electronic musical instrument in which a plurality of different tone synthesis methods are mixed, the above-mentioned method as a combination of the PCM method and the FM method of the first or second prior art may be assigned to different tone generation channels. In this case, however, the FM method of the first prior art cannot generate a tone including many harmonics of high orders, and the FM method of the second prior art cannot generate a soft tone. As a result, a desired tone cannot be obtained.

SUMMARY OF THE INVENTION

The present invention has been made to solve the above-mentioned problems, and has as its object to provide a tone waveform generation apparatus which can arbitrarily assign a plurality of different tone generation processing modes to tone generation channels, and can generate a tone having good sound quality using optimal tone generation processing in correspondence with the characteristics of a tone to be generated.

More specifically, according to one aspect of the present invention, there is provided a tone waveform generation apparatus comprising:

tone generation processing means which has a plurality of tone generation channels to each of which one of a first tone generation processing mode for reading out prestored waveform data at a speed corresponding to a pitch to be assigned, and outputting the readout waveform data as a tone waveform, and a second tone generation processing mode for synthesizing a plurality of signals in accordance with a predetermined algorithm to output waveform data at an assigned pitch as a tone waveform is assigned as processing for generating a tone, and which are subjected to time-divisional processing;

pitch designation means for designating a pitch of a tone;

processing designation means for designating desired tone generation processing from the first and second tone generation processing modes in units of tone generation channels, and outputting corresponding processing designation data;

pitch assignment means for assigning a pitch designated by the pitch designation means to each of the tone generation channels of the tone generation processing means; and processing assignment means for assigning processing designation data output from the processing designation means to each of the tone generation channels of the tone generation processing means.

With the above arrangement, two tone generation processing modes can be arbitrarily assigned in units of tone generation channels in correspondence with the characteristics of tones to be generated. In particular, for a tone generation channel for generating a tone having characteristics which are difficult to reproduce by a synthesis method due to a complicated variation in its harmonic structure, a waveform data read method can be assigned, thus allowing generation of a tone having better sound quality.

It is another object of the present invention to provide an apparatus which can arbitrarily assign a plurality of tone generation processing modes to tone generation channels, and can desirably generate a tone which includes up to harmonic components of high orders, a tone consisting of only a single cosine wave component, and a tone which includes noise components and harmonics which complicatedly vary.

More specifically, according to another aspect of the present invention, there is provided a tone waveform generation apparatus comprising:

tone generation processing means which has a plurality of time-divisionally processed tone generation channels to each of which one of a first tone generation processing mode and a second tone generation processing mode is assigned, said first tone generation processing mode reading out prestored waveform data at a speed corresponding to a pitch designated by input performance data and outputting the readout waveform data as a tone waveform, and said second tone generation processing mode mixing a modulation signal in a carrier signal at an arbitrary mixing ratio based on the performance data and converting the mixed output on the basis of a predetermined functional relationship to generate a modulated tone signal, the predetermined functional relationship being neither of sine and cosine functional relationships, and the carrier signal setting the modulated tone signal to have a sine or cosine wave when the mixing ratio is controlled to be a predetermined mixing ratio, and said tone generation processing means generating a tone on the basis of a pitch assigned to each of the tone generation channels, and the tone generation processing mode selected by processing designation data assigned to each of the tone generation channels;

pitch designation means for designating a pitch;

processing designation means for designating desired processing from the first and second tone generation processing modes in units of channels, and outputting corresponding processing designation data;

pitch assignment means for assigning a pitch designated by the pitch designation means to each of the channels of the tone generation processing means; and processing assignment means for assigning processing designation data output from the processing designation means to a corresponding one of the channels.

With this arrangement, a modulated tone signal can include harmonic components, and a tone similar to that of an acoustic instrument can be generated. In addition, a unique synthesized tone can also be obtained. In particular, as the predetermined functional relationship, when a functional relationship other than a sine function or a cosine function is set, a modulated tone signal to be output can include more harmonic components of high orders. On the other hand, a modulated tone signal has a sine or cosine waveform when a mixing ratio of a carrier signal and a modulation signal is set to be a predetermined value. Thus, when the mixing ratio is changed between the predetermined value and another value, a modulated tone signal can be arbitrarily and continuously controlled between a state including harmonic components of high orders, and a state including only a sine or cosine wave component at a single frequency.

A player can arbitrarily select in units of tone generation channels whether tones are generated by the second tone generation processing or tones are generated by the first tone generation processing based on the waveform readout method. The control means dynamically selects and operates the different tone generation processing modes on the basis of the selection. Therefore, the tone generation channels can be efficiently used.

In this case, in a tone generation channel to which the second tone generation processing is assigned, a modulated tone signal can be arbitrarily and continuously changed between a state including harmonic components of high orders and a state including only a sine or cosine wave component at a single frequency unlike the conventional frequency modulation (FM) method. For this reason, a tone color which can change very complicatedly and dramatically can be generated in the tone generation channel.

It is still another object of the present invention to provide an apparatus which can desirably generate a tone including up to harmonic components of high orders, and a tone consisting of only a single sine or cosine wave component, and can desirably synthesize a tone including noise components and harmonic components which vary complicatedly.

More specifically, according to still another aspect of the present invention, there is provided a tone waveform generation apparatus comprising:

tone generation means for executing first tone generation processing for reading out prestored waveform data at a speed corresponding to a designated pitch, and outputting the readout waveform data as a tone signal, and second tone generation processing for mixing a modulation signal in a carrier signal at an arbitrary mixing ratio based on the performance data, and converting the mixed output on the basis of a predetermined functional relationship to generate a modulated tone signal, the predetermined functional relationship being neither of sine and cosine functional relationships, and the carrier signal setting the modulated tone signal to have a sine or cosine wave when the mixing ratio is controlled to be a predetermined mixing ratio; and control means for causing, on the basis of a tone generation start instruction, the tone generation means to start generation of the tone signal by the first tone generation processing or generation of the modulated tone signal by the second tone generation processing, mixing the tone signal and the modulated tone signal in accordance with a predetermined mixing characteristic which can change over time, and outputting the mixed output as a mixed tone signal.

With this arrangement, a state of a modulated tone signal generated by the second tone generation processing can be arbitrarily and continuously controlled between a state including harmonic components of high orders and a state including only a sine or cosine wave component at a single frequency unlike the conventional FM method. According to the present invention, a mixed tone signal obtained by mixing a PCM tone signal which can generate a tone color faithful to that of an acoustic instrument, and a modulated tone signal which can generate a tone color which can change complicatedly and dramatically in accordance with arbitrary mixing characteristics can be generated. As a result, a tone including up to harmonic components of high orders, a tone consisting of only a single sine or cosine wave component, and a tone including noise components and harmonic components which vary complicatedly can be desirably synthesized.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

Other objects and features of the present invention will be easily understood for those who are skilled in the art from the descriptions of the preferred embodiments taken in conjunction with the accompanying drawings, in which:

FIGS. 9A to 9E are waveform charts showing various waveforms generated by the modulation unit 7;

FIGS. 20A to 20C are charts showing the relationship among phase data, PCM addresses, and a PCM signal;

FIGS. 21A to 21C are charts showing the relationship among phase data, carrier addresses, and a carrier signal;

DETAILED DESCRIPTION OF THE PREFERRED EMBODIMENTS

The first embodiment in which the present invention is applied to an electronic keyboard instrument will be described below with reference to the accompanying drawings.

Figures 1A, 1B, 1C:
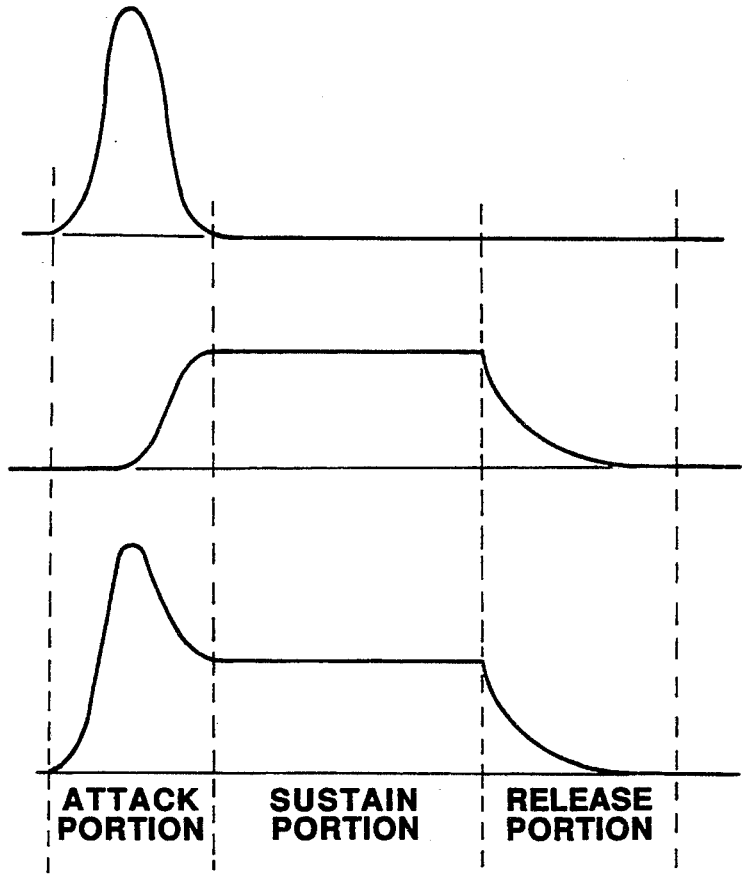
FIGS. 1A to 1C are envelope waveform charts of conventional tones.
Figure 2:
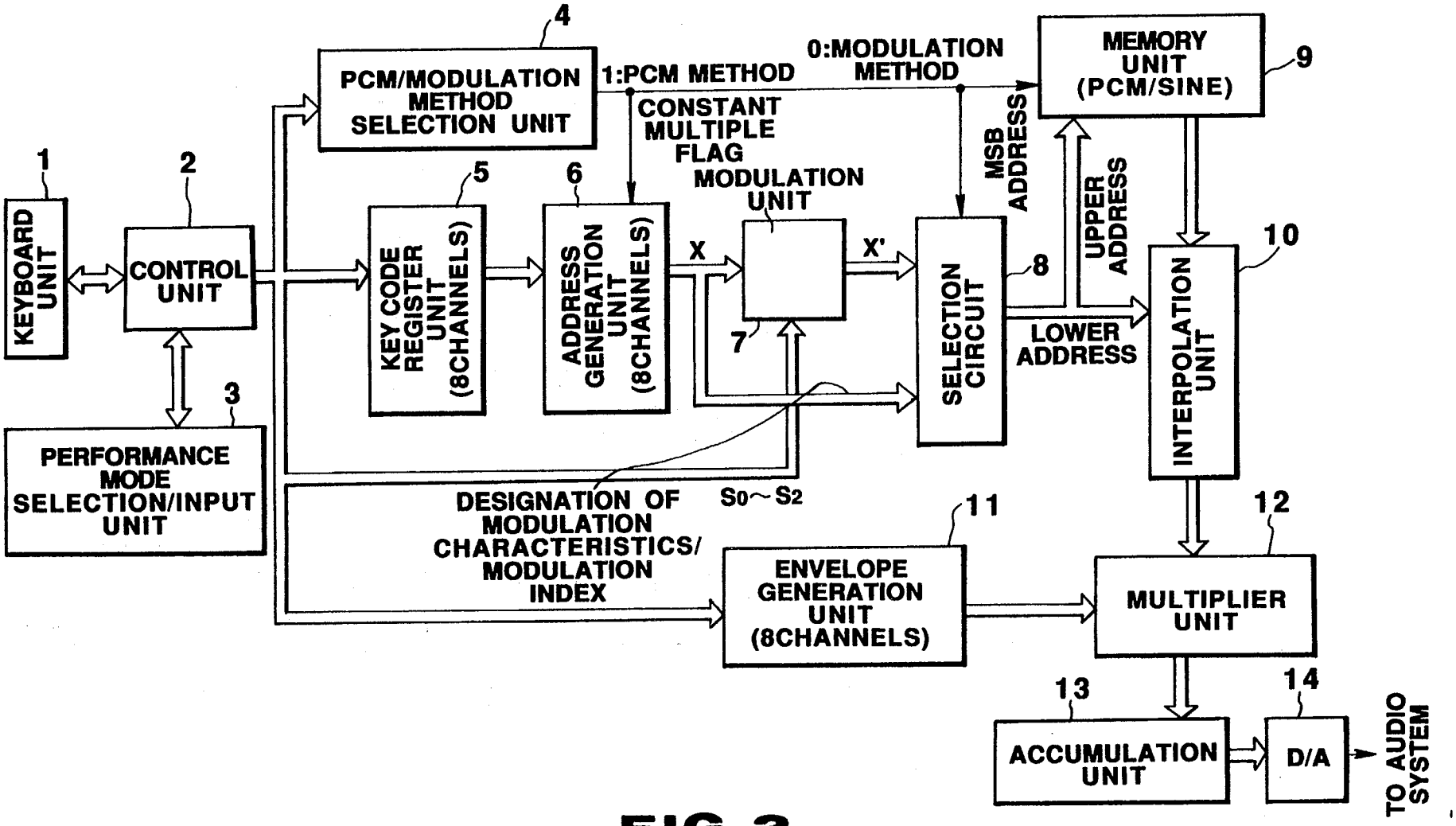
FIG. 2 is a block diagram showing the overall arrangement of the first embodiment of the present invention.

FIG. 2 is a block diagram showing the overall arrangement of the first embodiment of the present invention.

A performance mode selection/input unit 3 has a performance mode selection switch (not shown). The switch is used by a player to select a desired performance mode from some performance modes in each of which one or a plurality of tone synthesis methods are assigned to tone generation channels.

A CPU (central processing unit) in a control unit 2 controls this instrument system in accordance with a program written in a ROM (read-only memory; not shown).

The control unit 2 scans a keyboard unit 1 at predetermined time intervals to fetch ON or OFF key data of the keyboard unit 1. Upon detection of the depression of a key, the control unit 2 assigns the depressed key to one of a plurality of tone generation channels, and sends operation data of the key to a key code register unit 5. The key code register unit 5 temporarily stores a key code on the basis of the operation data of the key sent from the control unit 2, and outputs pitch data corresponding to the key code, i.e., incremental width data for reading a memory unit 9 to an address generation unit 6.

A PCM/modulation method section unit 4 designates one of a PCM method and a modulation method on the basis of selection data of a tone synthesis method sent from the control unit 2, and outputs a flag for operating a constant multiplier (to be described later).

The address generation unit 6 outputs an address signal X corresponding to an accumulated value of incremental widths corresponding to pitch data sent from the key code register unit 5 (for this reason, an incremental speed for reading the memory is changed in accordance with a pitch of a depressed key). The address signal X is used for reading out data from a waveform memory in the memory unit 9, and is also input to a modulation unit 7 as non-modulated original phase angle data.

The memory unit 9 prestores waveform data such as tone waveform data used in the PCM method, and sine wave data used in the modulation method. The PCM tone waveform data and the sine wave data are read out from different addresses.

The modulation unit 7 is a circuit for modulating an address signal for reading a sine wave memory of the memory unit 9 when tone synthesis is performed by the modulation method.

A selection circuit 8 is a gate circuit. When the flag output from the PCM/modulation method selection unit 4 is "1" (PCM method), the circuit 8 selects the address signal x output from the address generation unit 6; when the flag is "0" (modulation method), it selects an address signal X' modulated by the modulation unit 7. Of the output from the selection circuit 8, an upper address corresponding to an integral part of an address is input to the memory unit 9. On the other hand, a lower address corresponding to a decimal part of the address is input to an interpolation unit 10. The interpolation unit 10 obtains waveform data at an address corresponding to the integral part+the decimal part.

The interpolation unit 10 will be described below.

Figure 3A:
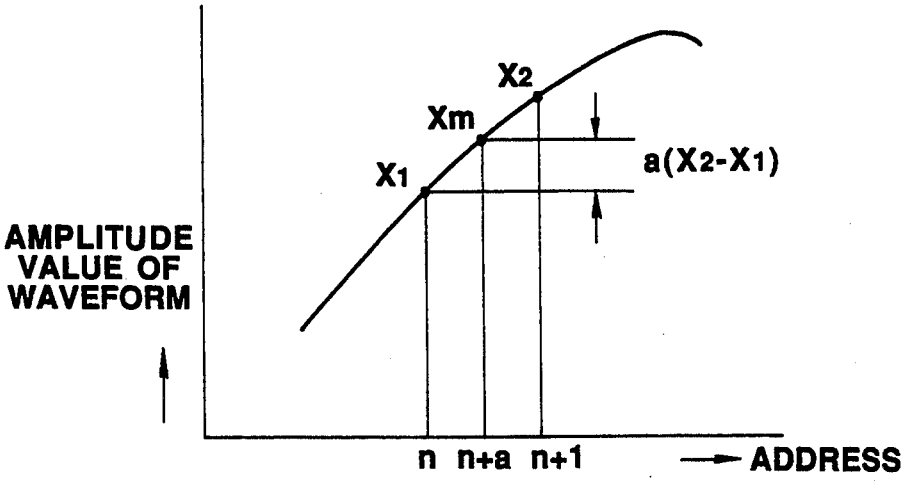
FIGS. 3A and 3B are respectively a graph and a diagram for explaining an interpolation unit 10.

When waveform data is read out from the memory unit 9, an amplitude value $X_m$ (an interpolated value of $X_1$ and $X_2$, and is located on a line connecting $X_1$ and $X_2$) corresponding to an intermediate portion n+a (for $0<a<1$) of two adjacent addresses n and n+1 of the memory unit 9 is often required depending on a pitch of an ON key, as shown in FIG. 3A. a is the decimal part of the address, and corresponds to the lower address.

$X_m$ is obtained as follows.

Figure 3B:
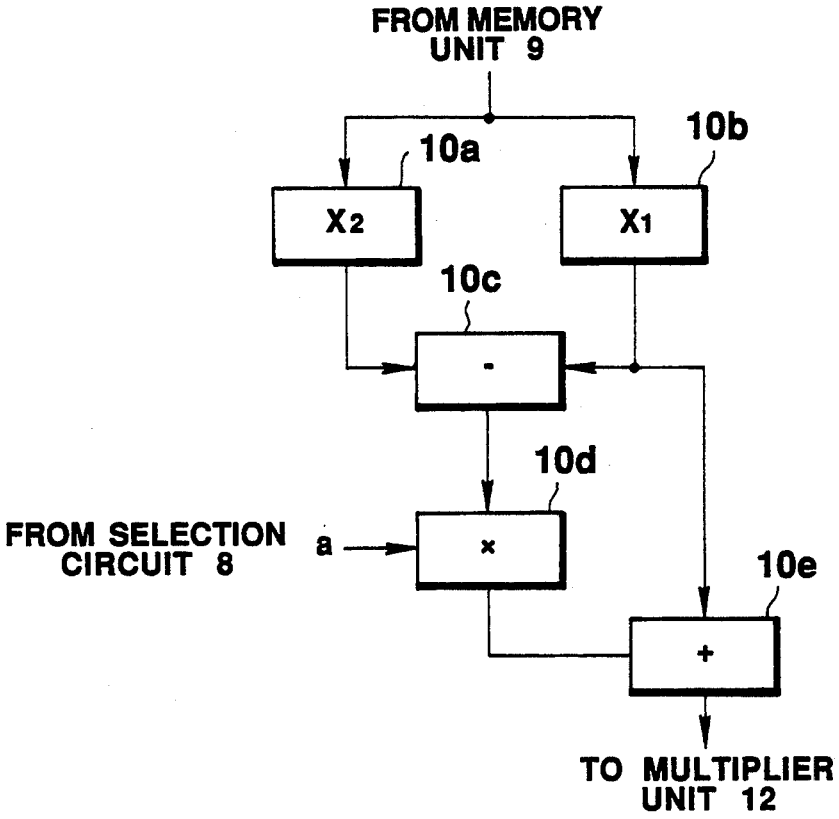

FIG. 3B is a diagram showing the principle of the interpolation unit 10. In FIG. 3B, a difference $(X_2-X_1)$ of outputs from registers 10*a* and 10*b* for temporarily storing amplitude values $X_1$ and $X_2$ corresponding to addresses n and n+1 is obtained by a subtractor 10*c*. The difference $(X_1-X_2)$ is multiplied with the lower address value a by a multiplier 10*d* to obtain $a(X_2-X_1)$. Thereafter, an adder 10*e* adds the product $a(X_2-X_1)$ and the amplitude value $X_1$ at the address n to obtain the amplitude value $X_m$. That is, we have:

$$X_1+a(X_2-X_1)=X_m \quad (3)$$

In this manner, the amplitude value $X_m$ of the address (n+a) can be obtained from amplitude values $X_1$ and $x_2$ of addresses $n_1$ and $n_2$ by the interpolation unit 10. When the lower address a is 0, no interpolation is performed, and the waveform data from the memory unit 9 is directly output to a multiplier unit 12 via the register 10*b* and the adder 10*e* shown in FIG. 3B.

The waveform data for one channel obtained as described above is multiplied with an envelope signal from an envelope generation unit 11 by the multiplier unit 12. Thereafter, waveform data for eight channels are added by an accumulation unit 13 in units of sampling periods, and the sum signal is converted to an analog tone signal by a D/A converter 14. The analog signal is sent to an audio system.

The relationship between tone synthesis methods assigned to the tone generation channels and key codes will be described below with reference to FIGS. 4A to 4D. FIGS. 4A to 4D exemplify an 8-tone polyphonic system.

Figures 4A, 4B, 4C, 4D:
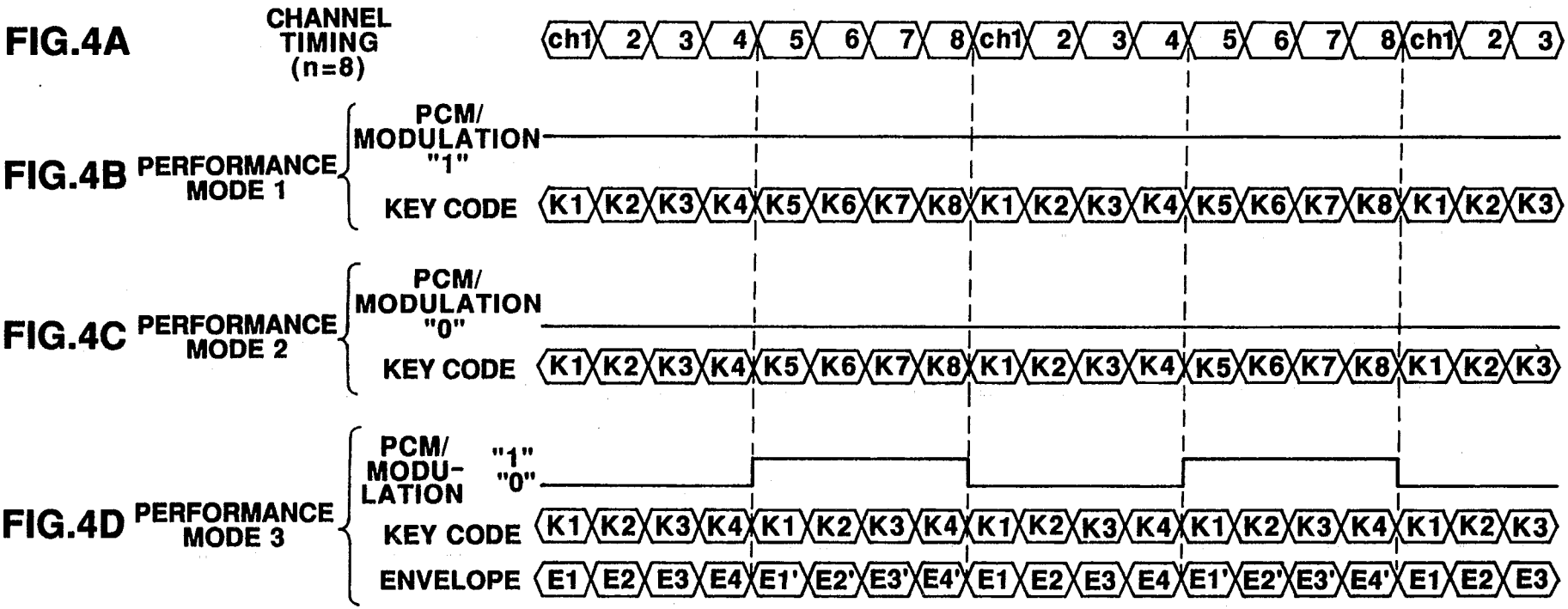
FIGS. 4A to 4D are charts showing the relationship between tone synthesis methods assigned to respective tone generation channels, and key codes in units of performance modes.

In a performance mode 1 shown in FIG. 4B, only a PCM method is used as the tone synthesis method, and the flag of the PCM/modulation method selection unit 4 shown in FIG. 2 is always "1". As shown in FIG. 4A, tone waveform data by the PCM method are assigned to all the eight channels for eight depressed keys (key codes K1, K2, K3, . . . K8).

In a performance mode 2 shown in FIG. 4C, a modulation method, e.g., a phase modulation method or a frequency modulation (FM) method is solely used. The flag of the PCM/modulation method selection unit 4 is always "0", and tone waveform data by the modulation method are assigned to all the eight channels for eight depressed keys (key codes K1, K2, K3, . . . K8), as shown in FIG. 4C.

A performance mode 3 shown in FIG. 4D is a characteristic mode of this embodiment. In this embodiment, the flag output from the PCM/modulation method selection unit 4 is changed in units of tone generation channels in accordance with a control signal output from the control unit 2, so that the PCM method and the modulation method are switched in units of four tone generation channels. Tone generation is performed by the two tone synthesis methods for key codes (K1, K2, K3, K4) of tone generation channels 1 to 4 and tone generation channels 5 to 8, so that each of these methods can produce four polyphonic tones. In this case, different envelopes E1, E2, E3, and E4, or E1', E2', E3', and E4' are given to tones corresponding to the four key codes (K1, K2, K3, K4) of each of the two methods in units of tone generation channel timings. In the performance mode 3, tones synthesized by the two methods, i.e., the PCM method and the modulation method, are simultaneously produced in the auditory sense, thus obtaining non-monotonous, "deep" tones.

The address generation unit 6 commonly used for both the PCM and modulation methods will be described below.

In this embodiment, when addresses are designated to sequentially read out waveform data from the memory unit 9 (FIG. 2), the incremental width of the address must be changed in accordance with a key code of a depressed key, i.e., a pitch. The address generation unit 6 changes this incremental width, and FIG. 5 shows the circuit arrangement of the unit 6.

Figure 5:
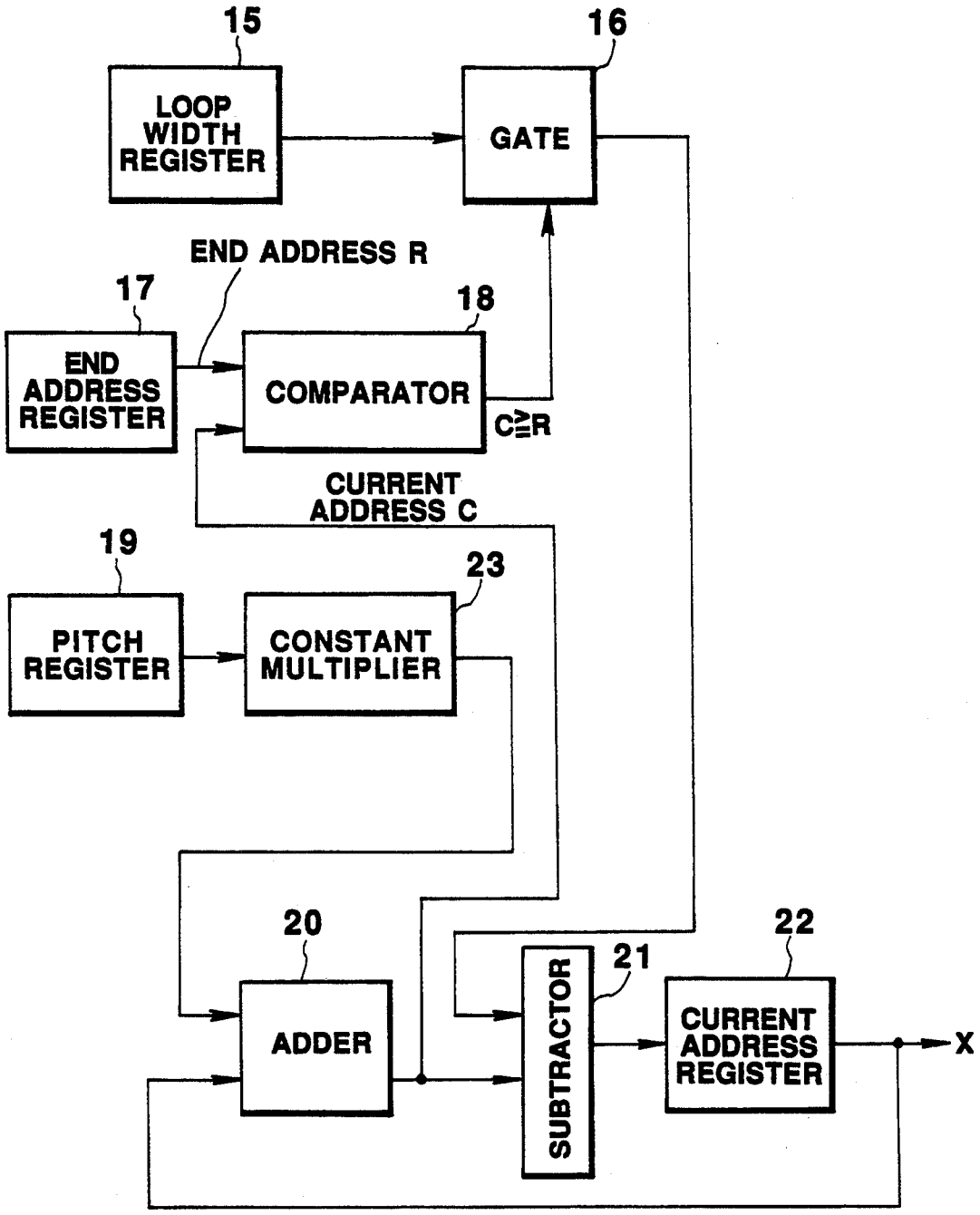
FIG. 5 is a block diagram of an address generator 6.

In FIG. 5, an adder 20 and a current address register 22 for storing an address which sequentially changes serve as an accumulator. A pitch register 19 temporarily stores incremental width data sent from the key code register unit 5. The incremental width data is input to the above-mentioned accumulator via a constant multiplier 23 (to be described later), and is accumulated at an incremental width according to a pitch of a depressed key. As a result, if an incremental width of a given tone is assumed to be 1, a series of accumulated values such as 1, 2, 3, . . . or 2, 4, 6, . . . for a tone higher by one octave are sequentially output from the current address register 22. These values are address signals X for reading the memory unit 9. The address signal X corresponds to address data for reading out waveform data from the memory unit 9 when the PCM method is selected. However, when the modulation method is selected, the address signal X corresponds to non-modulated original phase angle data.

As described above, the memory unit 9 stores tone waveform data for the PCM method, and sine wave data used in the modulation method. The tone waveform data for the PCM method is obtained by sampling a tone waveform of an acoustic instrument having a given pitch frequency at a predetermined sampling period. On the other hand, sampling data for the modulation method is obtained by sampling a sine wave at a given pitch frequency (normally, a lowest frequency of a tone) at a frequency higher than a sampling frequency of the PCM method.

In this embodiment, in order to mix the PCM method and the modulation method, and to parallelly produce tones, the constant multiplier 23 is operated to equalize a pitch of a tone waveform produced by the phase or frequency modulation method to that by the PCM method.

In order to operate the constant multiplier 23, a constant multiple flag is output from the PCM/modulation method selection unit 4. The constant multiple flag is set to be "1" for the PCM method and to be "0" for the modulation method like in the flag for designating the tone synthesis method. When the flag is "1" (PCM method), the constant multiplier 23 sets a constant multiplication factor to be "1", and when the flag is "0" (modulation method), it sets the constant multiplication factor to be the predetermined value.

In order to synthesize a tone on the basis of waveform data from the memory unit 9, the memory must be repetitively read access in such a manner that once read access starts from a start address and ends at an end address, the address is returned to the start address again. This operation is called loop reproduction. For this purpose, address width (to be referred to as loop width hereinafter) data from the start address to the end address is prestored in a loop width register 15.

The loop reproduction operation will be described below.

A comparator 18 checks if a current address C output from the adder 20 becomes equal to or exceeds an end address R set in an end address register 17. If the current address C becomes equal to or exceeds the end address R, the above-mentioned loop width is subtracted from the current address C by a subtractor 21 to return the current address to the start address.

Figure 6A:
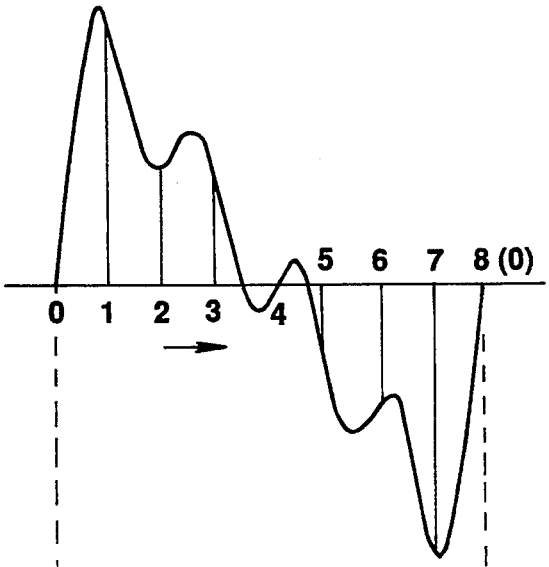
FIGS. 6A to 6D are charts for explaining loop reproduction.
Figure 6B:
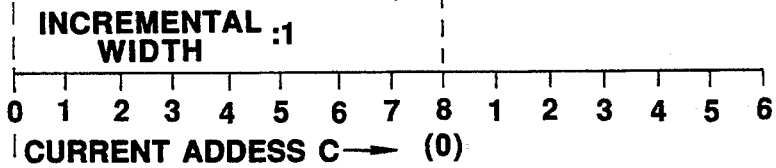
Figure 6C:
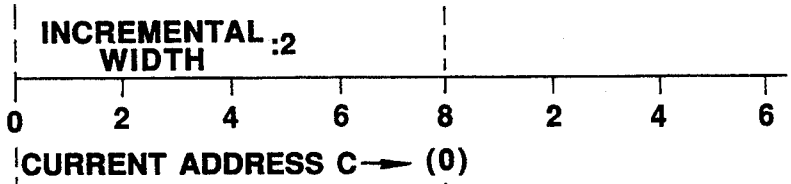

Read access of the memory unit 9 (FIG. 2) may not be precisely ended at the end address depending on an incremental width. For example, assume that a tone waveform shown in FIG. 6A (in this embodiment, a waveform for one period is subjected to loop reproduction) stored in the memory unit 9 is read out therefrom using addresses shown in FIG. 6A. When an incremental width output from the pitch register 19 shown in FIG. 5 is 1 or 2, a value "8" of the current address C coincides with a value "8" of the end address R, as shown in FIG. 6B or 6C. As a result, a loop width "8" is subtracted from an output "8" from the adder 20 by the subtractor 21, and an output from the current address register 22 becomes zero. Thus, the current address C is returned to a start address "0", and is incremented like 1, 2, 3, . . . or 2, 4, 6, . . . .

Figure 6D:
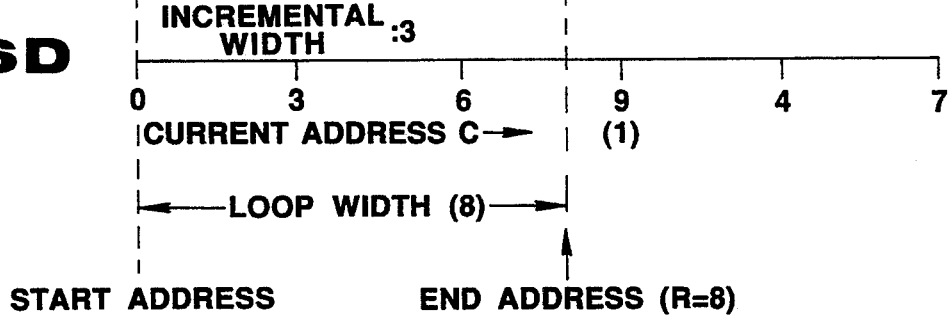

On the other hand, in the case of an incremental width=3 in FIG. 6D, the current address is incremented like 0, 3, 6, 9, and exceeds "8" as the end address. Thus, the loop width "8" is subtracted from the output "9" from the adder 20, and the output from the current address register 22 becomes "1". Therefore, loop reproduction starts from not the address "0" but from an address "1", and the address is incremented like 4, 7, . . . , by the incremental width=3.

In this manner, the address of the memory unit 9 is updated by the loop width predetermined in the loop width register 15, and a tone waveform stored in the memory unit 9 is repetitively reproduced, thus obtaining a tone waveform free from a discontinuous point.

The way of modulating the address signal X in the modulation unit 7 will be described in turn using first and second arrangements by the phase modulation method, and a third arrangement by the frequency modulation method.

The first arrangement of the modulation unit 7 will be described below. In the first arrangement, the address signal x for reading the memory unit 9 (FIG. 2) for storing sine wave data is changed to change a phase angle of a read position of a sine wave, thus obtaining various waveforms. The address signal X will be referred to as original phase angle data X hereinafter.

The operation principle of the first arrangement will be explained below.

Figure 7A:
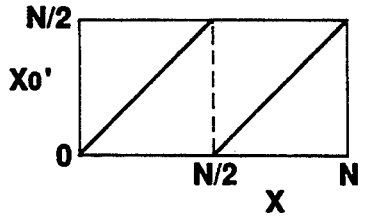
FIGS. 7A to 7G are charts showing a change in phase angle data in a first arrangement of a modulation unit 7.
Figure 7B:
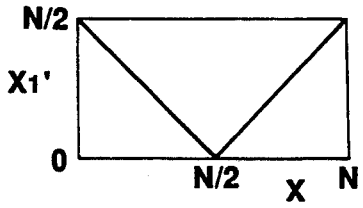
Figure 7C:
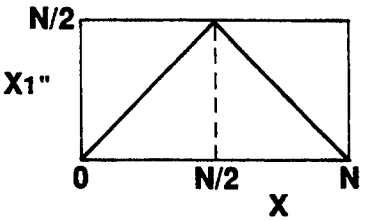
Figure 7D:
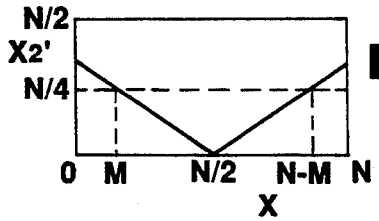
Figure 7E:
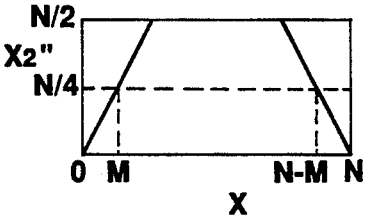
Figure 7F:
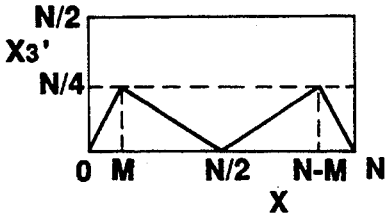
Figure 7G:
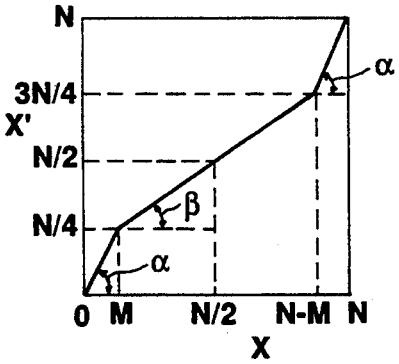

FIG. 7G shows the relationship between original phase angle data X, and changed phase angle data X' obtained by a circuit shown in FIG. 8 (to be described later). As can be seen from FIG. 7G, in this embodiment, X and X' are related by an inclination of a polygonal function. From FIG. 7G, if an inclination of a polygonal line in FIG. 7G is represented by $\alpha$ when $0 \leqq X < M$ and $N-M \leqq X < N$, and is represented by $\beta$ when $M \leqq X < N-M$, we have:

$$\alpha=(N/4)/M \tag{4}$$

$$\beta=(N/4)/(N/2-M) \tag{5}$$

From these equations, we have:

$$1/\alpha+1/\beta=2 \tag{6}$$

where N represents $2\pi$ radians (one period) of a phase angle, and M represents the switching point of inclinations of polygonsal line. When $X=M$, $X'=N/4=\pi/2$, and a maximum value of a sine wave stored in the memory unit 9 (FIG. 2) can be accessed.

Figure 8:
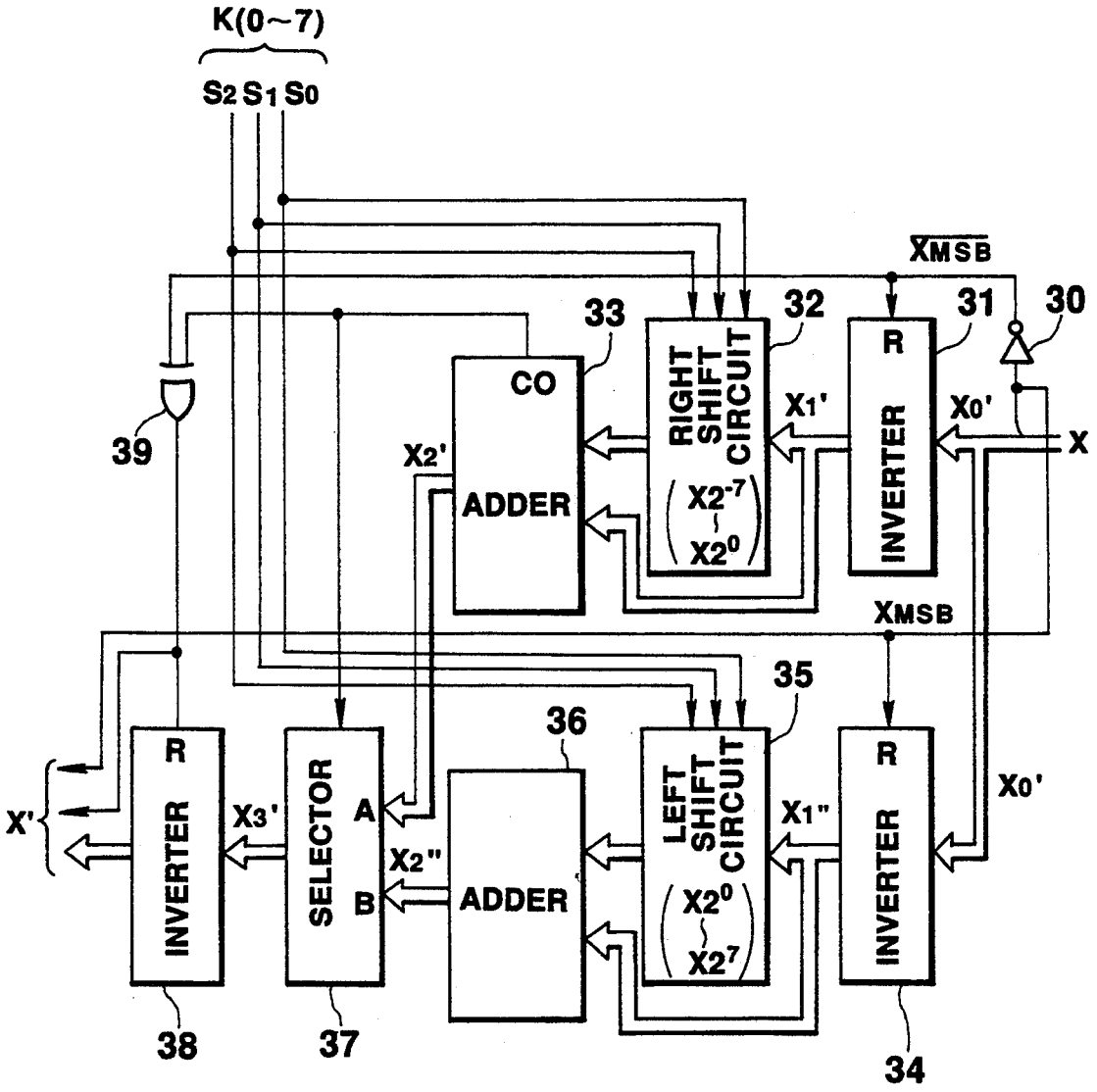
FIG. 8 is a block diagram of the modulation unit 7.
Figure 10A:
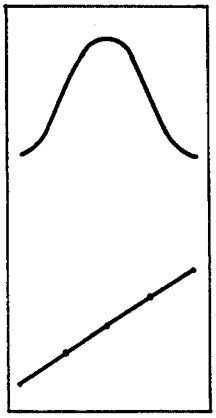
FIGS. 10A to 10G are charts showing modulated waveform data.
Figure 10B:
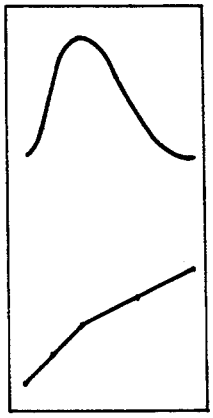
Figure 10C:
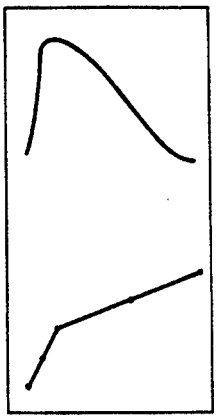
Figure 10D:
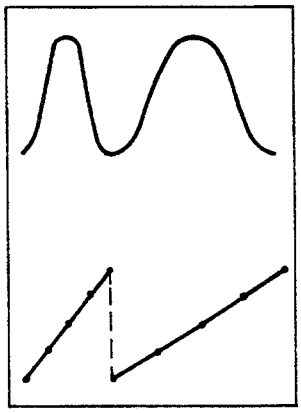
Figure 10E:
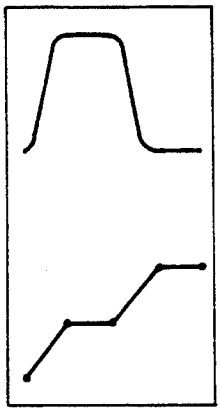
Figure 10F:
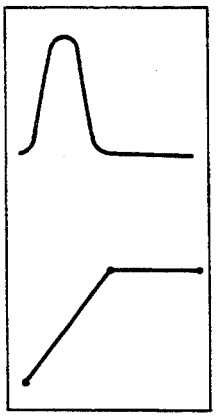
Figure 10G:
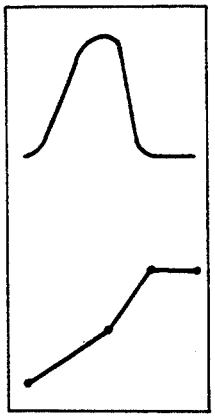

The circuit shown in FIG. 8 equivalently performs an arithmetic operation for multiplying the original phase angle data X with $\alpha$ when $0 \leqq X < M$ and $N-M \leqq X < N$ or $\beta$ when $M \leqq X < N-M$, thereby obtaining changed phase angle data X'.

Furthermore, in the circuit shown in FIG. 8 (to be described later), $\alpha$ and $\beta$ are determined to yield:

$$\beta=\alpha/2^k \tag{7}$$

(for k=0, 1, 2, . . . 7)

From equation (6) and (7) we have:

$$\alpha=(1+2^k)/2 \tag{8}$$

$$\beta=(1+2^{-k})/2 \tag{9}$$

After k is determined, the circuit shown in FIG. 8 equivalently performs arithmetic operations given by the following equations from equations (8) and (9):

When $0 \leqq X < M$ and $N-M \leqq X < N$, $$\begin{aligned} X' &= \alpha X \\ &= \{(1+2^k)/2\}X \\ &= 2^{-1}X + 2^{k-1}X \end{aligned} \tag{10}$$

When $M \leqq X < N-M$, $$\begin{aligned} X' &= \beta X \\ &= \{(1+2^{-k})/2\}X \\ &= 2^{-1}X + 2^{-k-1}X \end{aligned} \tag{11}$$

Note that the arithmetic operations given by equations (10) and (11) can be executed by a binary bit-shift operation.

In order to equivalently perform the arithmetic operations given by equations (10) and (11), the circuit shown in FIG. 8 sequentially executes the following arithmetic operations.

① When lower bits obtained by excluding the most significant bit (MSB) $X_{MSB}$ from the original phase angle data X are extracted, data $X_0'$ which is repeated to have N/2 as a boundary, as shown in FIG. 7A, with respect to a change in original phase angle data X is obtained.

② $X_0'$ is appropriately inverted to obtain data $X_1'$ and $X_1''$ which have characteristics, as shown in FIGS. 7B and 7C, with respect to a change in original phase angle data X.

③ $X_1'$ is multiplied with $\beta$, and $X_1''$ is multiplied with $\alpha$, thus obtaining data $X_2'$ and $X_2''$ having characteristics, as shown in FIGS. 7D and 7E, with respect to a change in original phase angle data X.

④ When $X_2' \geqq N/4$, $X_2''$ is selected, and when $X_2' < N/4$, $X_2'$ is selected, thereby obtaining data $X_3'$ having characteristics, as shown in FIG. 7F, with respect to a change in original phase angle data X.

⑤ When $0 \leqq X < M$, $X_3'$ is selected; when $M \leqq X < N/2$, an arithmetic operation $(N/2 - X_3')$ is executed; when $N/2 \leqq X < N - M$, an arithmetic operation $(X_3' + N/2)$ is executed; and when $N - M \leqq X \leqq N$, an arithmetic operation $(N/2 - X_3') + N/2$ is executed.

With the arithmetic operations ⑤ to ⑤ the circuit shown in FIG. 8 executes the arithmetic operations equivalent to equations (10) and (11) described above, and modulated phase angle data X' having polygonal characteristics shown in FIG. 7G with respect to a change in original phase angle data X can be obtained.

As the arrangement of the modulation unit 7 shown in FIG. 2, the circuit shown in FIG. 8 for realizing the arithmetic operations ① to ⑤ described above will be described below.

Lower bits obtained by excluding the MSB $X_{MSB}$ from the original phase angle data X output from the address generation unit 6 are extracted to obtain $X_0'$. This corresponds to the above-mentioned arithmetic operation ①.

$X_0'$ is input to inverters 31 and 34. In this case, a control terminal R of the inverter 31 receives a signal $\overline{X_{MSB}}$ obtained by inverting the MSB $X_{MSB}$ of the original phase angle data X by an inverter 30. On the other hand, a control terminal R of the inverter 34 directly receives the MSB $X_{MSB}$. Thus, when the MSB $X_{MSB}$ is "0", the inverter 31 inverts the input $X_0'$, and outputs it as $X_1'$, and when the MSB is "1", it directly outputs the input $X_0'$ as $X_1'$. On the other hand, when the MSB $X_{MSB}$ is "0", the inverter 34 directly outputs the input $X_0'$ as $X_1'$, and when the MSB is "1", it inverts the input $X_0'$, and outputs it as $X_1''$. As a result, phase angle data $X_1'$ and $X_1''$ shown in FIGS. 7B and 7C are obtained. The above-mentioned operations correspond to the arithmetic operation ②.

Thereafter, a right shift circuit 32 shifts the phase data $X_1'$ to the right by k bits to calculate $2^{-k}X_1'$. An adder 33 respectively shifts the output $2^{-k}X_1'$ from the right shift circuit 32, and the phase angle data $X_1'$ by one bit to the right, and adds the shifted data to each other to obtain:

$$\begin{aligned} X_2' &= \beta X_1' \\ &= \{(1 + 2^{-k})/2\}X_1' \\ &= 2^{-1}X_1' + 2^{-k-1}X_1' \end{aligned} \tag{12}$$

On the other hand, a left shift circuit 35 shifts the phase angle data $X_1''$ to the left by k bits to calculate $2^kX_1''$. An adder 36 respectively shifts the output $2^kX_1''$ from the left shift circuit 35, and the phase angle data $X_1''$ by one bit to the right, and adds the shifted data to each other to obtain:

$$\begin{aligned} X_2'' &= \alpha X_1'' \\ &= \{(1 + 2^{k})/2\}X_1'' \\ &= 2^{-1}X_1'' + 2^{k-1}X_1'' \end{aligned} \tag{13}$$

A coefficient k for determining a shift amount in the right and left shift circuits 32 and 35 is given by 3-bit control data $S_0$ to $S_2$ input from the control unit 2 shown in FIG. 2 to the modulation unit 7.

A selector 37 selects $X_2''$ only when the adder 33 outputs a carry-out signal CO, i.e., only when $X_2' \geqq N/4$; otherwise, it selects $X_2'$ thereby outputting phase angle data $X_3'$ having characteristics shown in FIG. 7F with respect to the original phase angle data x. The above-mentioned operations correspond to the arithmetic operation ④ described above.

An inverter 38 selectively inverts the output $X_3'$ from the selector 37. The inverter 38 inverts $X_3'$ when an output from an exclusive OR gate 39 which receives the signal $\overline{X_{MSB}}$ obtained by inverting $X_{MSB}$ by the inverter 30, and the carry-out signal CO from the adder 33, is "1". Since one of $\overline{X_{MSB}}$ and the carry-out signal CO goes to "1" and the other one goes to "0" within a range of $M \leqq X < N/2$ and $N - M \leqq X < N$, the output from the exclusive OR gate 39 goes to "1" within this range, and $X_3'$ is inverted. Within a range of $0 \leqq X < M$ and $N/2 \leqq X < N - M$, the output from the exclusive OR gate 39 goes to "0", and $X_3'$ is directly output.

The output from the exclusive OR gate 39 is added to the output from the inverter 38 as upper bits. Furthermore, the MSB $X_{MSB}$ is added to the above sum as the MSB, thus obtaining the final modulated phase angle data X'. The values of the output from the exclusive OR gate 39 and the $X_{MSB}$ are (0, 0) when $0 \leqq X < M$; (1, 0) when $M \leqq X < N/2$; (0, 1) when $N/2 \leqq X < N - M$; and (1, 1) when $N - M \leqq X \leqq N$. For this reason, the value of the modulated phase angle data X' becomes equal to a value output from the inverter 38 when $0 \leqq X < M$; is equal to a sum of a value output from the inverter 38 and N/4 when $M \leqq X < N/2$; is equal to a sum of a value output from the inverter 38 and N/2 when $N/2 \leqq X < N - M$; and is equal to a sum of a value output from the inverter 38 and 3N/4 when $N - M \leqq X \leqq N$. Consequently, the modulated phase angle data X' having characteristics shown in FIG. 7G with respect to the original phase angle data X can be obtained.

FIGS. 9A to 9E show various waveform data obtained by accessing sine wave data of the memory unit 9 using modulated phase angle data X' obtained from the modulation unit 7 (FIG. 2) comprising the circuit shown in FIG. 8. As can be seen from FIGS. 9A to 9E, as the value of the coefficient k is increased, a waveform is gradually changed from a sine wave to a sawtooth wave.

In the above description, the polygonal characteristics shown in FIG. 7G are used. When circuits for generating modulated phase angle data X' having polygonal characteristics shown in the lower columns of FIGS. 10A to 10G are provided, waveform data modulated shown in the upper columns of FIGS. 10A to 10G can be obtained.

A second arrangement of the modulation unit 7 will be described below.

Figure 11:
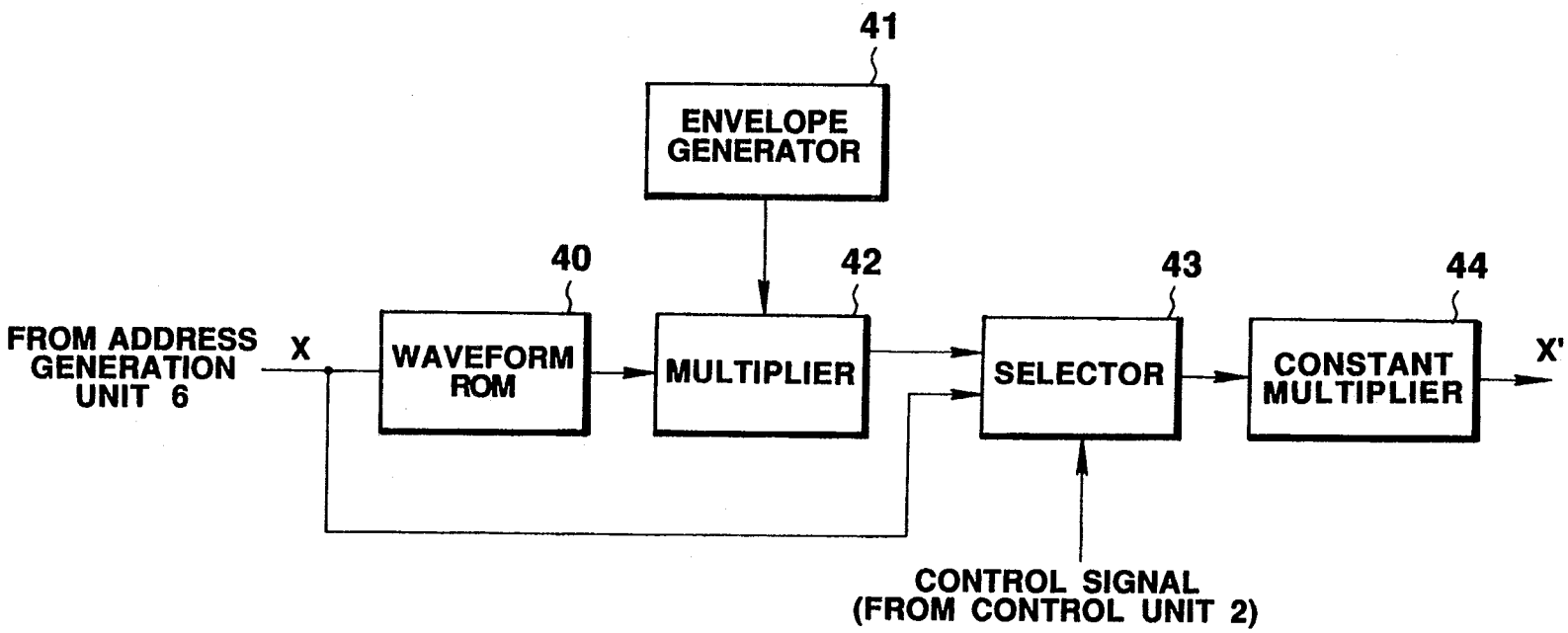
FIG. 11 is a block diagram showing a second arrangement of a modulation unit 7.

FIG. 11 is a block diagram showing the second arrangement of the modulation unit 7 based on a phase modulation method different from that in the first arrangement.

In FIG. 11, a waveform ROM 40 for storing a sine wave or a waveform different from the sine wave is subjected to read access based on the address signal X output from the address generation unit 6 (FIG. 2). The readout waveform is multiplied with an envelope output from an envelope generator 41 by a multiplier 42. The waveform is then input to a selector 43. The selector 43 directly receives the address signal X, and selects one of the two inputs in accordance with a control signal output from a CPU (not shown). Thereafter, the output from the selector 43 is multiplied with a predetermined multiplication factor by a constant multiplier 44, thereby increasing a read incremental width of the memory unit 9 (FIG. 2) to several times to 10 to 20 times the incremental width for the PCM method. The output from the constant multiplier 44 serves as the output X' from the modulation unit 7 shown in FIG. 2. Since the constant multiplier 44 is used, the constant multiplier 23 (FIG. 5) of the address generation unit 6 shown in FIG. 2 is omitted.

In the circuit shown in FIG. 11, when the selector 43 selects the address signal, a sine wave is read out from a sine table of the memory unit 9. When the selector 43 selects the output from the multiplier 42, a more complicated waveform can be obtained. In particular, when the waveform ROM 40 stores various waveforms, the output X' can become a further complicated signal as compared to the first arrangement described above, and waveform data read out from the memory unit 9 can have further complicated characteristics.

A third arrangement of the modulation unit 7 will be described below.

Figure 12:
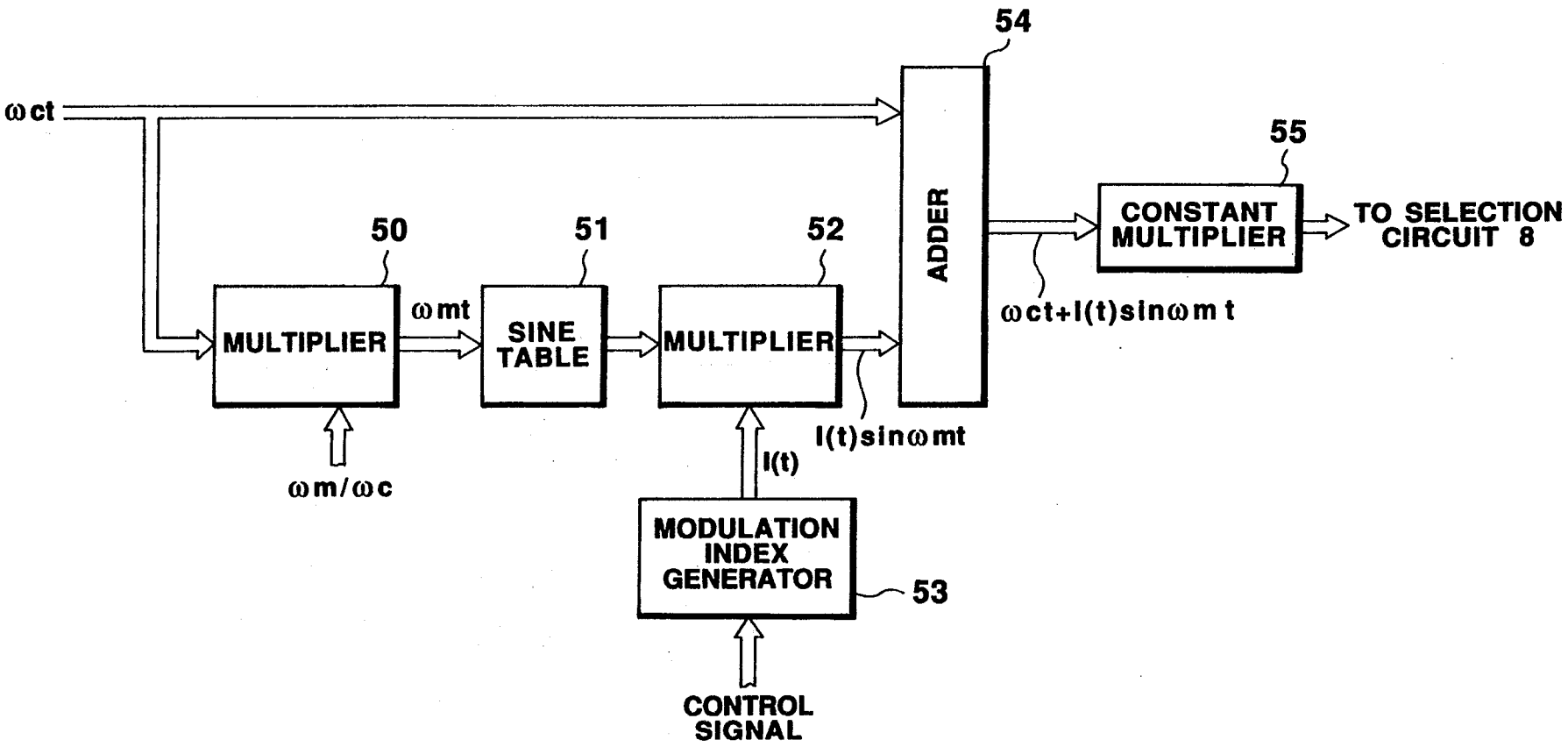
FIG. 12 is a block diagram showing a third arrangement of a modulation unit 7.

FIG. 12 is a block diagram showing the third arrangement of the modulation unit 7 on the basis of the FM method.

An input signal $\omega_c t$ to an adder 54 and a multiplier 50 corresponds to the address signal X from the address generation unit 6 (FIG. 2), and is an accumulated value whose value changes by an incremental width corresponding to a pitch of a depressed key. This accumulated value repetitively changes within a range of 0 and $2\pi$ radians. The $\omega_c t$ is multiplied with a constant value $\omega_m/\omega_c$ by the multiplier 50, and a sine table 51 is accessed using the obtained $\omega_m t$ as an address signal. A signal $\sin\omega_m t$ output from the sine table 51 is multiplied with a modulation index I(t) generated by a modulation index generator 53 on the basis of a control signal, thus obtaining $I(t)\sin\omega_m t$. The adder 54 then adds $\omega_c t$ and $I(t)\sin\omega_m t$ to obtain $\omega_c t + I(t)\sin\omega_m(t)$. Thereafter, the output from the adder 54 is multiplied with a predetermined multiplication factor by a constant multiplier 55, thus increasing an incremental width for reading out data from the memory unit 9. The output from the constant multiplier 55 obtained in this manner serves as the output X' from the modulation unit 7 shown in FIG. 2. Since the constant multiplier 55 is used, the constant multiplier 23 (FIG. 5) of the address generation unit 6 shown in FIG. 2 is omitted.

The operation of the overall circuit shown in FIG. 2 as described above can be summarized as follows.

When a player selects one of the performance modes shown in FIGS. 4B to 4D, and depresses a key, the PCM/modulation method selection/input unit 4 outputs the flag "1" (PCM method) or the flag "0" (modulation method) in accordance with a tone synthesis method selection control signal output from the control unit 2. The output flag serves as the MSB of an address signal to be supplied to the memory unit 9. Therefore, when the above-mentioned flag is "1", tone waveform data for the PCM method is read out from an area where the MSB of its address is "1"; when the flag is "0", sine wave data used in the modulation method is read out from an area where the MSB of its address is "0". The address generation unit 6 outputs an address signal X having an incremental width corresponding to a pitch of the depressed key on the basis of key data of the depressed key. When the PCM method is selected, tone waveform data in the memory unit 9 is directly read out via the selection circuit 8 in accordance with the address signal X. On the other hand, when the modulation method is selected, the address signal X is input to the modulation unit 7, and sine wave data in the memory unit 9 is read out therefrom via the selection circuit 8 in accordance with an output X' from the unit 7.

The above-mentioned tone synthesis method selection operation is performed at each selection timing of a tone generation channel corresponding to a depressed on the basis of performance mode selection data. Of the output from the selection circuit 8, upper bits corresponding to an integral part of the address signal are supplied to the memory unit 9, and lower bits corresponding to a decimal part of the address signal are supplied to the interpolation unit 10. The interpolation unit 10 performs the above-mentioned interpolation operation, thus producing a tone from the audio system via the multiplier unit 12, the accumulation unit 13, and the D/A converter 14.

In the first to third arrangements, a combination of tone synthesis methods, i.e., the PCM method and the modulation method has been exemplified. Various other tone synthesis methods may be combined, and tones may be produced in units of tone generation channels.

The second embodiment of the present invention will be described below.

This embodiment exemplifies a tone waveform generation apparatus which combines tone waveform generation methods, e.g., the PCM method and the modulation method. In particular, as the modulation method, a method different from the conventional FM method is employed. Prior to a description of the detailed arrangement of this embodiment, a tone waveform generation method by the modulation method employed in this embodiment will be described below.

Figure 13:
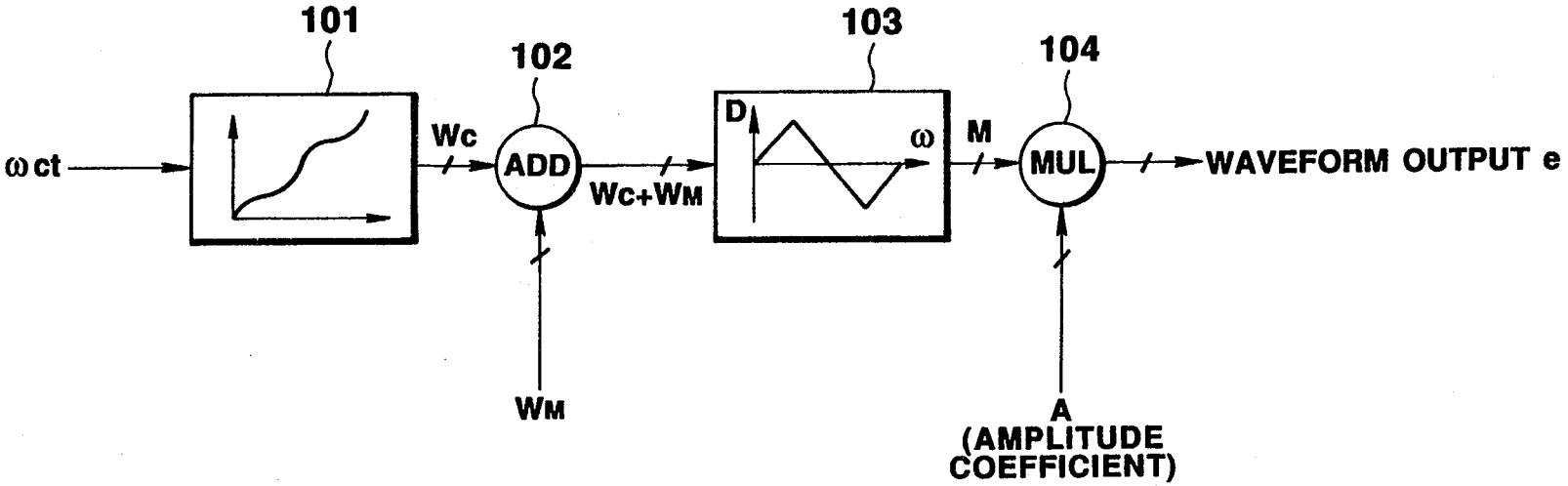
FIG. 13 is a diagram showing a tone waveform generation apparatus by a modulation method as a fundamental arrangement of the second embodiment of the present invention.

FIG. 13 shows an arrangement of a tone waveform generation apparatus of this embodiment.

A carrier wave phase angle $\omega_{ct}$ whose value changes linearly between 0 to $2\pi$ [rad] is used as an address for a carrier wave ROM 101 to read out a carrier signal $W_c$. The carrier wave phase angle $\omega_{ct}$ is obtained by multiplying an angular velocity $\omega_c$ [rad/sec] with a time t [sec].

The carrier signal $W_c$ is added to an externally supplied modulation signal $W_M$ by an adder (to be referred to as an "ADD" hereinafter) 102, and the sum signal is supplied to a decoder 103. The decoder 103 decodes the sum waveform $W_c+W_M$ [rad] on the basis of a triangular waveform to obtain a decode output D.

The decode output D is multiplied with an amplitude coefficient A by a multiplier (MUL) 104, thus obtaining a final waveform output e.

Figure 14:
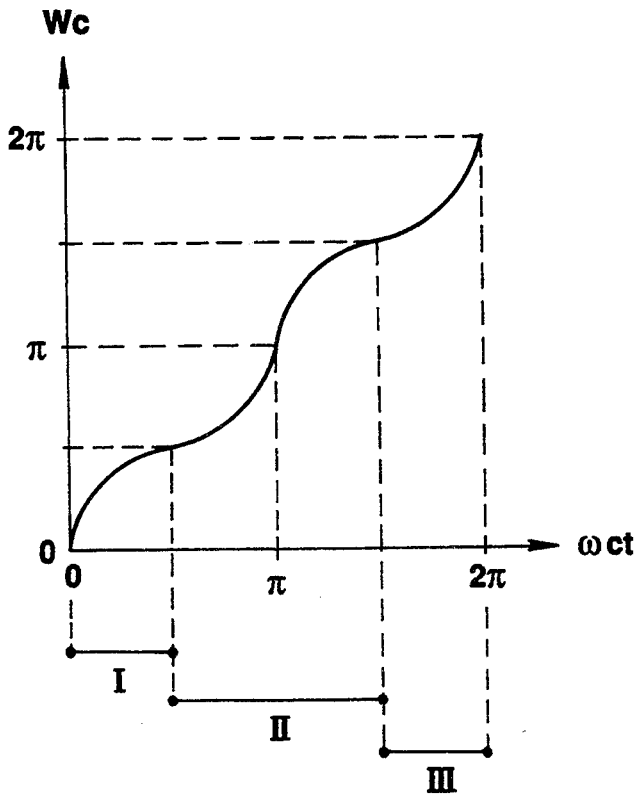
FIG. 14 is a graph showing a storage content of a carrier wave ROM.

In the tone waveform generation apparatus with the above arrangement, the carrier wave ROM 101 stores a waveform shown in FIG. 14. If the circle ratio is given by $\pi$, the relationships between the carrier wave phase angle $\omega_{ct}$ [rad] and the carrier signal $W_c$ [rad] in regions I, II, and III in FIG. 14 are respectively expressed by:

$$\begin{aligned} W_c &= (\pi/2)\sin\omega_{ct} \\ &\quad (\text{region I: } 0 \leqq \omega_{ct} \leqq \pi/2) \\ W_c &= \pi - (\pi/2)\sin\omega_{ct} \\ &\quad (\text{region II: } \pi/2 \leqq \omega_{ct} \leqq 3\pi/2) \\ W_c &= 2\pi + (\pi/2)\sin\omega_{ct} \\ &\quad (\text{region III: } 3\pi/2 \leqq \omega_{ct} \leqq 2\pi) \end{aligned} \tag{14}$$

The carrier signal $W_c$ calculated by one of equations (14) and the external modulation signal $W_M$ are added to each other, and the sum signal is input to the decoder 103. Thus, the decoder 103 outputs the decode output D. The decode output D is multiplied with the amplitude coefficient A by the MUL 104 to obtain the waveform output e given by:

$$\begin{aligned} e &= A \cdot TRI\{(\pi/2)\sin\omega_{ct} + W_M\} \\ &\quad (0 \leqq \omega_{ct} \leqq \pi/2) \\ e &= A \cdot TRI\{\pi - (\pi/2)\sin\omega_{ct} + W_M\} \\ &\quad (\pi/2 \leqq \omega_{ct} \leqq 3\pi/2) \\ e &= A \cdot TRI\{2\pi + (\pi/2)\sin\omega_{ct} + W_M\} \\ &\quad (3\pi/2 \leqq \omega_{ct} \leqq 2\pi) \end{aligned} \tag{15}$$

where TRI(x) is defined as a triangular wave function set in the decoder 103.

When the modulation signal $W_M$ is 0, an input waveform to the decoder 103 is the carrier signal $W_c$ itself defined by one of equations (14). That is, $$e = A \cdot TRI(W_c) \tag{16}$$

Figure 15:
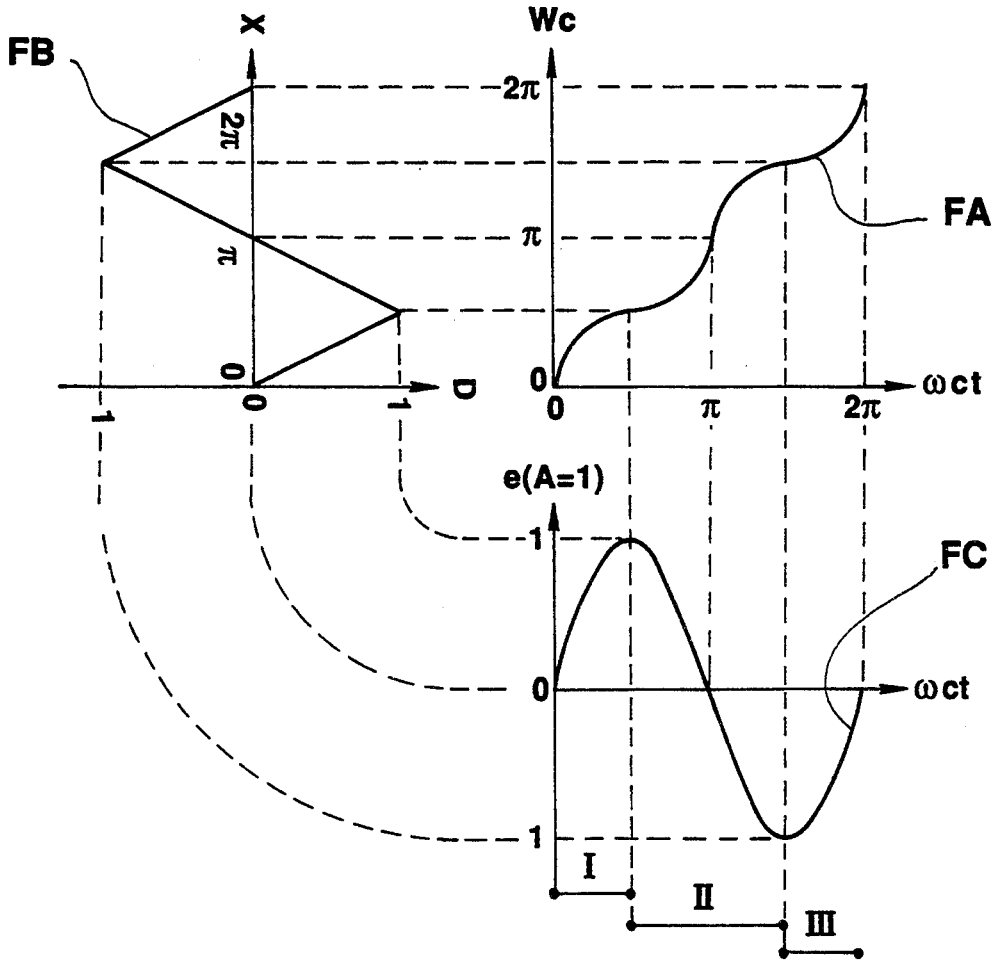
FIG. 15 is a chart for explaining an operation in a non-modulation mode of the tone waveform generation apparatus by the modulation method.
Figure 16A:
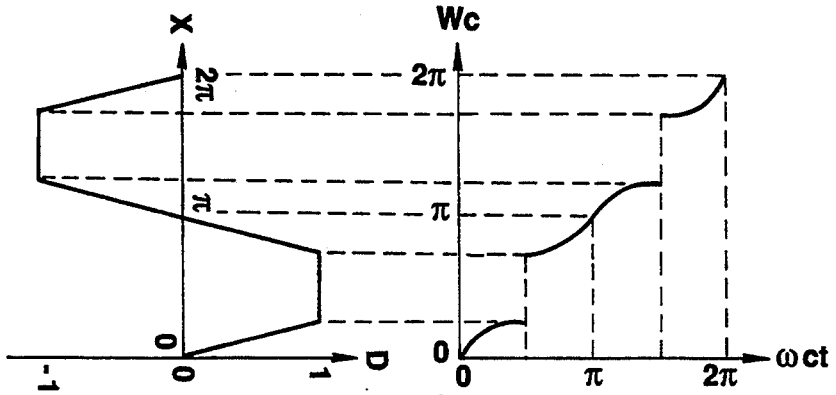
FIGS. 16A to 16D are charts showing other waveforms stored in the carrier wave ROM and a triangular wave decoder.
Figure 16B:
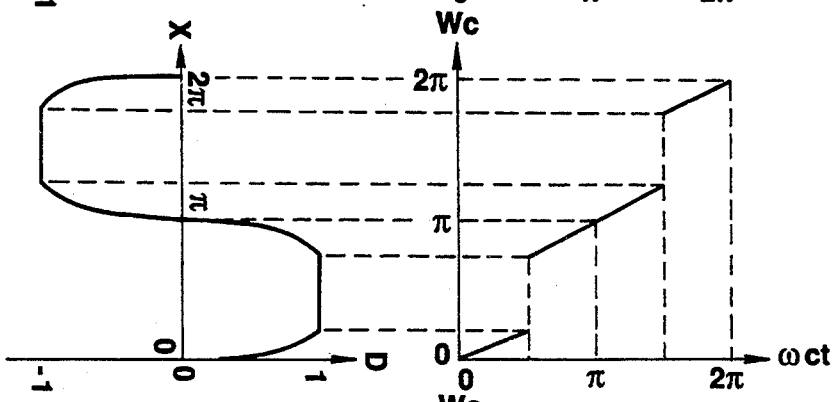
Figure 16C:
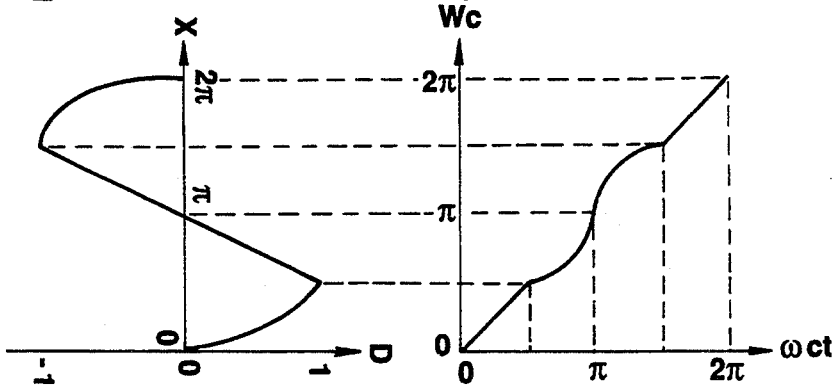
Figure 16D:
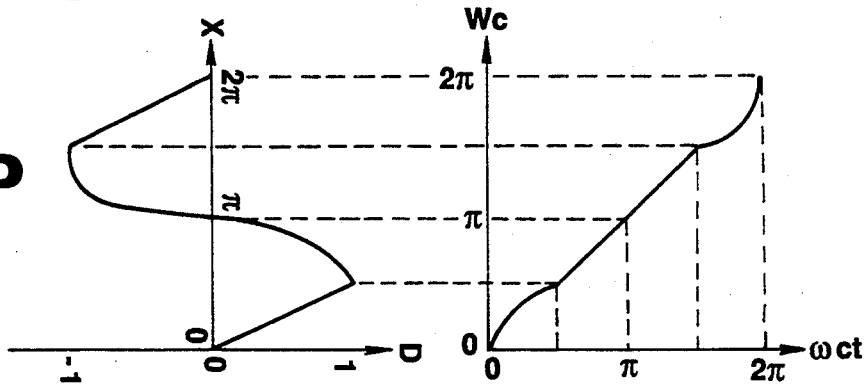

Note that the relationship between the carrier signal $W_c$ and the carrier wave phase angle $\omega_{ct}$ is represented by symbol FA in FIG. 15 on the basis of equations (14) or FIG. 14.

The triangular wave function D=TRI(x) (where x is the input) calculated by the decoder 103 is defined by the following equations, and corresponds to a function represented by FB in FIG. 15:

$$\begin{aligned} D = TRI(x) &= (2/\pi)x \\ &\quad (\text{region I: } 0 \leqq x \leqq \pi/2) \\ D = TRI(x) &= -1 + (2/\pi)(3\pi/2 - x) \\ &\quad (\text{region II: } \pi/2 \leqq x \leqq 3\pi/2) \end{aligned} \tag{17}$$

-continued $$\begin{aligned} D = TRI(x) &= -1 + (2/\pi)(x - 3\pi/2) \\ &\quad (\text{region III: } 3\pi/2 \leqq x \leqq 2\pi) \end{aligned}$$

As can be seen from FIG. 15, the carrier signal $W_c$ as an input signal to the decoder 103, and the triangular wave function D=TRI(x) calculated by the decoder 103 are monotonous functions in the regions I, II, and III defined by equations (14) or (17), and the carrier wave phase angle $\omega_{ct}$ and an input x have values in the same ranges in the regions I, II, and III. Equations (14), (16), and (17) can be synthesized in identical ranges. More specifically, when equations (14) and (17) are substituted in equations (16), we have:

$$\begin{aligned} e &= A \cdot TRI\{(\pi/2)\sin\omega_{ct}\} \\ &= A \cdot (2/\pi)(\pi/2)\sin\omega_{ct} \\ &= A \cdot \sin\omega_{ct} \\ &\quad (\text{region I: } 0 \leqq \omega_{ct} \leqq \pi/2 \\ e &= A \cdot TRI\{\pi - (\pi/2)\sin\omega_{ct}\} \\ &= A \cdot \{-1 + (2/\pi)(3\pi/2 - \pi + (\pi/2)\sin\omega_{ct})\} \\ &= A \cdot \sin\omega_{ct} \\ &\quad (\text{region II: } \pi/2 \leqq \omega_{ct} \leqq 3\pi/2) \\ e &= A \cdot TRI\{2\pi + (\pi/2)\sin\omega_{ct}\} \\ &= A \cdot \{-1 + (2/\pi)(2\pi + (\pi/2)\sin\omega_{ct} - 3\pi/2)\} \\ &\quad (\text{region III: } 3\pi/2 \leqq \omega_{ct} \leqq 2\pi) \end{aligned} \tag{18}$$

More specifically, when $W_M$,=0, a single sine wave $A \cdot \sin\omega_{ct}$ including no harmonic components of high orders at all in any region of the carrier wave phase angle $\omega_{ct}$ is output. For example, when the amplitude coefficient A=1, the relationship between the carrier wave phase angle $\omega_{ct}$ and the waveform output e when $W_M$=0 is expressed by a sine wave, as indicated by symbol FC in FIG. 15.

As can be understood from the above-mentioned relationships, in order to realize a process for decaying a tone to only a single sine wave component, or generation of a tone consisting of only a single sine wave component, the externally input modulation signal $W_M$ can be controlled to approach 0 with an elapse of time.

A change in waveform output e when the magnitude of the modulation signal $W_M$ mixed in the carrier signal $W_c$ by the adder 102 is increased will be examined below. When a mixing ratio of the modulation signal $W_M$ (a ratio of $W_M$ to the carrier signal) is gradually increased, a modulation signal component $W_M$ included in the waveform output from the adder 102 is increased. For this reason, the waveform output e is gradually distorted from a sine wave on the time base, and is changed to include many harmonic components of high orders on the frequency axis. In this case, a conversion function in the decoder 103 is expressed by a triangular wave function FB given by equations (17) or shown in FIG. 15, which originally includes many harmonic components of high orders. For this reason, a tone including many harmonic components of high orders at frequencies ten times the pitch frequency can be obtained in accordance with the modulation signal $W_M$. In the FM method based on equation (1) described in the prior art, it is difficult to express harmonic components of high orders at frequencies 11 times the pitch frequency or more. However, in this embodiment, it is possible to express up to harmonic components of high orders at frequencies about 30 times the pitch frequency. In addition, it is also possible to complicatedly change power of harmonic components of low orders in accordance with a change in modulation signal $W_M$ in place of a linear increase/decrease in power.

According to the above-mentioned fact, when the value of the modulation signal $W_M$ is changed, a process for decaying a tone to only a single side wave component or generation of a tone consisting of only a single sine wave component can be realized in the same manner as tones of acoustic instruments. In addition, a tone clearly including up to harmonic components of high orders can be generated. In particular, when a tone having a low pitch is to be synthesized, i.e., when a tone which has a low fundamental frequency (pitch frequency) and includes many harmonic components of high orders within an audio frequency range is to be synthesized, the tone waveform generation apparatus shown in FIG. 13 is very effective. As a typical example, a decay tone for several tens of seconds obtained when a bass key of a piano is strongly depressed includes harmonic components of high orders exceeding that of the 30th order. When such a tone is synthesized, the apparatus shown in FIG. 13 is effective.

The tone waveform generation apparatus of this embodiment is not limited to the above-mentioned arrangement. For example, the decoder 103 may perform decoding on the basis of a function including harmonic components, and a function for causing the decoder 103 to output a sine wave output D may be stored in the carrier wave ROM 101, thus obtaining the same effect as described above. FIGS. 16A to 16D show combinations of functions calculated by the decoder 103, and functions stored in the carrier wave ROM 101. In FIGS. 16A to 16D, a function for defining the relationship between the carrier wave phase angle $\omega_{ct}$ and the carrier signal $W_c$ is stored in the carrier wave ROM 101, and the decoder 103 converts an input x in accordance with a function for defining the relationship between the input x and the decode output D. Assuming that the value of the modulation signal $W_M$ is 0, the carrier signal $W_c$ output from the carrier wave ROM 101 is input as the input x to the decoder 103, and causes the decoder 103 to output a single sine wave as a waveform output e. According to the functions of the decoder 103 shown in FIGS. 16A to 16D, when the value of the modulation signal $W_M$ is set to be other than 0, a waveform output e including many harmonic components of high orders can be obtained.

An electronic musical instrument of the present invention based on the principle of the tone waveform generation apparatus described above will be described in detail below.

Figure 17:
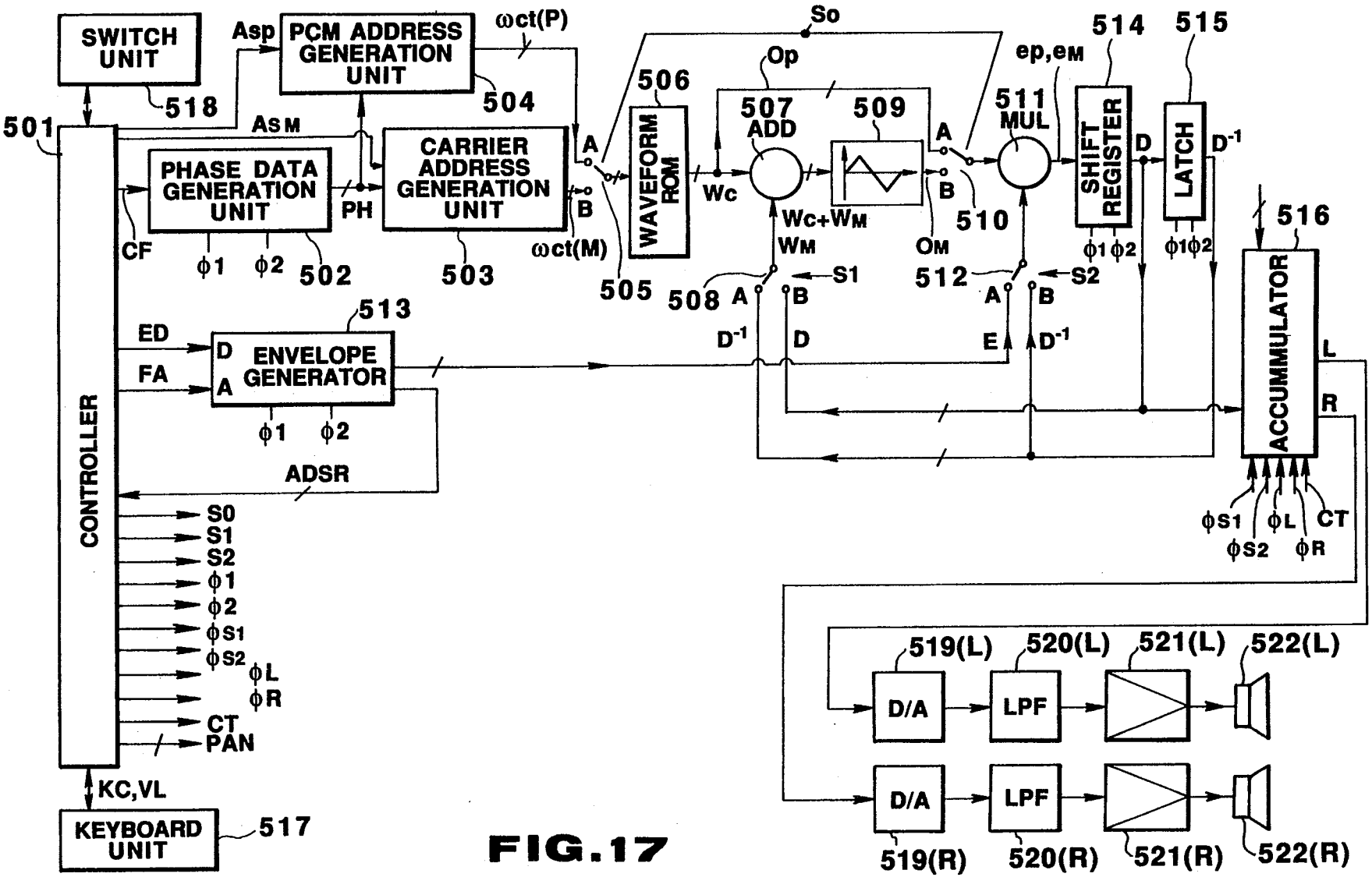
FIG. 17 is a block diagram of the second embodiment of the present invention.

FIG. 17 is a block diagram showing the overall arrangement of an electronic keyboard instrument according to this embodiment. In this embodiment, since a PCM tone signal generation circuit is additionally used to have the arrangement of the tone waveform generation apparatus shown in FIG. 13 as a fundamental arrangement, the following description will be made with reference to FIG. 13, and the like.

This embodiment exemplifies a 32-polyphonic tone generation apparatus, and the respective internal circuits are operated 32-time-divisionally in each sampling period.

A controller 501 generates and outputs data CF corresponding to a pitch, envelope data ED and FA, PCM start address data $A_{SP}'$ and carrier start address data $A_{SM}$ in accordance with a setup state of a switch unit 518 and data such as key code data KC and velocity data VL input from a keyboard unit 517. The controller 501 outputs selector control signals $S_0$, $S_1$, and $S_2$ for ON/OFF-controlling selectors 505 and 510, and selectors 508 and 512, and also outputs clocks $\phi_1$, $\phi_2$, $\phi_{S1}$, $\phi_{S2}$, $\phi_L$, $\phi_R$, CT, and pan control data PAN for controlling a phase data generation unit 502, an envelope generator 513, an accumulator 516, and the like.

The phase data generation unit 502 generates phase data PH, which is sequentially increased by a step width defined by the data CF, on the basis of the data CF corresponding to a scale from the controller 501, and supplies it to a carrier address generation unit 503 and a PCM address generation unit 504.

The carrier address generation unit 503 generates, based on the phase data PH, carrier address data $\omega_{CT}(M)$ for accessing a carrier signal area of a waveform ROM 506. A start address is designated by the carrier start address data $A_{SM}$ from the controller 501.

The PCM address generation unit 504 generates, based on the phase data PH, PCM address data $\omega_{CT}(P)$ accessing a PCM signal area of the waveform ROM 506. In this case, a start address is designated by the PCM start address data $A_{SP}$ from the controller 501.

The selector 505 selects one of the PCM address data $\omega_{CT}(P)$ input to a terminal A and the carrier address data $\omega_{CT}(M)$ input to a terminal B on the basis of the selector control signal $S_0$.

When the carrier signal area of the waveform ROM 506 is accessed by the carrier address data $\omega_{CT}(M)$ the ROM 506 outputs a corresponding carrier signal $W_c$ to an adder (to be referred to as an "ADD" hereinafter) 507. When the PCM signal area is accessed by the PCM address $\omega_{CT}(P)$ the waveform ROM 506 supplies a corresponding PCM signal $O_P$ to a terminal A of the selector 510.

The ADD 507 adds the carrier signal $W_c$ from the ROM 506 to a delay output D or $D^{-1}$ input from the selector 508 as the modulation signal $W_M$ and outputs a sum waveform $W_c+W_M$ and supplies it to a triangular wave decoder 509. The selector 508 selects one of the delay output D input to a terminal A and the delay output $D^{-1}$ input to a terminal B in accordance with the selector control signal $S_1$ from the controller 501.

The triangular wave decoder 509 converts the sum waveform $W_c+W_M$ in accordance with a triangular wave function to output a decode output $O_M$, and supplies it to the terminal B of the selector 510. The circuit configuration of the decoder 509 will be described later. The selector 510 selects the PCM signal $O_P$ input to the terminal A or the decode output $O_M$ input to the terminal B on the basis of the selector control signal $S_0$, and supplies a selected signal to a multiplier (to be referred to as an "MUL" hereinafter) 511.

The MUL 511 is a multiplier for adding an envelope to the PCM signal $O_P$ or the decode output $O_M$, and multiplies one of these signals with an envelope signal E from the envelope generator 513 or a modulation signal $D^{-1}$ from a latch 515 input via the selector 512, thereby outputting a PCM waveform output $e_p$ corresponding to the PCM signal $O_P$ or a modulated waveform output $e_M$ corresponding to the decode output $O_M$. The selector 512 selects the envelope signal E input to a terminal A or the delay output $D^{-1}$ input to a terminal B in accordance with the selector control signal $S_2$ from the controller 501. In response to this, the envelope generator 513 outputs the envelope signal E on the basis of the address data FA and the setup data ED output from the controller 501 upon detection of the depression of a key. The envelope signal E has the following characteristics. That is, the envelope signal E reaches an initial level IL in an attack time AT from the depression of a given key, and reaches a sustain level SL in a decay time DT from the initial level. The envelope signal E maintains the sustain level until the release of the key is detected. After the release of the key is detected, the envelope signal E becomes 0 level in a release time RT to mute a tone. Data values of the attack time AT, the initial level IL, the decay time DT, the sustain level SL, and the release time RT are set in the envelope generator 513 as the setup data ED from the controller 501 at the beginning of the depression of a given key. These data are identified by the address data FA.

Figure 18:
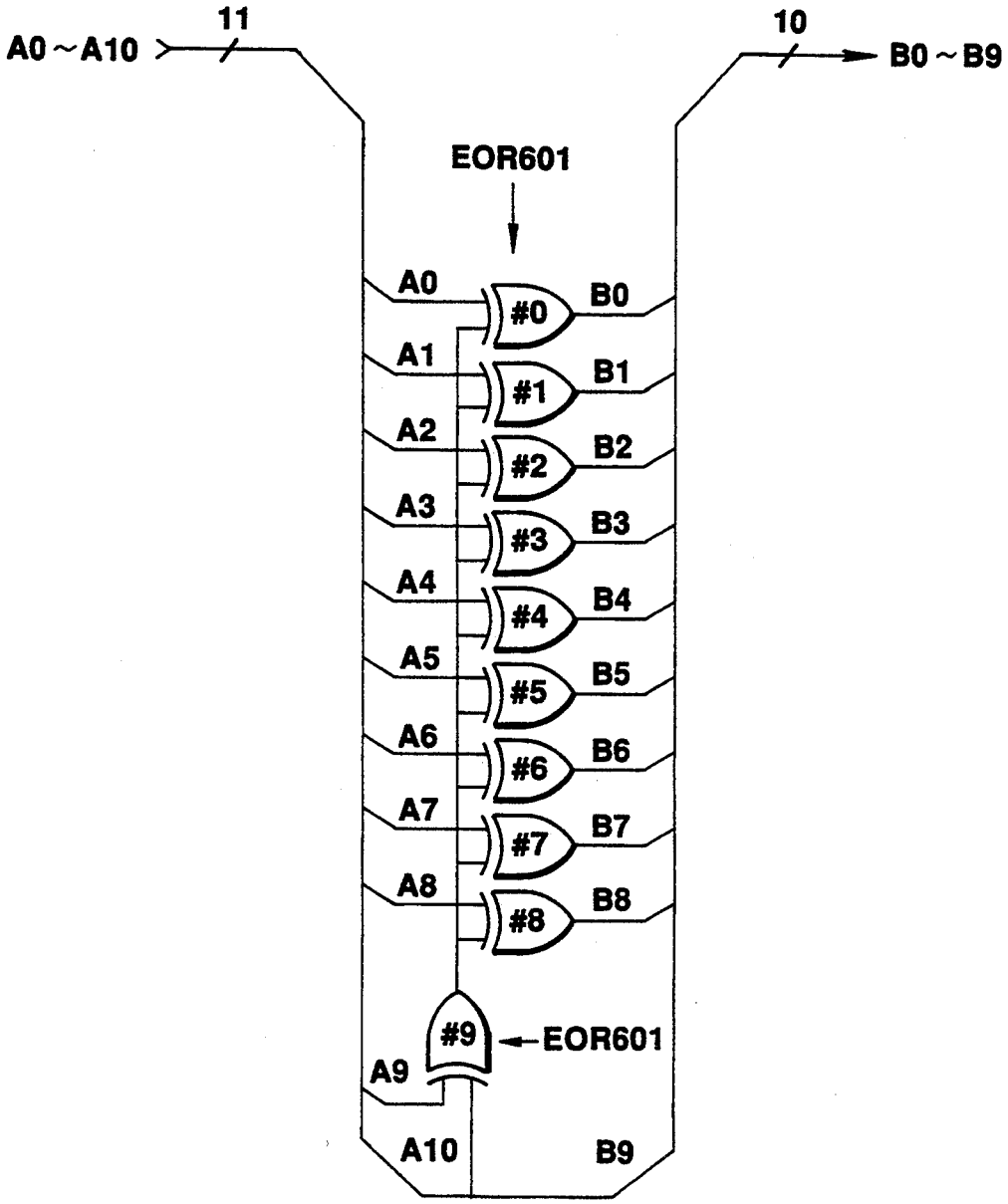
FIG. 18 is a circuit diagram of the triangular wave decoder.

FIG. 18 shows an arrangement of the triangular wave decoder 509 shown in FIG. 17. In FIG. 18, inputs A0 to A10 (11 bits) correspond to the sum waveform $W_c+W_M$ in FIG. 17, and outputs B0 to B9 (10 bits) correspond to the decode output $O_M$ in FIG. 17.

The two input terminals of a ninth EOR 601 receive the upper two bits A9 and A10 of the sum waveform from the ADD 507 in FIG. 17, and its output is input to the first input terminals of 0th to eighth EORs 601. The second input terminals of the 0th to eighth EORs 601 receive the 0th to eighth bits of the sum waveform from the ADD 507, respectively.

The outputs from the 0th to eighth EORs 601 are output to the multiplier 511 (FIG. 17) as 0th to eighth bits B0 to B8 of the decode output, and the MSB A10 of the sum waveform is output to the multiplier 511 as an MSB B9 of the decode output, which represents a sign bit.

The operation of the decoder 509 will be described below.

Assume that a value Z determined by the sum waveform bits A0 to A10 is sequentially increased in proportion to an elapse of time, and a phase angle for one period, i.e., 0 to $2\pi$ [rad] can be designated within a full range of the sum waveform bits A0 to A10. When a combination (A10, A9) of the logic levels of the MSB A10 and the ninth bit A9 of the sum waveform becomes (0, 0), a value indicated by the sum waveform bits A0 to A10 is changed from 0 to $\frac{1}{4}$ the full range, i.e., $\pi/2$ [rad]. within this range, since the output from the ninth EOR 601 goes to logic "0", as the sum waveform bits A0 to A8 input to the 0th to eighth EORs 601 are sequentially increased, the same waveform appears as the lower bits B0 to B8 of the decode output. The MSB B9 as a sign bit of the decode output is equal to the sum waveform MSB A10, i.e., is at logic "0". Therefore, in this range, a positive decode output is generated. If a value determined by the decode output bits B0 to B9 is represented by W, the above operation can be expressed by:

$$W=Z \text{ for } 0 \leqq Z \leqq \pi/2 \tag{19}$$

As a second case, when (A10, A9)=(0, 1), a value represented by the sum waveform bits A0 to A10 falls within a range of $\pi/2$ to $\pi$ [rad]. Within this range, since the output from the ninth EOR 601 goes to logic "1", a waveform which decreases with an increase in sum waveform bits A0 to A8 input to the 0th to eighth EORs 601 is output as lower 9 bits B0 to B8 of the decode output. Furthermore, the MSB B9 as a sign bit of the decode output is equal to the sum waveform MSB A10, i.e., is at logic "0". Therefore, a positive decode output is generated within the above range. This can be expressed by:

$$W=-Z+\pi \text{ for } \pi/2 \leqq Z \leqq \pi \tag{20}$$

As a third case, when (A10, A9)=(1, 0), a value represented by the sum waveform bits A0 to A10 is changed within a range of $\pi$ to $3\pi/2$ [rad]. Within this range, since the output from the ninth EOR 601 goes to logic "1" like in the second case, a waveform which decreases with an increase in sum waveform bits A0 to A8 input to the 0th to eighth EORs 601 is output as lower 9 bits B0 to B8 of the decode output like in the second case. On the other hand, the MSB B9 as a sign bit of the decode output is equal to the sum waveform MSB A10, i.e., is at logic "1". For this reason, the decode output becomes negative. This can be expressed by:

$$W=-Z+\pi \text{ for } \pi \leqq Z \leqq 3\pi/2 \tag{21}$$

As a fourth case, when (A10, A9)=(1, 1), a value determined by the sum waveform bits A0 to A10 is changed within a range of $3\pi/2$ to $2\pi$ [rad]. Within this range, since the output from the ninth EOR 601 goes to logic "0", the outputs from the 0th to eighth EOR 601 are the same as those in the first case, and the same waveform is output as lower nine bits B0 to B9 of the decode output as the input sum waveform bits A0 to A8 are increased. On the other hand, the sign bit B9 goes to logic "1" since the sum waveform MSB A10 is at logic "1", and a decode output becomes negative. This can be expressed by:

$$W=Z-2\pi \text{ for } 3\pi/2 \leqq Z \leqq 2\pi \tag{22}$$

Equations (19) to (22) corresponding to the first to fourth cases described above can be summarized as follows:

$$\begin{aligned} W &= Z && \text{for } 0 \leqq Z \leqq \pi/2 \\ W &= -Z+\pi && \text{for } \pi/2 \leqq Z \leqq 3\pi/2 \\ W &= Z-2\pi && \text{for } 3\pi/2 \leqq Z \leqq 2\pi \end{aligned} \tag{23}$$

Equations (18) which have already been described as the characteristics of the decoder 103 shown in FIG. 13 are modified as follows:

$$\begin{aligned} D &= (2/\pi)x && (0 \leqq x \leqq \pi/2) \\ D &= (2/\pi)(-x+\pi) && (\pi/2 \leqq x \leqq 3\pi/2) \\ D &= (2/\pi)(x-2\pi) && (3\pi/2 \leqq x \leqq 2\pi) \end{aligned} \tag{24}$$

Figure 19:
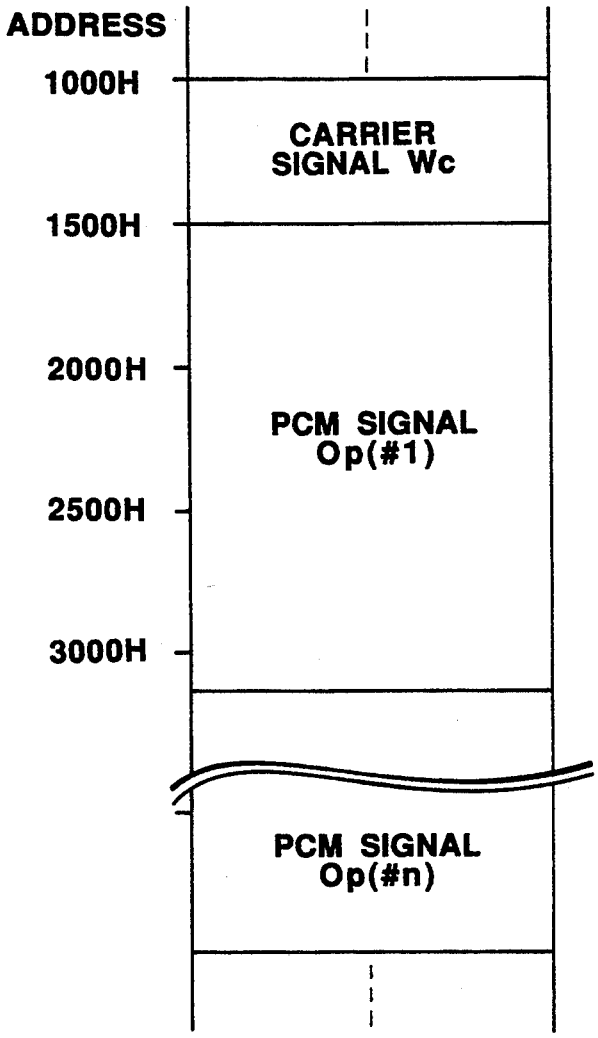
FIG. 19 shows a data architecture of a waveform ROM.

Upon comparison between equations (24) and (23), their input/output relationships are substantially the same as each other except that a gain is different by $2/\pi$. As can be seen from the above description, the triangular wave decoder 509 shown in FIGS. 17 and 19 is operated in the same manner as in the decoder 103 shown in FIG. 13 and having characteristics given by equations (18).

Referring back to FIG. 17, when the terminals A of the selectors 505 and 510 are selected in accordance with the selector control signal $S_0$, tone synthesis based on the PCM method is performed. More specifically, the phase data generation unit 502 repetitively generates phase data PH which is increased by a step width corresponding to the data CF corresponding to a pitch from the controller 501, as shown in FIG. 20A. PCM address data $\omega_{CT}$(P) is generated on the basis of the phase data PH and the PCM start address data $A_{SP}$ from the controller 501, as shown in FIG. 20B. In this embodiment, the PCM start address data $A_{SP}$ is 1500H (H represents hexadecimal notation). Thus, a #1 PCM signal $O_P$ is read out from the address 1500H of the waveform ROM 506 (FIG. 19), as shown in FIG. 20C. The PCM signal $O_P$ is multiplied with an envelope by the MUL 511, thus attaining tone synthesis based on the PCM method.

On the other hand, when the terminals B of the selectors 505 and 510 are selected in accordance with the selector control signal $S_0$, tone synthesis based on the modulation method shown in FIG. 13 is executed. More specifically, the phase data generation unit 502 generates phase data PH at a repetition period corresponding to the data CF from the controller 501, as shown in FIG. 21A. Carrier address data $\omega_{CT}$(M) is generated based on the phase data PH and the carrier start address data $A_{SM}$ from the controller 501, as shown in FIG. 21B. In this case, the carrier start address data $A_{SM}$ is 0000H. Thus, a carrier signal $W_c$ having characteristics shown in FIG. 14 is repetitively read out from the address 0000H of the waveform ROM 506 (FIG. 19), as shown in FIG. 21C. The waveform ROM 506 corresponds to the carrier wave ROM 101 (FIG. 13), the ADD 507 corresponds to the ADD 102 (FIG. 13), the triangular wave decoder 509 corresponds to the decoder 103 (FIG. 13), and the MUL 511 corresponds to the MUL 104 (FIG. 13). Thus, tone synthesis based on the modulation method described above with reference to FIG. 13 is executed.

The musical instrument shown in FIG. 17 can parallelly produce 32 tones on the basis of key depression operations on the keyboard unit 517. For this purpose, the respective circuits are 32-time-divisionally operated for each sampling period as one tone generation period. More specifically, although not shown, the phase data generation unit 502 includes a register for holding the data CF for 32 tone generation channels, and a 32-stage shift register for holding accumulated values of the respective tone generation channels on the basis of the data CF. The unit 502 performs independent accumulation operations in units of tone generation channels in accordance with the clocks $\phi_1$ and $\phi_2$ output from the controller 501, and outputs phase data PH shown in FIG. 20A or 21A corresponding to a given tone generation channel at a time-divisional timing corresponding to the given tone generation channel. Similarly, the envelope generator 513 includes a register for holding address data FA and setup data ED for 32 tone generation channels, and a 32-stage shift register for holding envelope values for the respective tone generation timings (sampling periods) based on the above data. The envelope generator 513 outputs an independent envelope signal E for each tone generation channel in accordance with the clocks $\phi_1$ and $\phi_2$ output from the controller 501. The PCM address generation unit 504 includes a register for holding PCM start address data $A_{SP}$ for 32 tone generation channels, and a 32-stage shift register for holding accumulated values (see FIG. 20B) of PCM address data $\omega_{CT}$(P) in units of tone generation timings based on the PCM start address data, and generates independent PCM address data $\omega_{CT}$(P) in units of tone generation channels. Furthermore, the carrier address generation unit 503 divides phase data PH for each tone generation channel with a predetermined coefficient, adds the quotient to the start address $A_{SM}'$ and repetitively reads out the carrier address $\omega_{CT}$(M) shown in FIG. 21B using the sum as an address.

Every time a key of the keyboard unit 517 is depressed, the controller 501 assigns the depressed key to one of the 32 tone generation channels, outputs the data CF corresponding to the depressed key to the register in the phase data generation unit 502, and outputs the corresponding address data FA and setup data ED to the register in the envelope generator 513. Furthermore, the controller 501 outputs the corresponding PCM start address data $A_{SP}$ to the register of the PCM address generation unit 504. Note that the carrier start address $A_{SM}$ output to the carrier address generation unit 503 is a fixed value. Thus, the phase data generation unit 502 and the envelope generator 513 start generation of the phase data PH and the envelope signal E at a timing corresponding to the assigned channel. The carrier address generation unit 503 and the PCM address generation unit 504 start generation of the carrier address $\omega_{CT}$(M) and the PCM address $\omega_{CT}$(P) on the basis of the above-mentioned data, thus starting tone synthesis in the tone generation channel.

At the same time, the controller 501 controls the selector control signal $S_0$ in units of tone generation channels. Thus, the connection states of the selectors 505 and 510 are changed in units of tone generation channels, so that it can be selected whether tone synthesis is performed by the PCM method or the modulation method based on the principle arrangement shown in FIG. 13.

In addition to the above arrangement, the arrangement shown in FIG. 17 comprises a shift register 514 for holding the PCM waveform output $e_p$ or the modulated waveform output $e_M$ for one sampling period (one data) for each tone generation channel. The shift register 514 shifts data in accordance with the clocks $\phi_1$ and $\phi_2$ from the controller 501. A delay output D from the shift register 514 is input to the ADD 507 as the modulation signal $W_M$ via the terminal B of the selector 508. Thus, when tone synthesis based on the modulation method is performed in a given tone generation channel, modulation can be performed using the modulated waveform output $e_M$ of the immediately preceding sampling period of its own tone generation channel as the modulation signal $W_M$, and a very deeply modulated waveform output $e_M$ can be obtained.

FIGS. 22A to 22H show detailed timing charts of the above-mentioned operations. FIGS. 22A to 22H exemplify a case wherein tone synthesis by the PCM method is performed in even-numbered tone generation channels, and tone synthesis by the modulation method is performed in odd-numbered tone generation channels.

Figures 22A, 22B, 22C, 22D, 22E, 22F, 22G, 22H:
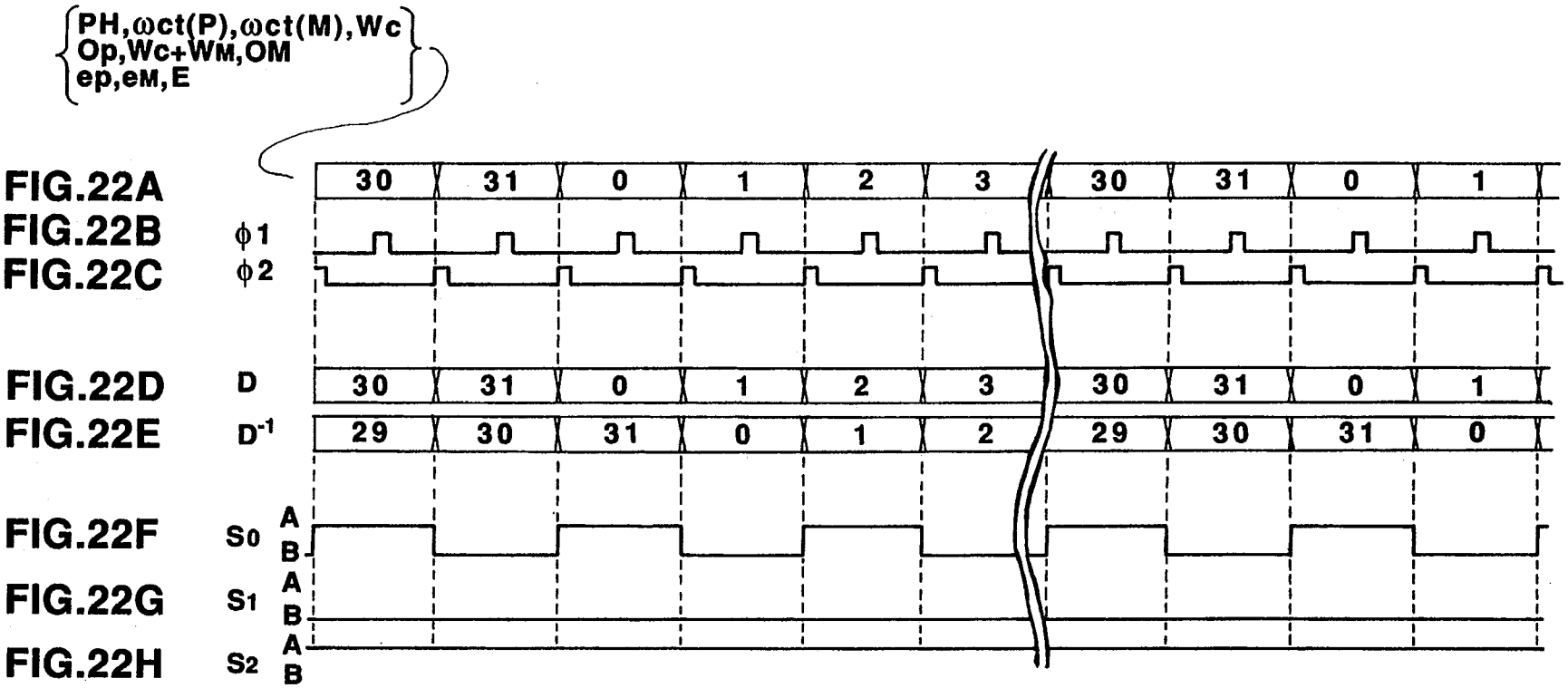
FIGS. 22A to 22H are operation timing charts of a first operation mode of the second embodiment of the present invention.

At one of 0th to 31st time-divisional timings shown in FIG. 22A, data, i.e., phase data PH, PCM address data $\omega_{CT}$(P) carrier address data $\omega_{CT}$(P), a carrier wave signal $W_c$, a PCM signal $O_P$, a sum waveform $W_c+W_M$, a decode output $O_M$, a PCM waveform output $e_p$, a modulated waveform output $e_M$, and an envelope output signal E, corresponding to a tone generation channel at that time-divisional timing are output. The shift register 514 outputs a PCM waveform output $e_p$ (for the even-numbered tone generation channel) or a modulated waveform output $e_M$ (for the odd-numbered tone generation channel) of the immediately preceding sampling period as a delay output D at one of the same time-divisional timings as the 0th to 31st timings in 22A, as shown in FIG. 22D. A delay output $D^{-1}$ from the latch 515 shown in FIG. 22E will be described later. The selector control signal $S_0$ causes the selectors 505 and 510 to select their terminals A at timings of the even-numbered tone generation channels shown in FIG. 22A, and causes the selectors 505 and 510 to select their terminals B at timings of the odd-numbered tone generation channels, as shown in FIG. 22F. The selector control signal $S_1$ causes the selector 508 to always select the delay output D input from the terminal B, as shown in FIG. 22G. The selector control signal $S_2$ causes the selector 512 to always select the envelope signal E input from the terminal A, as shown in FIG. 22H. The phase data generation unit 502, the envelope generator 513, and the shift register 514 are operated in synchronism with each time-divisional timing shown in FIG. 22A in accordance with the clocks $\phi_1$ and $\phi_2$ shown in FIGS. 22B and 22C.

With the operations at the operation timings described above, in each even-numbered tone generation channel in FIG. 22A, PCM address data $\omega_{CT}(P)$ from the PCM address generation unit 504 is input to the waveform ROM 506 via the selector 505. A PCM signal $O_P$ output from the ROM 506 is input to the MUL 511 via the selector 510, and is multiplied with an envelope defined by an envelope signal E, thus obtaining a PCM waveform output $e_p$. Thus, tone synthesis by the PCM method is executed. In each odd-numbered tone generation channel in FIG. 22A, carrier address data $\omega_{CT}(M)$ from the carrier address generation unit 503 is input to the waveform ROM 506 via the selector 505. The waveform ROM 506 outputs a carrier signal $W_c$. The ADD 507 adds the carrier signal $W_c$ and the delay output D (modulated waveform output $e_M$) of the immediately preceding sampling period of the corresponding tone generation channel. The sum waveform $W_c+W_M$ obtained from the ADD 507 is input to the triangular wave decoder 509. The decode output $O_M$ from the triangular wave decoder 509 is input to the MUL 511 via the selector 510, and is multiplied with an envelope defined by the envelope signal E, thereby obtaining a modulated waveform output $e_M$. In this manner, tone synthesis by the modulation method is executed.

The PCM waveform output $e_p$ or the modulated waveform output $e_M$ obtained in this manner is output to the accumulator 516 as the delay output D from the shift register 514, and is distributed to right and left channel outputs R and L by a predetermined operation (to be described later). These channel outputs are converted into analog tone signals by D/A converters 519 (L, R) and low-pass filters (LPFs) 520 (L, R), and the analog signals are then amplified by amplifiers 521 (L, R). Thereafter, the amplified signals are reproduced as tones from loudspeakers 522 (L, R).

The circuit shown in FIG. 17 has the latch 515 for holding the delay output D from the shift register 514 by only one time-divisional timing interval. The latch 515 delays the delay output D by one time-divisional timing interval in accordance with the clocks $\phi_1$ and $\phi_2$ from the controller 501. The delay output $D^{-1}$ from the latch 515 is input to the ADD 507 as the modulation signal $W_M$ via the terminal A of the selector 508. Thus, when tone synthesis based on the modulation method is performed in a given tone generation channel, modulation can be performed using the modulated waveform output $e_M$ or the PCM waveform output $e_p$ of the immediately preceding sampling period of the tone generation channel as the modulation signal $W_M$. Thus, an effectively modulated waveform output $e_M$ can be obtained. In particular, waveforms defining various functions, such as a sine wave, a sawtooth wave, a rectangular wave, and the like may be stored in the PCM signal area of the waveform ROM 506, so that these waveforms are read out as PCM waveform outputs $e_p$ so as not to be directly output from the accumulator 516. Thus, modulation signals $W_M$ having various waveforms can be obtained. In this case, the level of the modulation signal $W_M$ can be controlled by the envelope signal E multiplied with the PCM signal $O_P$ by the MUL 511.

In this embodiment, the controller 501 fetches an envelope control state signal ADSR indicating an envelope control state after an ON event of a given key is started so as to change the selector control signal $S_0$ in accordance with the envelope control state in units of tone generation channels. Thus, different tone synthesis methods may be used in, e.g., an attack interval, a decay interval, a sustain interval, a release interval, and the like.

FIGS. 23A to 23I show detailed operation timing charts of the above-mentioned operations. FIGS. 23A to 23I exemplify a case wherein tone synthesis by the PCM method is performed in even-numbered tone generation channels, and tone synthesis by the modulation method is performed in odd-numbered tone generation channels like in FIGS. 22A to 22H.

FIGS. 23A to 23F and FIG. 23H are the same as FIGS. 22A to 22F and FIG. 22H. In this operation, the controller 501 shown in FIG. 17 fetches the envelope control state signal ADSR from the envelope generator 513 for the 31st tone generation channel shown in FIG. 23A. The controller 501 discriminates whether the current envelope corresponds to the attack, decay, sustain, or release state. In accordance with the discrimination result, the controller 501 controls the selector control signal $S_1$ so as to cause the selector 508 to select the delay output $D^{-1}$ input to the terminal A during an attack interval A and a release interval R, and controls the selector control signal $S_1$ so as to cause the selector 508 to select the delay output D input to the terminal B during a decay interval D and a sustain interval S, as shown in FIG. 23G.

Figures 23A, 23B, 23C, 23D, 23E, 23F, 23G, 23H, 23I:
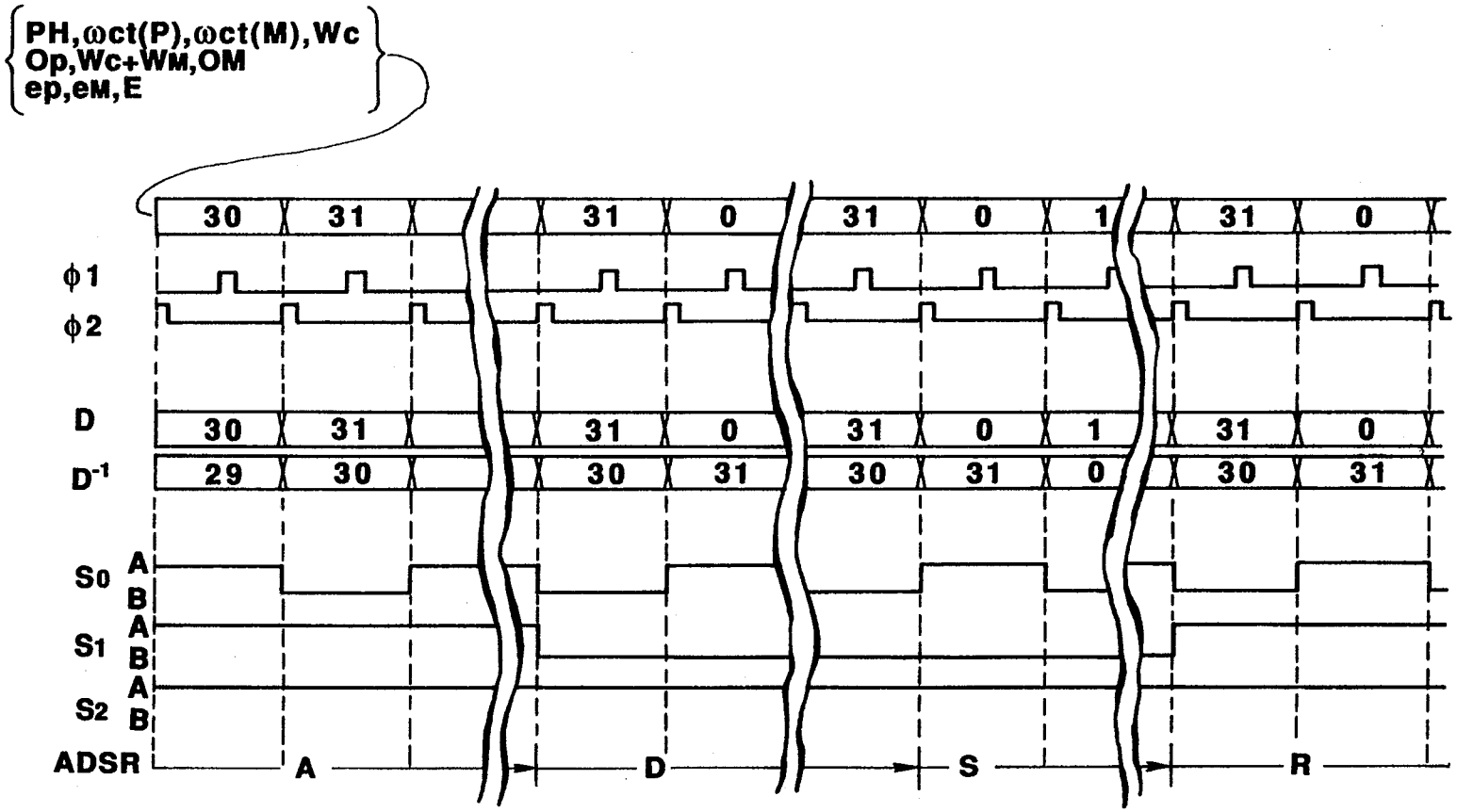
FIGS. 23A to 23I are operation timing charts of a second operation mode of the second embodiment of the present invention.

With the operation at the above-mentioned operation timing, in the 31st tone generation channel shown in FIG. 23A, tone synthesis by the modulation method is performed using, as the modulation signal $W_M$, the PCM waveform output $e_p$ of the 30th tone generation channel of the immediately preceding sampling period during the attack interval A and the release interval R, and tone synthesis by the modulation method is performed using, as the modulation signal $W_M$, the modulated waveform output $e_M$ of its own tone generation channel of the immediately preceding sampling period during the decay interval D and the sustain interval S.

In addition to the above case, in a given tone generation channel, it is easy to set so that tone synthesis by the PCM method is performed during the attack interval and the release interval, and tone synthesis by the modulation method is performed during the decay interval and the sustain interval.

FIGS. 24A to 24E show the relationships between control states of the selector control signals $S_0$, $S_1$, and $S_2$, and tone synthesis methods realized by the circuit shown in FIG. 17 in accordance with the control states.

Figures 24A, 24B, 24C, 24D, 24E:
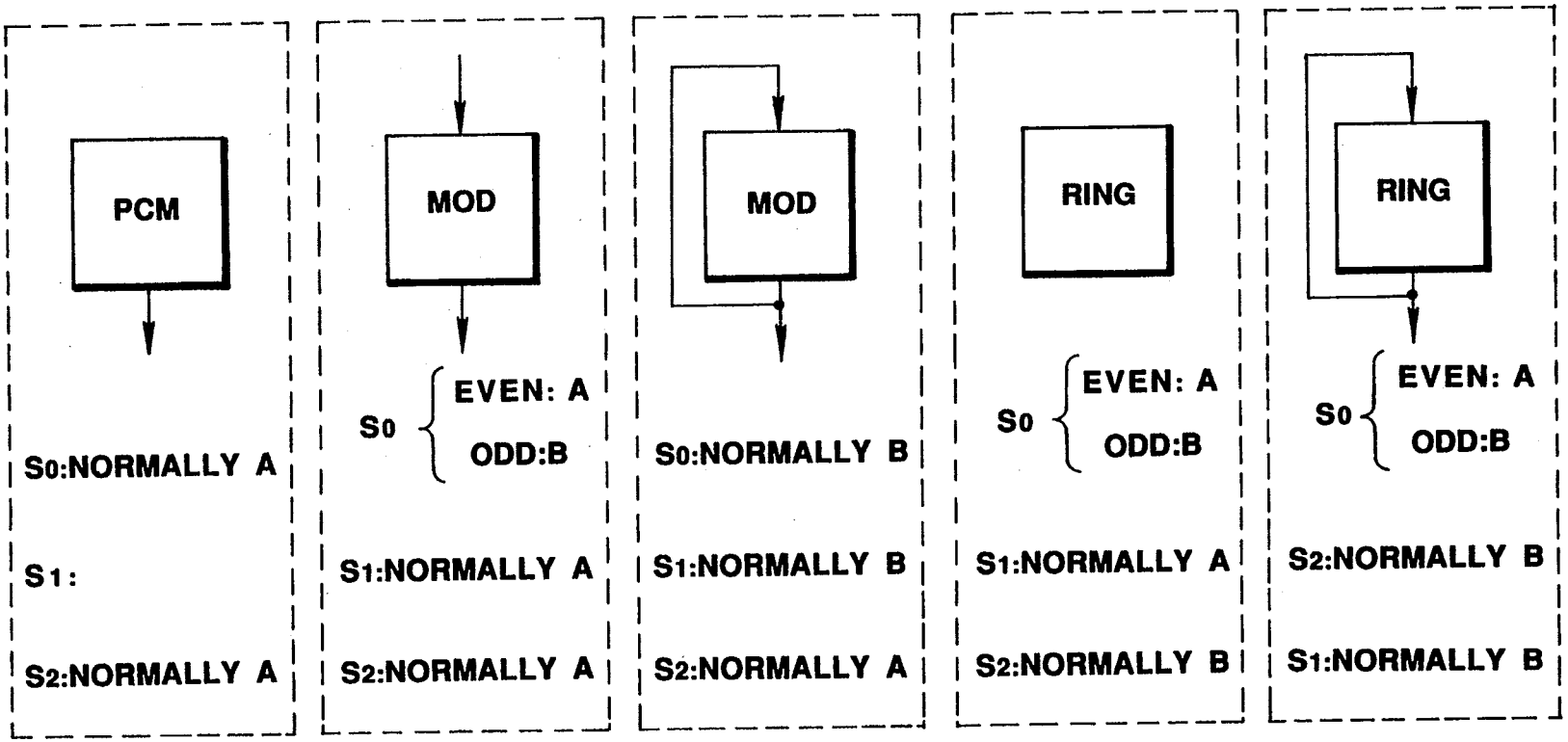
FIGS. 24A to 24E show the relationships among control states $S_0$, $S_1$, and $S_2$, and tone synthesis methods.

As shown in FIG. 24A, when the signal $S_0$ is set to cause the selectors 505 and 510 to always select their terminals A, the signal $S_1$ is indefinite, and the signal $S_2$ is set to cause the selector 512 to always select the envelope signal E input to its terminal A, tone synthesis by the PCM method is performed.

As shown in FIG. 24B, when the signal $S_0$ is set to cause the selectors 505 and 510 to select their terminals A in even-numbered tone generation channels and to select their terminals B in odd-numbered tone generation channels, the signal $S_1$ is set to cause the selector 508 to always select the delay output D input to its terminal A, and the signal $S_2$ is set to cause the selector 512 to always select the envelope signal E input to the terminal A, tone synthesis by the modulation method using the PCM waveform output $e_p$ (delay output $D^{-1}$) of the immediately preceding sampling period of an adjacent tone generation channel as the modulation signal $W_M$ is performed. In this case, the PCM waveform $e_p$ is a functional waveform such as a sine wave, a sawtooth wave, a rectangular wave, or the like. The PCM waveform output $e_p$ is controlled not to be output from the accumulator 516 shown in FIG. 17 (this operation will be described later).

As shown in FIG. 24C, when the signal $S_0$ is set to cause the selectors 505 and 510 to always select their terminals B, the signal $S_1$ is set to cause the selector 508 to always select the delay output D input to its terminal B, and the signal $S_2$ is set to cause the selector 512 to always select the envelope signal E input to its terminal A, tone synthesis by the modulation method using the modulated waveform output $e_M$ (delay output D) of the immediately preceding sampling period of its own tone generation channel as the modulation signal $W_M$ is performed.

As shown in FIG. 24D, when the signal $S_0$ is set to cause the selectors 505 and 510 to select their terminals A in even-numbered tone generation channels and to select their terminals B in odd-numbered tone generation channels, the signal $S_1$ is fixed to select the terminal A, and the signal $S_2$ is set to cause the selector 512 to always select the delay output $D^{-1}$ input to its terminal B, tone synthesis by a ring modulation method using the PCM waveform output $e_p$ (delay output $D^{-1}$) of the immediately preceding sampling period of an adjacent tone generation channel as an envelope is performed. In this case, the PCM waveform output $e_p$ is controlled not to be output from the accumulator 516 shown in FIG. 17 like in FIG. 24B.

As shown in FIG. 24E, when the signal $S_0$ is set to cause the selectors 505 and 510 to select their terminals A in even-numbered tone generation channels and to select their terminals B in odd-numbered tone generation channels, the signal $S_1$ is set to cause the selector 508 to always select the delay output D input to its terminal B, and the signal $S_2$ is set to cause the selector 512 to always select the delay output $D^{-1}$ input to its terminal B, tone synthesis by a ring modulation method using the PCM waveform output $e_p$ (delay output $D^{-1}$) of the immediately preceding sampling period of an adjacent tone generation channel as an envelope, and using the modulated waveform output $e_M$ (delay output D) of the immediately preceding sampling period of its own tone generation channel as the modulation signal $W_M$ is performed. In this case, the PCM waveform output $e_p$ is controlled not to be output from the accumulator 516 shown in FIG. 17.

As described above, in this embodiment, various tone synthesis methods can be desirably mixed in units of tone generation channels.

Figure 25A:
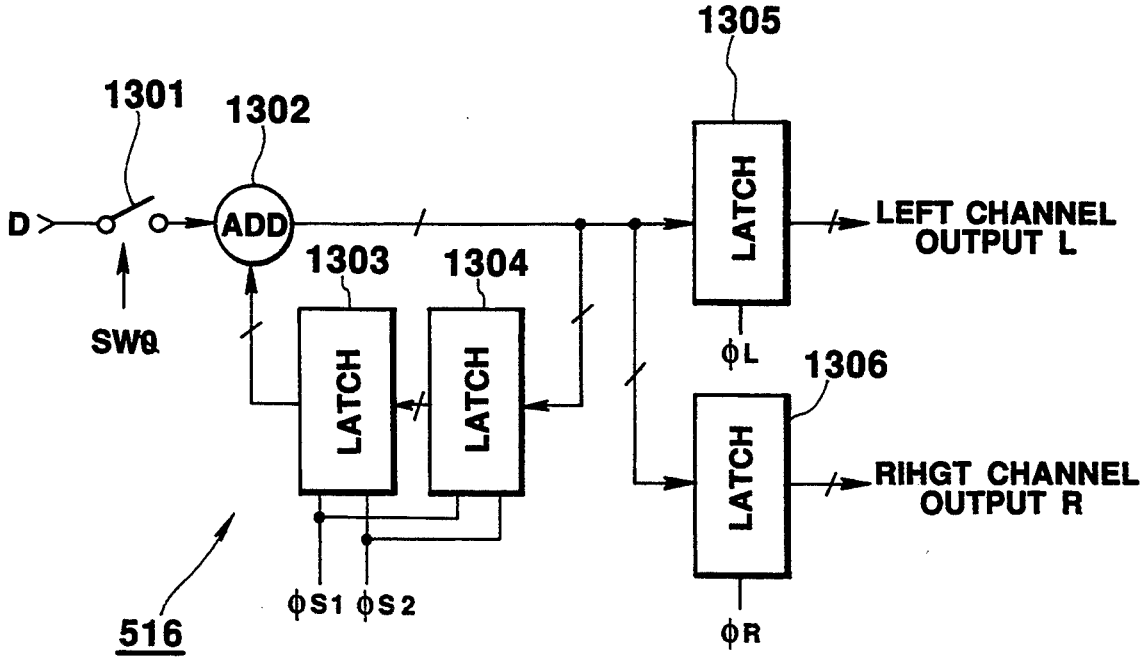
FIGS. 25A and 25B are diagrams of an accumulator 516.
Figure 25B:
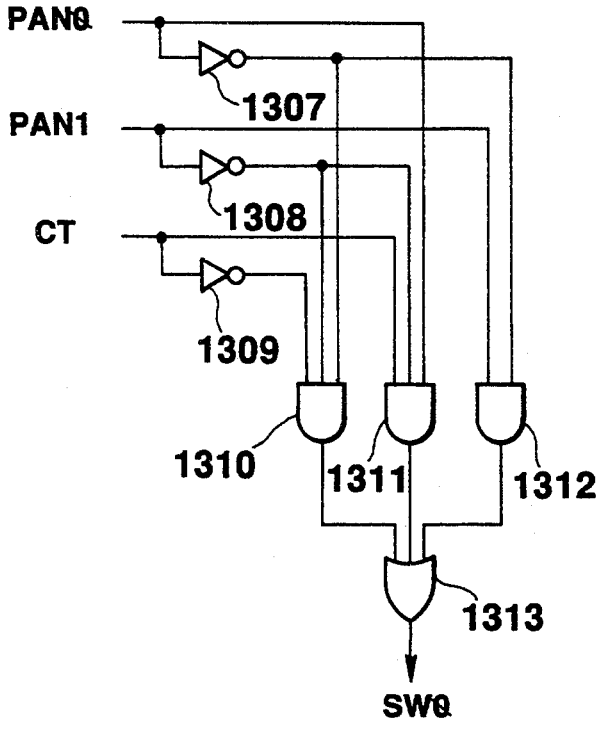

FIGS. 25A and 25B show the arrangement of the accumulator 516 shown in FIG. 17. FIG. 25A shows a circuit portion for distributing a tone waveform obtained as the delay output D in FIG. 17 to the left and right channels L and R. FIG. 25B shows a decoder circuit for generating a selector control signal SW0 for ON/OFF-controlling a selector 1301 shown in FIG. 25A.

In an operation of the accumulator 516 shown in FIG. 25A, each time-divisional interval (tone generation timing interval of each tone generation channel) is divided into a left-channel processing interval in the first half, and a right-channel processing interval in the second half, as will be described later, and an accumulation operation is performed by an ADD 1302, and two series latches 1303 and 1304 for each of the left and right channels.

More specifically, the delay output D for each tone generation channel supplied during each time-divisional interval is accumulated on a left-channel accumulated value output from the latch 1303 by the ADD 1302 when the selector 1301 is turned on during the left channel processing interval in the time-divisional interval. On the other hand, when the selector 1301 is turned on during a right-channel processing interval in the time-divisional interval, the output D is accumulated on a right-channel accumulated value output from the latch 1303 by the ADD 1302. When the selector 1301 is turned on during the entire time-divisional interval, the output D is accumulated on the left- and right-channel accumulated values successively output from the latch 1303 by the ADD 1302, respectively. Furthermore, when the selector 1301 is not turned-on during the time-divisional interval, the delay output D of the corresponding tone generation channel is not input to the accumulator 516 shown in FIG. 17, and is used as only the modulation signal $W_M$ via the terminal B of the selector 508, as described above.

The left-channel accumulated value is added to the delay output D of the 31st tone generation channel during the left-channel processing interval in the time-divisional interval for the last 32nd tone generation channel during each sampling period, and the sum is latched by a left-channel output latch 1305. The latched value is then output as the left-channel output L. The right-channel accumulated value is added to the delay output D of the 31st tone generation channel during the right-channel processing interval in the time-divisional interval for the last 32nd tone generation channel, and the sum is latched by a right-channel output latch 1306. The latched value is then output as the right-channel output R.

The latches 1303 and 1304 shown in FIG. 25A are operated in response to clocks $\phi_{S1}$ and $\phi_{S2}$ from the controller 501 shown in FIG. 17, and the left- and right-channel output latches 1305 and 1306 are operated in response to clocks $\phi_L$ and $\phi_R$ from the controller 501.

The selector 1301 shown in FIG. 25A is ON/OFF-controlled in accordance with the selector control signal SW0 from the decoder unit shown in FIG. 25B.

In FIG. 25B, control data PAN from the controller 501 shown in FIG. 17 consists of 1-bit pan control data PAN0 and 1-bit pan control data PAN1 and a predetermined pair of data are set for each of 32 time-divisional intervals corresponding to the 32 tone generation channels. An AND gate 1310 receives signals obtained by respectively inverting the pan control data PAN0 and PAN1, and a clock CT by inverters 1307, 1308, and 1309. An AND gate 1311 receives the pan control data PAN0 and the clock CT, and a signal obtained by inverting the pan control data PAN1 by the inverter 1308. Furthermore, an AND gate 1312 receives a signal obtained by inverting the pan control data PAN0 by the inverter 1307, and the pan control data PAN1. The outputs from the AND gates 1310, 1311, and 1312 are input to an OR gate 1313, and the selector control signal SW0 can be obtained as the output from the OR gate 1313.

Assuming that the delay output D of a given tone generation channel is to be output as the left-channel output L, PAN0=0 and PAN1=0 are set in the time-divisional interval corresponding to the given tone generation channel. Thus, during the first-half left-channel processing interval in which the clock CT in the time-divisional interval goes to Low level, the output from the AND gate 1310 goes to High level, and the selector control signal SW0 as the output from the OR gate 1313 goes to High level. Thus, during the left-channel processing interval in the time-divisional interval, the selector 1301 shown in FIG. 25A is turned on.

Assuming that the delay output D of a given tone generation channel is to be output as the right-channel output R, PAN0=1 and PAN1=0 are set in the time-divisional interval corresponding to the given tone generation channel. Thus, during the second-half right-channel processing interval in which the clock CT in the time-divisional interval goes to High level, the output from the AND gate 1311 goes to High level, and the selector control signal SW0 as the output from the OR gate 1313 goes to High level. Thus, during the right-channel processing interval in the time-divisional interval, the selector 1301 shown in FIG. 25A is turned on.

Assuming that the delay output D of a given tone generation channel is to be output as both the left- and right-channel outputs L and R, PAN0=0 and PAN1=1 are set during the time-divisional interval corresponding to the given tone generation channel. Thus, the output from the AND gate 1312 goes to High level during the entire time-divisional interval regardless of the state Of the clock CT, and the selector control signal SW0 as the output from the OR gate 1313 goes to High level. Thus, the selector 1301 shown in FIG. 25A is turned on during the entire time-divisional interval.

Assuming that the delay output D of a given tone generation channel is used as only the modulation signal $W_M$ via the terminal B of the selector 508 without being input to the accumulator 516 shown in FIG. 17, PAN0=1 and PAN1=1 are set during the time-divisional interval corresponding to the given tone generation channel. Thus, during this time-divisional interval, none of the AND gates 1310, 1311, and 1312 are enabled, and the selector control signal SW0 is kept at Low level. Therefore, the selector 1301 shown in FIG. 25A is not turned on during this time-divisional interval.

Figures 26A, 26B, 26C, 26D, 26E, 26F, 26G, 26H, 26I, 26J, 26K:
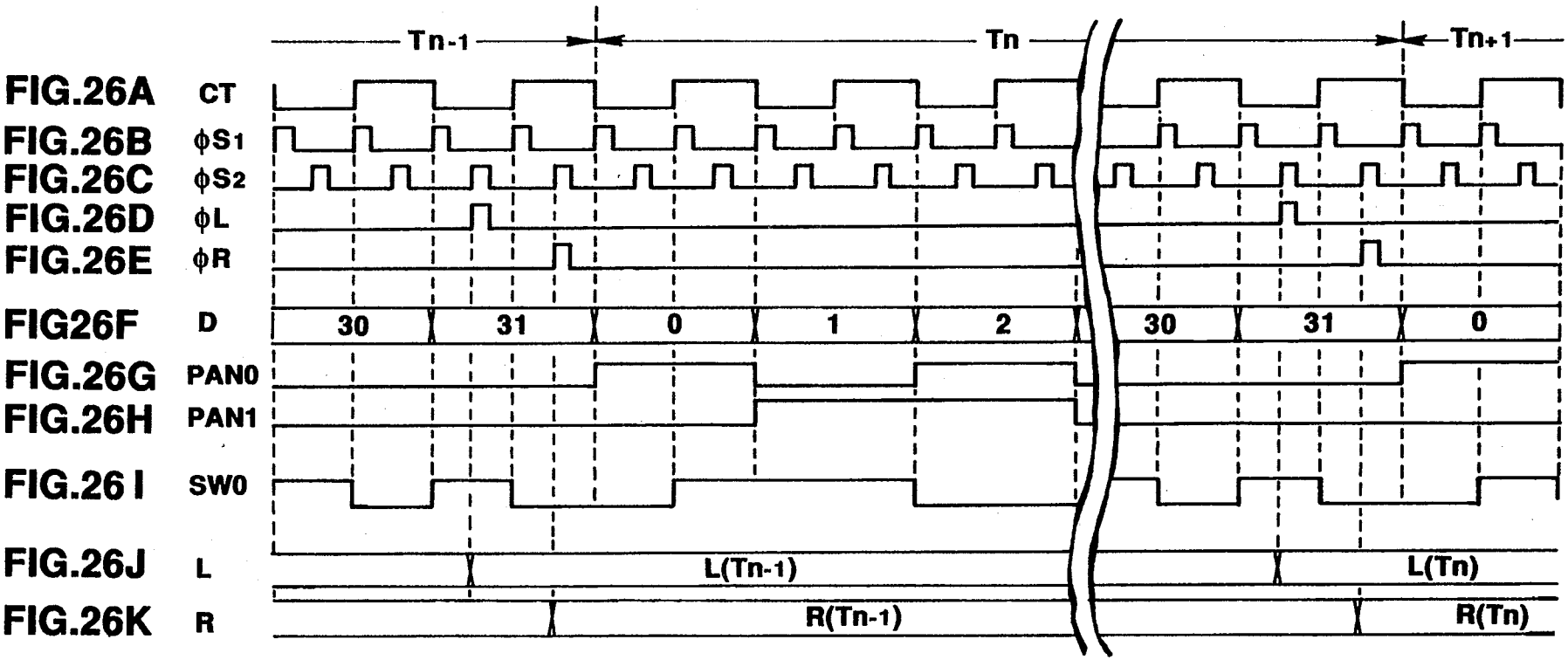
FIGS. 26A to 26K are operation timing charts of the accumulator 516.

The operation of the accumulator 516 having the arrangement shown in FIGS. 25A and 25B will be described below with reference to the operation timing chart shown in FIGS. 26A to 26K. 20 In FIGS. 26A to 26K, during time-divisional intervals corresponding to the 30th and 31st tone generation channels (FIG. 26F), PAN0=0 and PAN1=0 (FIGS. 26G and 26H). For this reason, during the left-channel processing interval in which the clock CT (FIG. 26A) goes to Low level, the selector control signal SW0 (FIG. 26I) goes to High level, and the selector 1301 is turned on. At a timing of the leading edge of the clock $\phi_{S1}$ (FIG. 26B) in this interval, the ADD 1302 adds the delay output D to the left-channel accumulated value output from the latch 1303. The sum is latched by the latch 1304 at a timing of the leading edge of the clock $\phi_{S2}$ (FIG. 26C).

On the other hand, since PAN0=1 and PAN1=0 during the time-divisional interval corresponding to the 0th tone generation channel, the selector control signal SW0 goes to High level during the right-channel processing interval in which the clock CT goes to High level, and the selector 1301 is enabled. At a timing of the leading edge of the clock $\phi_{S1}$ in this interval, the ADD 1302 adds the delay output D to the right-channel accumulated value output from the latch 1303, and the sum is latched by the latch 1304 at a timing of the leading edge of the clock $\phi_{S2}$.

During the time-divisional interval corresponding to the 1st tone generation channel, since PAN0=0 and PAN1=1, the selector control signal SW0 goes to High level during both the left- and right-channel processing intervals regardless of the state of the clock CT, and the selector 1301 is turned on. The ADD 1302 adds the delay output D to the left-channel accumulated value output from the latch 1303 at a timing of the leading edge of the clock $\phi_{S1}$ during the left-channel processing interval, and the sum is latched by the latch 1304 at a timing of the leading edge of the clock $\phi_{S2}$. Subsequently, the ADD 1302 adds the delay output D to the right-channel accumulated value output from the latch 1303 at a timing of the leading edge of the clock $\phi_{S1}$ during the right-channel processing interval, and the sum is latched by the latch 1304 at a timing of the leading edge of the clock $\phi_{S2}$.

Furthermore, during the time-divisional interval corresponding to the 2nd tone generation channel, since PAN0=1 and PAN1=1, the selector control signal SW0 goes to Low level during the entire interval, and the selector 1301 is kept OFF. Thus, the delay output D is used as only the modulation signal $W_M$ (FIG. 17).

During the left-channel processing interval in which the clock CT goes to Low level during the time-divisional interval corresponding to the 31st tone generation channel during a sampling period $T_{n-1}$, the ADD 1302 adds the delay output D input from the selector 1301 to the left-channel accumulated value output from the latch 1303 at a timing of the leading edge of the clock $\phi_{S1}$ during this interval, and the sum is latched by the left-channel output latch 1305 at a timing of the leading edge of the clock $\phi_L$ (FIG. 26D). The latched sum is then output as the left-channel output $L(T_{n-1})$. This output value is held in the left-channel output latch 1305 during one sampling period, and is converted into an analog tone signal by the D/A converter 519 (L) and the LPF 520 (L) shown in FIG. 17. The analog tone signal is amplified by the amplifier 521 (L), and the amplified signal is then produced as a tone from the loudspeaker 522 (L).

Similarly, during the right-channel processing interval in which the clock CT goes to High level in the time-divisional interval corresponding to the 31st tone generation channel during the sampling period $T_{n-1}$, the latch 1303 outputs the right-channel accumulated value at a timing of the leading edge of the clock $\phi_{S1}$ during this interval. The accumulated value passes through the ADD 1302 at a timing of the leading edge of the clock $\phi_R$ (FIG. 26E; no addition is performed at this timing in this case), and is latched by the right-channel output latch 1306. The latched value is then output as the right-channel output R ($T_{n-1}$). This output value is held in the right-channel output latch 1306 during one sampling period, and is converted into an analog tone signal by the D/A converter 519 (R) and the LPF 520 (R) shown in FIG. 17. Thereafter, the analog tone signal is amplified by the amplifier 521 (R), and the amplified signal is then produced as a tone from the loudspeaker 522 (R).

The above-mentioned output operations are similarly performed in other sampling periods $T_n$ and $T_{+1}$.

In the second embodiment described above, the waveform ROM 506 shown in FIG. 17 stores only one carrier signal $W_c$ having characteristics shown in FIG. 14, as shown in FIG. 19, and the triangular wave decoder 509 shown in FIG. 17 comprises a hardware arrangement shown in FIG. 18. However, the present invention is not limited to these. For example, the waveform ROM 506 may store waveforms in the right columns in FIGS. 16A to 16D as carrier signals $W_c$, and ROMs for storing waveforms in the left columns in FIGS. 16A to 16D may be arranged in place of the triangular wave decoder 509 to be selectively operated.

The third embodiment of the present invention will be described below.

This embodiment exemplifies a tone waveform generation apparatus using a combination of tone waveform generation methods, i.e., a PCM method and a modulation method, and in particular, a method different from the conventional FM method is used as the modulation method. Prior to a description of the detailed arrangement of this embodiment, a tone waveform generation method based on the modulation method used in this embodiment will be described below.

Figure 27:
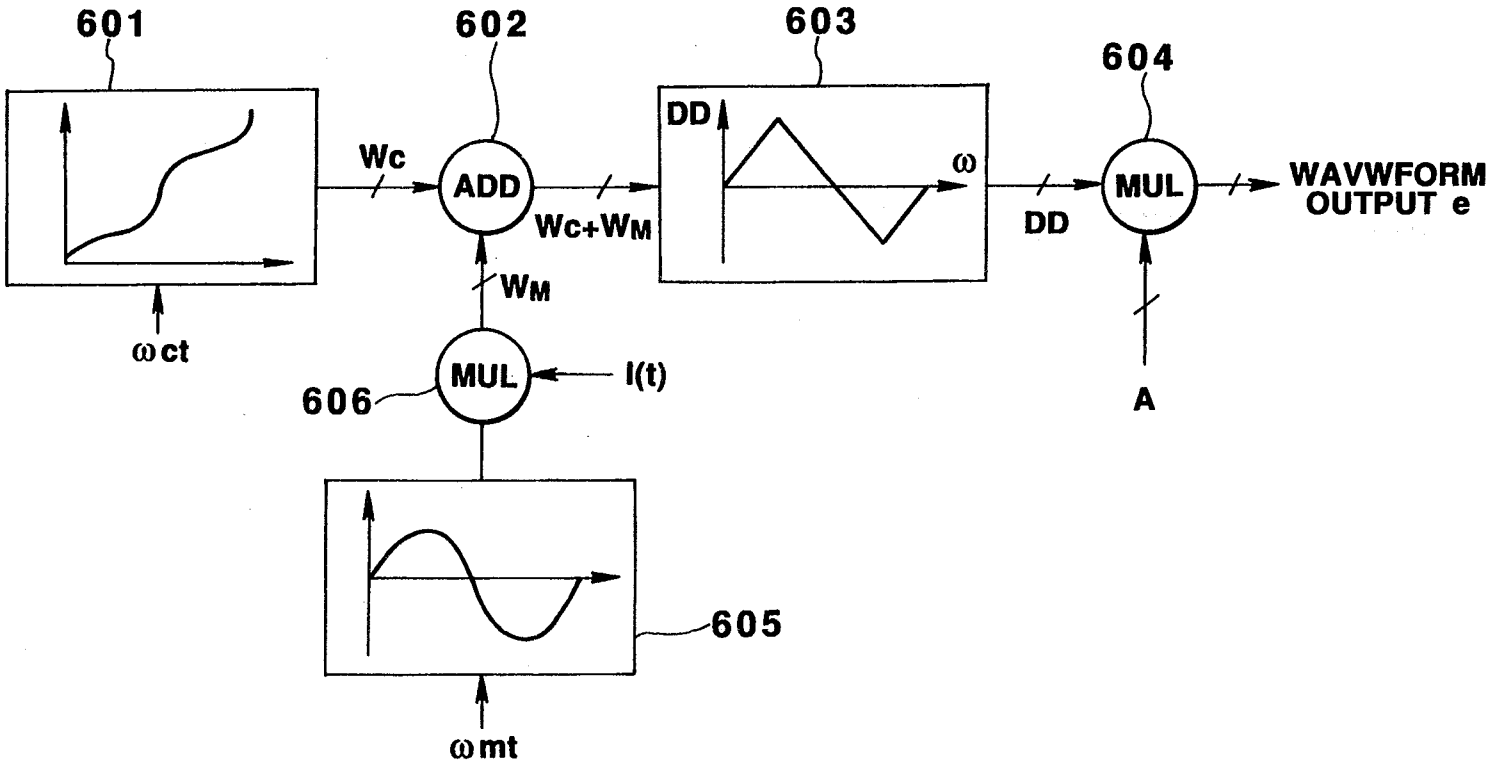
FIG. 27 is a diagram showing a tone waveform generation apparatus by a modulation method as a fundamental arrangement of the third embodiment of the present invention.

FIG. 27 shows an arrangement of a tone waveform generation apparatus based on the modulation method as the principle of this embodiment.

In FIG. 27, a carrier wave ROM 601, an ADD 602, a decoder 603, and an MUL 604 are the same as the carrier wave ROM 101, the ADD 102, the decoder 103, and the MUL 104 in FIG. 13, and a detailed description thereof will be omitted.

In FIG. 27, a modulation wave ROM 605 and a multiplier (MUL) 606 are arranged. A modulation wave phase angle $\omega_{mt}$ whose value changes within a range of 0 to $2\pi$ [rad] is used as an address for the modulation wave ROM 605. A modulation signal read out from the ROM 605 using the address is multiplied with a modulation index I(t) [rad] which can be changed over time by the MUL 606, thus obtaining a modulation signal $W_M$. The modulation wave phase angle $\omega_{mt}$ is obtained by multiplying an angular velocity $\omega_m$ with a time to [sec].

The modulation wave ROM 605 stores a normal sine function waveform. Therefore, the relationship between the modulation wave phase angle $\omega_{mt}$ and the modulation signal $W_M$ [rad] is given by:

$$W_M = I(t)\sin\omega_{mt} \tag{25}$$

A carrier signal $W_c$ and the modulation signal $W_M$ calculated by equations (14) and (25) are added to each other, and the sum signal is input to the decoder 603. The decoder 603 outputs a decode output DD. A waveform output e obtained by multiplying the decode output DD with an amplitude coefficient A by the MUL 604 is given by:

$$\begin{aligned} e &= A \cdot TRI\{(\pi/2)\sin\omega_{ct} + I(t)\sin\omega_{mt}\} \\ &\quad (0 \leqq \omega_{ct} \leqq \pi/2) \\ e &= A \cdot TRI\{\pi - (\pi/2)\sin\omega_{ct} + I(t)\sin\omega_{mt}\} \\ &\quad (\pi/2 \leqq \omega_{ct} \leqq 3\pi/2) \\ e &= A \cdot TRI\{2\pi + (\pi/2)\sin\omega_{ct} + I(t)\sin\omega_{mt}\} \\ &\quad (3\pi/2 \leqq \omega_{ct} \leqq 2\pi) \end{aligned} \tag{26}$$

where TRI(x) is defined as a triangular wave function.

When the modulation index I(t) is 0, i.e., when no modulation is performed, an input waveform to the decoder 603 is the carrier signal $W_c$ itself defined by one of equations (14), and is expressed by equation (16).

Note that the relationship between the carrier $W_c$ and the carrier wave phase angle $\omega_{ct}$ is represented by equations (14) and FIG. 14, and a function FA in FIG. 15.

The characteristics of the decoder 603 (D=TRI(x) where x is the input) are also expressed by equations (17) and a function FB in FIG. 15.

As can be understood from equations (14), (16), and (17), when no modulation is performed, a single sine wave $A \cdot \sin\omega_{ct}$ including no harmonic components of high orders at all in any region of the carrier wave phase angle $\omega_{ct}$ is output. More specifically, when the amplitude coefficient A=1, the relationship between the carrier wave phase angle $\omega_{ct}$ and the waveform output e in a non-modulation mode is expressed by a single sine wave.

As can be understood from the above-mentioned relationships, in order to realize a process for decaying a tone to only a single sine wave component, or generation of a tone consisting of only a single sine wave component, the value of the modulation index I(t) in equations (26) can be made to approach 0 with an elapse of time.

A change in waveform output e when the value of the modulation index I(t) is increased will be described below. When the value of the modulation index I(t) is gradually increased from 0, a ratio of the modulation signal $W_M$ included in the sum waveform $W_c+W_M$ output from the ADD 602 in FIG. 27 is increased. Therefore, the waveform output e is gradually distorted on the time base, and is changed to include many harmonic components of high orders on the frequency axis. Thus, harmonic components of high orders at frequencies 10 times the pitch frequency appear. In addition, power of harmonic components of low orders can be complicatedly changed in accordance with a change in I(t). In the first prior art of the FM method based on equation (1) described in the prior art, it is difficult to generate a harmonic component of a high order at a frequency 11 times the pitch frequency or more. However, in this embodiment, a harmonic component of a high order about at a frequency about 30 times the pitch frequency can be generated.

According to the above-mentioned fact, in the tone waveform generation apparatus shown in FIG. 27, when the value of the modulation index I(t) is changed between about 0 to $2\pi$ [rad], a process for decaying a tone to only a single sine wave component or generation of a tone consisting of only a single sine wave component can be realized. In addition, a tone clearly including up to harmonic components of high orders as frequency components can be easily generated. In particular, when a tone having a low pitch is to be synthesized, i.e., when a tone which has a low fundamental frequency (pitch frequency) and includes many harmonic components of high orders within an audio frequency range is to be synthesized, the tone waveform generation apparatus of this embodiment is effective. As a typical example, a decay tone for several tens of seconds obtained when a bass key of a piano is strongly depressed includes harmonic components of high orders exceeding that of the 30th order. When such a tone is synthesized, the tone waveform generation apparatus of this embodiment is very effective.

The present invention is not limited to this embodiment. For example, when the characteristics of the decoder 603 and functions stored in the carrier wave ROM 601 are selected so that the decode output DD of the decoder 603 becomes a sine wave, the same effect as described above can be obtained. Combinations of the characteristics of the decoder 603 and the functions stored in the carrier wave ROM 601 are the same as those shown in FIGS. 16A to 16D. In FIGS. 16A to 16D, a function for defining the relationship between the carrier wave phase angle $\omega_{ct}$ and the carrier signal $W_c$ is stored in the carrier wave ROM 601, and the decoder 603 converts the input x in accordance with a function for defining the relationship between the input x and the decode output DD. Thus, when the value of the modulation index I(t) in the MUL 606 in FIG. 27 is set to be 0, the carrier signal $W_c$ output from the carrier wave ROM 601 is input to the decoder 603, so that a single sine wave can be output as the output e. When the value of the modulation index I(t) is set to be other than 0, the waveform output e including many harmonic components of high orders can be obtained.

For example, PCM tone waveforms or waveforms including harmonic components of high orders such as sawtooth waves, rectangular waves, and the like are stored in the modulation wave ROM 605, and are input to the decoder 603, so that tone waveforms including more harmonic components of high orders can be synthesized. An embodiment associated with these techniques will be described later.

Figure 28:
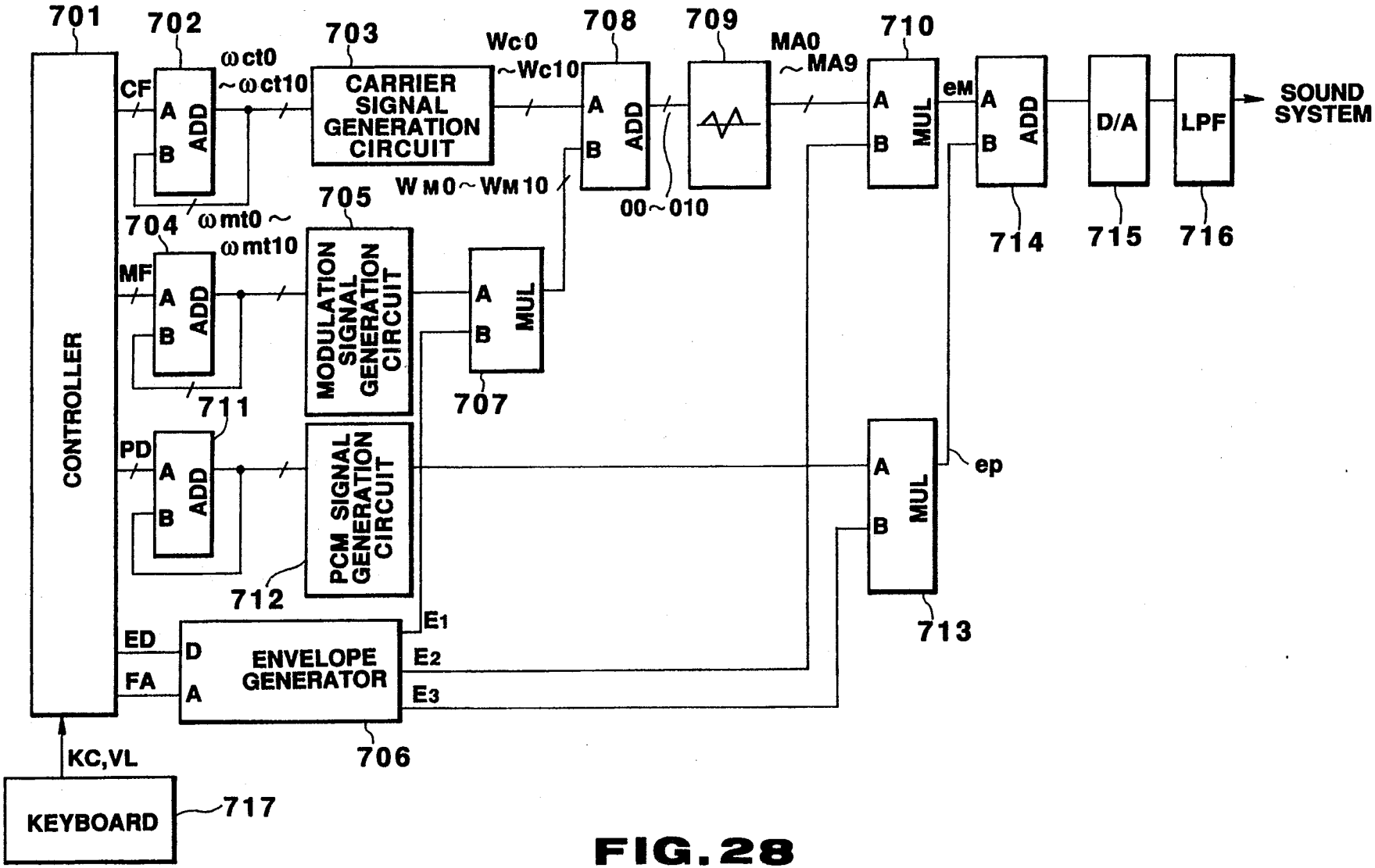
FIG. 28 is a block diagram of the third embodiment of the present invention.

FIG. 28 is a block diagram showing the overall arrangement of an electronic keyboard instrument according to the third embodiment. In this embodiment, since a PCM tone signal generation circuit is additionally used to have the arrangement of the tone waveform generation apparatus shown in FIG. 27 as a fundamental arrangement, the following description will be made with reference to FIG. 27, and the like.

A controller 701 generates and outputs carrier data CF, modulator data MF, pitch data (to be referred to as PCM pitch data hereinafter) PD for determining an incremental width corresponding to a pitch of a depressed key when an address of a PCM signal generation circuit 712 is read out, and envelope data ED and FA (to be described in detail later) in accordance with setup states of a parameter setup unit (not shown), and key code data KC and velocity data VL input from a keyboard unit 717.

Adders 702, 704, and 711 receive their outputs at their augend terminals B, and respectively receive the carrier data CF, the modulator data MF, and the PCM pitch data PD at their addend terminals A. Thus, the adder 702 outputs carrier phase angle data $\omega_{ct}$0 to $\omega_{ct}$10 (11 bits) which are sequentially increased by the value of the input data. The adder 704 outputs modulation phase angle data $\omega_{mt}$0 to $\omega_{mt}$10 (11 bits). The adder 711 generates an address signal for reading the PCM signal generation circuit 712. The carrier data CF and the PCM pitch data PD are determined to have values corresponding to, e.g., key code data KC from the keyboard unit 717. The modulator data MF is determined to have a ratio set by a player in correspondence with, e.g., the carrier data CF. Thus, a tone waveform having a pitch corresponding to a key operated on the keyboard unit 717 is generated. Note that the carrier phase angle data $\omega_{ct}$0 to $\omega_{ct}$10, and the modulation phase angle data $\omega_{mt}$0 to $\omega_{mt}$10 respectively correspond to the carrier phase angle $\omega_{ct}$ and the modulation phase angle $\omega_{mt}$ shown in FIG. 27. The carrier data CF corresponds to the angular velocity $\omega_c$ of the carrier phase angle $\omega_{ct}$, and the modulator data MF corresponds to the angular velocity $\omega_m$ of the modulation phase angle $\omega_{mt}$.

The carrier phase angle data $\omega_{ct}$0 to $\omega_{ct}$10, and the modulation phase angle data $\omega_{mt}$0 to $\omega_{mt}$10 are respectively input, as address signals, to a carrier signal generation circuit 703 and a modulation signal generation circuit 705. Note that the carrier signal generation circuit 703 and the modulation signal generation circuit 705 correspond to the carrier wave ROM 601 and the modulation wave ROM 605 shown in FIG. 27, respectively.

On the other hand, an envelope generator 706 outputs 11-bit modulation index data $E_1$, 10-bit amplitude coefficient data $E_2$, and amplitude coefficient data $E_3$ (for $0 \leqq E_3 \leqq 1$) for providing an amplitude envelope to a PCM tone signal read out from the PCM signal generation circuit 712 on the basis of address data FA and setup data ED from the controller 701. Note that $E_1$ and $E_2$ respectively correspond to the modulation index I(t) and the amplitude coefficient A shown in FIG. 27, and can change over time on the basis of key code data KC and velocity data VL from the keyboard unit 717.

The modulation index data $E_1$ has a value equal to or smaller than 1. A multiplier 707 multiplies the outputs from the modulation signal generation circuit 705 input to its terminal A with the modulation index data $E_1$ input at its terminal B, and outputs modulation signal data $W_M$0 to $W_M$10 (11 bits). The multiplier 707 and the modulation signal data $W_M$0 to $W_M$10 correspond to the MUL 606 and the modulation signal $W_M$ shown in FIG. 27, respectively.

Carrier signal data $W_c$0 to $W_c$10 and the modulation signal data $W_M$0 to $W_M$10 output from the carrier signal generation circuit 703 and the multiplier 707 are respectively input to terminals A and B of an adder 708. The adder 708 adds input data, and outputs data O0 to O10 (11 bits). Note that the adder 708 and the data O0 to O10 correspond to the ADD 602 and the sum waveform $W_c+W_M$ in FIG. 27, respectively.

The data O0 to O10 are input to a triangular wave decoder 709. The triangular wave decoder 709 outputs decode output data MA0 to MA9 (10 bits). The triangular wave decoder 709 and decode output data MA0 to MA9 correspond to the decoder 603 and the decode output DD shown in FIG. 27, respectively. The detailed arrangement of the triangular wave decoder 709 is the same as that shown in FIG. 18.

The decode output data MA0 to MA9 are input to a terminal A of a multiplier 710, and are multiplied with the 10-bit amplitude coefficient data $E_2$ input to a terminal B. Thus, an amplitude-modulated tone signal (to be referred to as a modulated tone signal hereinafter) $e_M$ is output from the multiplier 710. Note that the amplitude coefficient data $E_2$ has a value equal to or smaller than 1.

The output $e_M$ from the multiplier 710 is input to a terminal A of an adder 714.

A PCM tone signal read out from the PCM signal generation circuit 712 is input to a terminal A of a multiplier 713, and is multiplied with the above-mentioned amplitude coefficient data $E_3$ input to a terminal B. Thus, the PCM tone signal is amplitude-modulated. Thereafter, a PCM tone signal $e_p$ as an output from the multiplier 713 is input to a terminal B of the adder 714, and is added to the modulated tone signal $e_M'$ as an output from the multiplier 710, input to a terminal A.

A digital tone signal generated in this manner is converted into an analog tone signal via a D/A converter 715 and a low-pass filter 716, and the analog tone signal is then produced as a sound from a sound system (not shown).

With the above arrangement, when carrier data CF, modulator data MF, PCM pitch data PD, and envelope data ED output from the controller 701 in correspondence with a performance operation by a player are controlled, the player can cause the apparatus to output a tone whose pitch, tone volume, tone color, and the like are controlled on the basis of his or her performance operation, and to produce it as a sound.

Figure 29:
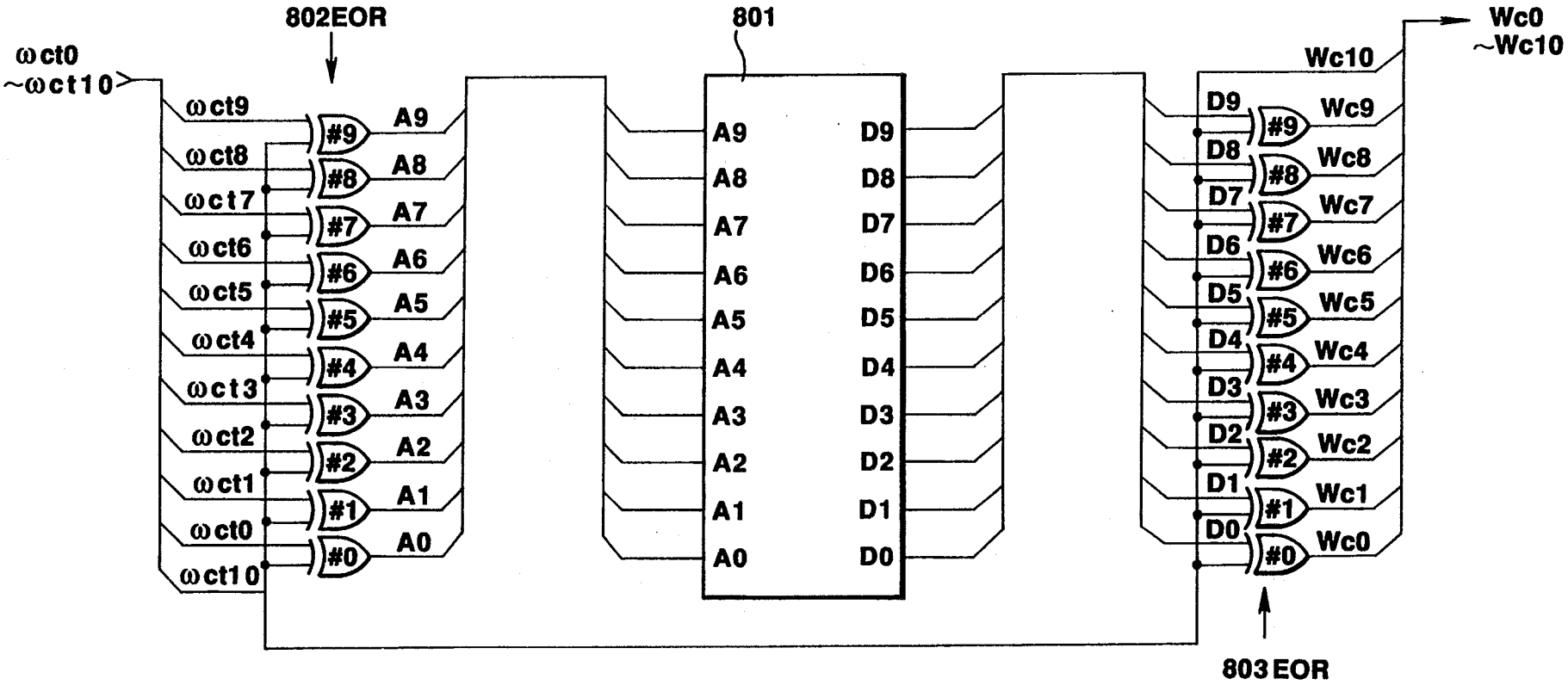
FIG. 29 is a circuit diagram of a carrier signal generator.

FIG. 29 shows an arrangement of the carrier signal generation circuit 703 shown in FIG. 28.

The first input terminals of 0th to 9th exclusive OR gates (to be referred to as EORs hereinafter) 802 receive the carrier phase angle MSB $\omega_{ct}$10 from the adder 702 (FIG. 28), and their second terminals receive 0th to 9th carrier phase angle bits $\omega_{ct}$0 to $\omega_{ct}$9.

Outputs A0 to A9 from the 0th to 9th EORs 802 are input to a carrier wave ROM 801 as an address signal. Outputs D0 to D9 from the carrier wave ROM 801 are input to the first input terminals of 0th to 9th EORs 803. The second input terminals of the 0th to 9th EORs 803 receive the carrier phase angle MSB $\omega_{ct}$10.

The outputs from the 0th to 9th EORs 803 and the carrier phase angle MSB $\omega_{ct}$10 are output to the adder 708 (FIG. 28) as the carrier signal data $W_c$0 to $W_c$10.

The operation of the circuit shown in FIG. 29 will be described below with reference to the charts shown in FIGS. 30A to 30F.

The carrier wave ROM 801 shown in FIG. 29 stores a waveform corresponding to a ½ period (0 to $\pi$ [rad]) of the carrier signal $W_c$ described above with reference to FIG. 14 or equation (14). More specifically, from equation (14), if a value determined by the outputs D0 to D9 from the carrier wave ROM 801 (FIG. 29) is represented by Y1, the ROM 801 stores:

$$Y1 = (\pi/2)\sin\omega_{ct} \quad (0 \leqq \omega_{ct} \leqq \pi/2) \qquad (27)$$
$$Y1 = \pi - (\pi/2)\sin\omega_{ct} \quad (\pi/2 \leqq \omega_{ct} \leqq \pi)$$

Note that the carrier phase angle $\omega_{ct}$ is the value determined by $\omega_{ct}$0 to $\omega_{ct}$9.

On the other hand, lower 10 bits $\omega_{ct}$0 to $\omega_{ct}$9 the carrier phase angle data $\omega_{ct}$0 to $\omega_{ct}$10 output from the adder 702 shown in FIG. 28 can designate a phase angle within a range of 0 to $\pi$ [rad] while the MSB $\omega_{ct}$10 is at logic "0". Furthermore, the lower 10 bits $\omega_{ct}$0 to $\omega_{ct}$9 can designate a phase angle within a range of $\pi$ to $2\pi$ [rad] while the MSB $\omega_{ct}$10 is at logic "1".

Figures 30A, 30B, 30C, 30D, 30E, 30F:
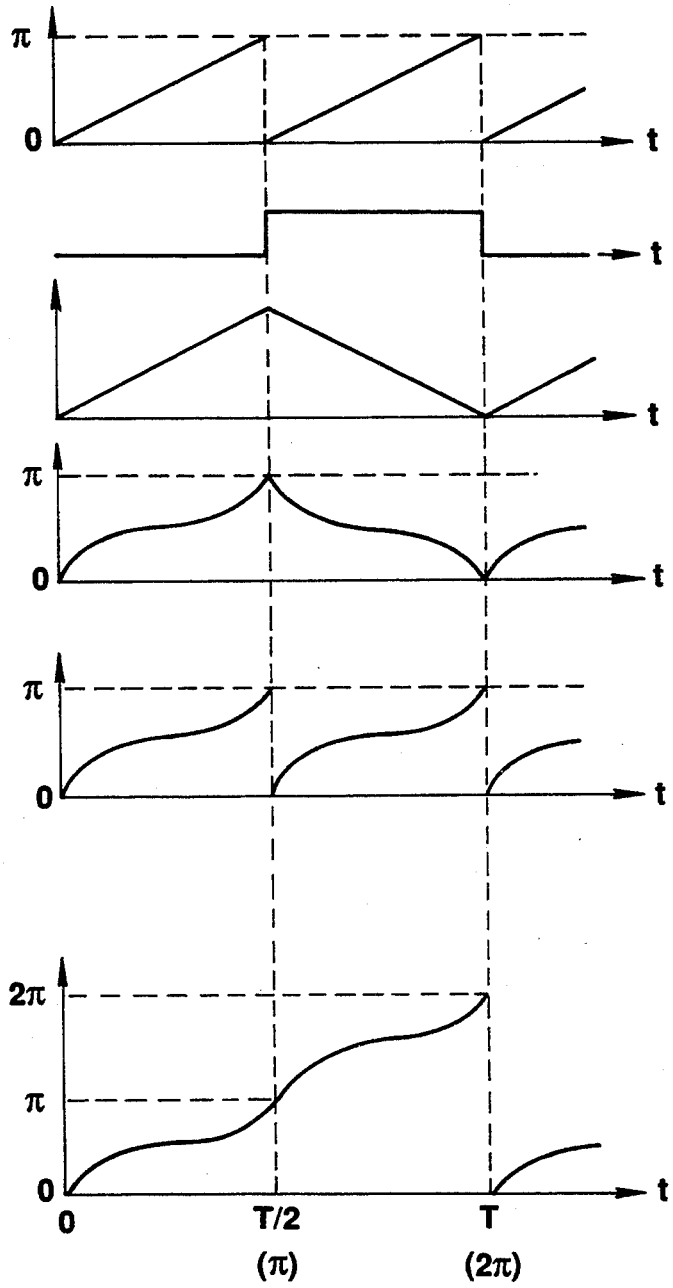
FIGS. 30A to 30F are charts for explaining an operation of the carrier signal generator.

Therefore, if a time required for changing a value designated by the carrier phase angle data $\omega_{ct}$0 to $\omega_{ct}$10 in the adder 702 (FIG. 28) from 0 to $2\pi$ is represented by T, the carrier phase angle MSB $\omega_{ct}$10 goes to logic "0" during a time interval between 0 and T/2, as shown in FIG. 30B, and a value indicated by the lower 10 carrier phase angle bits $\omega_{ct}$O to $\omega_{ct}$9 is changed from 0 to $\pi$, as shown in FIG. 30A. Since the first input terminals of the 0th to 9th EORs 802 receive the carrier phase angle MSB $\omega_{ct}$10 at logic "0", when the value indicated by the lower 10 carrier phase angle bits $\omega_{ct}$0 to $\omega_{ct}$9 is sequentially increased during the time interval between 0 and T/2, address signal data A0 to A9 which are sequentially increased in the same relationship as described above can be obtained, as shown in FIG. 30C. Thus, a waveform within a range of 0 to $\pi$ [rad] on the basis of equations (27) is sequentially read out from the carrier wave ROM 801 (FIG. 29), as shown in FIG. 30D. The readout waveform is input to the first terminals of the 0th to 9th EORs 803. The second input terminals of the EORs 803 receive the carrier phase angle MSB $\omega_{ct}$10 at logic "0". For this reason, the lower 10 carrier signal bits $W_c$0 to $W_c$9 of the outputs from the EORs become the same as the outputs D0 to D9 (FIG. 30D), as shown in FIG. 30E. Since the carrier signal MSB $\omega_c$10 is equal to the carrier phase angle MSB $\omega_{ct}$10, and is at logic "0", the same waveform as the outputs D0 to D9 shown in FIG. 30D is output as the carrier signal data $W_c$0 to $W_c$10, as in the time interval between 0 and T/2 shown in FIG. 30F.

During a time interval between T/2 and T, the carrier phase angle MSB $\omega_{ct}$10 is at logic "1", as shown in FIG. 30B, and a value indicated by the lower 10 carrier phase angle bits $\omega_{ct}$0 to $\omega_{ct}$9 is changed from 0 to $\pi$, as shown in FIG. 30A. At this time, since the first input terminals of the 0th to 9th EORs 802 receive the carrier phase angle MSB $\omega_{ct}$10 at logic "1", when a value indicated by the lower 10 carrier phase angle bits $\omega_{ct}$0 to $\omega_{ct}$9 is sequentially increased during the time interval between T/2 and T, address signal data A0 to A9 which are sequentially decreased in an opposite relationship thereto are obtained, as shown in FIG. 30C. Thus, a waveform within a range of 0 to $\pi$ [rad] on the basis of equations (27) is read out from the carrier wave ROM 801 (FIG. 29) in a reverse direction, as shown in FIG. 30D. This waveform is input to the first input terminals of the 0th to 9th EORs 803. Since the carrier phase angle MSB $W_c$10 at logic "1" is input to the second input terminals of the EORs 803, lower 10 carrier signal bits $W_c$0 to $W_c$9 as the outputs from the EORs define a waveform having an inverted increase/decrease relationship with respect to that of the outputs D0 to D9 (FIG. 30D), as shown in FIG. 30E. Since the carrier signal MSB $W_c$10 is equal to the carrier phase angle MSB $\omega_{ct}$10, and is at logic "1" an offset value of a value $\pi$ [rad] which can be designated by the lower 10 carrier phase angle bits $\omega_{ct}$0 to $\omega_{ct}$9 is superposed on the outputs D0 to D9. As a result, carrier signal data $W_c$0 to $W_c$10 representing a waveform in the time interval between T/2 to T shown in FIG. 30F is output.

As can be seen from the above-mentioned operations, the same waveform as the carrier signal $W_c$ described above with reference to FIG. 14 or equation (14) can be output within a range of time 0 to time T. In this case, since the carrier wave ROM 801 (FIG. 29) need only store data corresponding to a ½ period of a waveform for one period shown in FIG. 14, a memory capacity can be halved as compared to a case wherein a waveform for one period is simply stored.

A general operation of the envelope generator 706 shown in FIG. 28 will be described below. The arrangement of the envelope generator 706 is substantially the same as an envelope generator circuit used in a conventional electronic musical instrument, except that it can output envelope waveform data for three channels. When parameters from the controller 701 are set in the envelope generator 706, the following operations are performed.

Figures 31, 32:
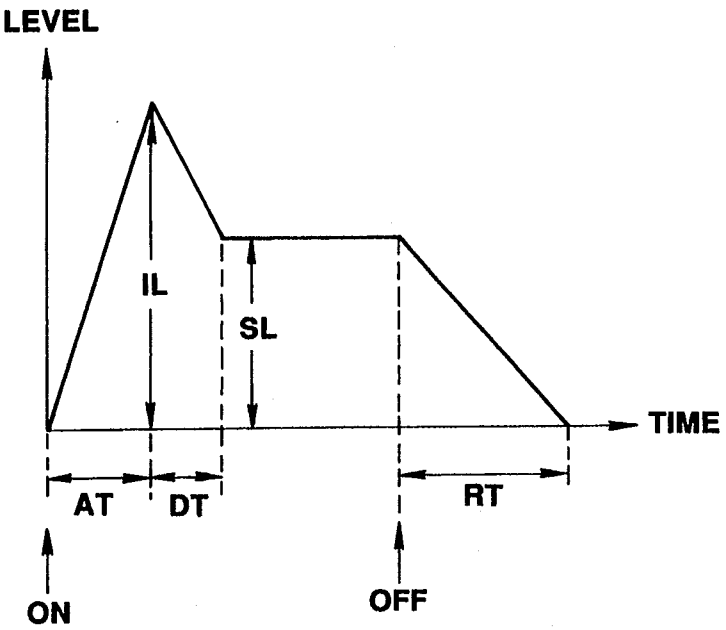
FIG. 31 is a graph showing output characteristics of an envelope generator.
FIG. 32 shows address data and setup data.

FIG. 31 shows examples of the modulation index data $E_1$, or the amplitude coefficient data $E_2$ and $E_3$ output from the envelope generator 706. Note that the data $E_1$, $E_2$, and $E_3$ are independently controlled. In FIG. 31, ON designates a timing at the beginning of an ON event of a given key on the keyboard unit 717 (FIG. 28), and OFF designates a timing of an OFF event. A level value indicates the modulation index data $E_1$ or the amplitude coefficient data $E_2$ and $E_3$, and is changed over time. The level value reaches an initial level IL in an attack time AT from the ON event, and is then decreased to a sustain level SL in a decay time DT from the initial level IL. The level value maintains the sustain level SL until the OFF event. After the OFF event, the level value is decreased to 0 in a release time RT.

When the controller 701 (FIG. 28) sets address data FA at an address input terminal A of the envelope generator 706, and supplies setup data ED to a data input terminal D of the envelope generator 706, characteristics of the modulation index data $E_1$ and the amplitude coefficient data $E_2$ and E3 can be set in the envelope generator 706 shown in FIG. 28. FIG. 32 shows the relationship between an address value supplied to the address input terminal A and types of data supplied to the data input terminal D. In this manner, the values shown in FIG. 32 are supplied to the address input terminal A for each of the data $E_1$, $E_2$, and $E_3$, and at the same time, and the data of types shown in FIG. 32 are supplied to the data input terminal D as the setup data D, thus setting the envelope generator.

An operation executed when a player actually operates the keyboard unit 717 to make a performance in the embodiment shown in FIG. 28 will be described below.

The controller 701 monitors the depression and release of a key on the keyboard unit 717. When the depression of a given key is detected, key code data KC indicating a pitch of the key output from the keyboard unit 717 is added to a bender value, a transpose value, and the like (not shown) to calculate carrier data CF. The "bender" value is a controller for allowing a player to arbitrary change a pitch of a tone in generation during a performance. The "transpose" value is setup data for performing transposition or changing a pitch in units of octaves on the keyboard unit 717.

The controller 701 outputs the above-mentioned carrier data CF to the adder 702. The adder 702 outputs the carrier phase angle data $\omega_{ct}0$ to $\omega_{ct}10$ according to the depressed key to the carrier signal generation circuit 703. The circuit 703 outputs the carrier signal data $W_c0$ to $W_c10$.

At the same time with the above-mentioned operations, the controller 701 adds the carrier data CF to data set by the player in advance (e.g., attack time data AT, initial level data IL, and the like shown in FIG. 32) to calculate modulator data MF. The controller 701 then outputs the modulator data MF determined as described above to the adder 704.

The modulation phase angle data $\omega_{mt}0$ to $\omega_{mt}10$ having a predetermined relationship with the carrier phase angle data $\omega_{ct}0$ to $\omega_{ct}10$ output from the adder 702 are output to the modulation signal generation circuit 705. The circuit 705 outputs modulation signal data $W_M0$ to $W_M10$.

The controller 701 then calculates PCM pitch data PD for the PCM signal generation circuit 712 on the basis of the key code data KC of the depressed key in the same manner as the carrier data CF, and outputs it to the adder 711.

Thus, the adder 711 outputs an address signal for reading out a PCM tone signal from the PCM signal generation circuit 712 in accordance with the depressed key.

Simultaneously with the above-mentioned operations, the controller 701 executes processing for determining characteristics of modulation index data $E_1$ output from the envelope generator 706 (FIG. 28). The controller 701 obtains velocity data VL of the depressed key from the keyboard unit 717. Note that this data has a value between 0 to 1. The controller 701 sets an attack time AT, a decay time DT, and a release time RT of the modulation index data $E_1$ (see FIG. 31) in the envelope generator 706 (FIG. 28) as tone color data. This setting operation is attained in such a manner that the controller 701 supplies the address data to the address input terminal A of the envelope generator 706, and outputs setup values to the data input terminal D, as shown in FIG. 32. The controller 701 then multiplies the initial level value IL of the modulation index data $E_1$ with the value of the velocity data VL to correct the initial level data IL, and sets the corrected data in the envelope generator 706. Furthermore, the controller 701 multiplies the sustain level value of the modulation index data $E_1$ with the value of the velocity data VL to correct the sustain level data SL, and sets the corrected data in the envelope generator 706. With the above-mentioned processing, the output characteristics of the modulation index data $E_1$ are determined.

Furthermore, the controller 701 executes processing for determining characteristics of the amplitude coefficient data $E_2$ output from the envelope generator 706. More specifically, the controller 701 sets an attack time, an initial level IL, a decay time DT, a sustain 15 level SL, and a release time RT (see FIG. 31) for the amplitude coefficient data $E_2$ in the envelope generator 706 (FIG. 28) as tone volume data. This setting operation can be performed in the same manner as the modulation index data $E_1$.

The controller 701 executes processing for determining characteristics of the amplitude coefficient data $E_3$ output from the envelope generator 706. This setting operation can be performed in the same manner as the modulation index data $E_1$ or the amplitude coefficient data $E_2$.

ON processing for generating a tone is then performed. More specifically, the controller 701 issues commands for enabling the modulation index data $E_1$ and the amplitude coefficient data $E_2$ and $E_3$ to the envelope generator 706. This processing is executed in such a manner that the controller 701 sequentially outputs values 0 and 7, and E (hexadecimal notation) as address data FA, and also outputs proper command data as setup data ED every time the address data is output, as shown in FIG. 31.

With the above-mentioned processing, the envelope generator 706 (FIG. 28) begins to output the modulation index data $E_1$, and the amplitude coefficient data $E_2$ and $E_3$, and the circuits shown in FIG. 28 are operated to generate a tone waveform, as has already been described above.

Figure 33:
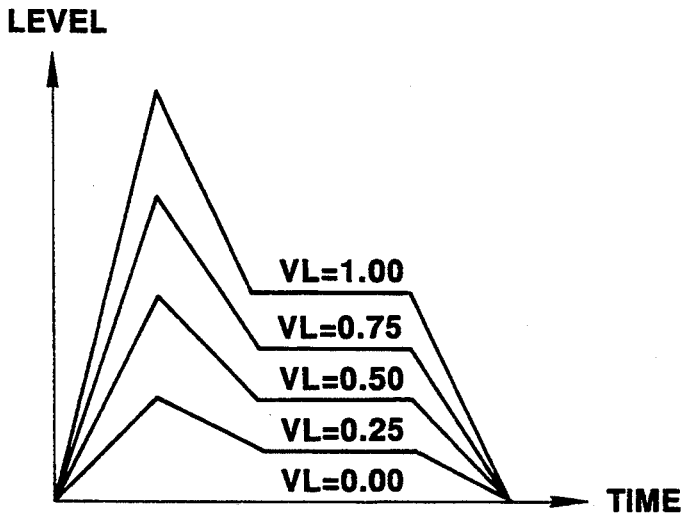
FIG. 33 is a graph showing characteristics of a modulation index $E_1$.

In this case, the characteristics of the modulation index data $E_1$ are changed, as shown in FIG. 33, in accordance with the value of the velocity data VL from the keyboard unit 717. Thus, a mixing ratio of the modulation signal data $W_M0$ to $W_M10$ as outputs from the multiplier 707 in the carrier signal data $W_c0$ to $W_c10$ from the carrier signal generation circuit 703 by the adder 708 is changed over time in accordance with the value of the velocity data VL. In this manner, a tone color, or the like of a tone can be changed in accordance with a performance state on the keyboard unit 717.

A tone characterized by a breath tone in an attack time like in, e.g., brass instruments (trumpets, saxophones, horns, and the like) is reproduced as follows. In a brass instrument, the amplitude of a harmonic component tends to be slowly decreased from a harmonic component of a low order to a harmonic component of a high order, and a harmonic string is almost linear. For this reason, the modulation signal generation circuit 705 (FIG. 28) is caused to generate a waveform such as a sawtooth wave which equally includes harmonic components of respective orders. Thus, when the modulation index data $E_1$ is 0, the modulated tone signal $e_M$ becomes a sine wave, and when the value of the data $E_1$ is increased, the number of harmonic components included in the modulated tone signal $e_M$ can be increased. In addition, this effect can be controlled according to velocity data which is output in accordance with a depressed key speed at the keyboard unit 717. Meanwhile, the PCM signal generation circuit 712 (FIG. 28) samples only a tone in an attack time unique to a brass instrument. In addition to the above-mentioned setting operations, data are set in the envelope generator 706 so that the amplitude coefficient data $E_2$ and $E_3$ can have characteristics shown in, e.g., FIG. 34A. The adder 714 can mix the modulated tone signal $e_M$ and the PCM tone signal $e_p$ in accordance with the characteristics shown in FIG. 34A, so that the PCM tone signal $e_p$ is output for an attack portion of a tone, and the modulated tone signal $e_M$ is output for a sustain portion and the subsequent portions. In this manner, a real tone which has an attack tone unique to a brass instrument and whose tone color is changed in a sustain portion according to a performance strength can be reproduced.

Figure 34B:
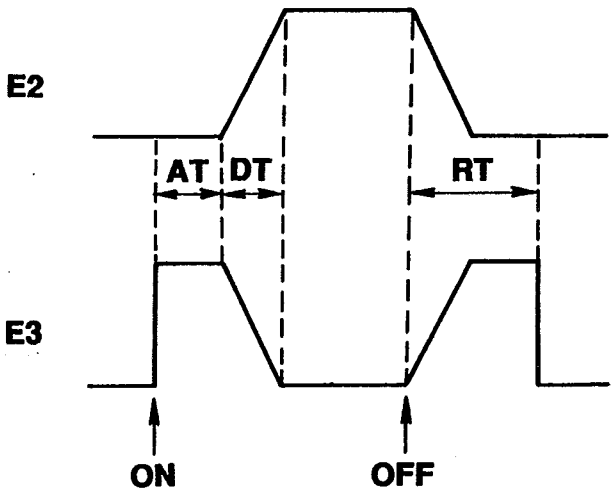
FIGS. 34A and 34B are graphs showing characteristics of amplitude coefficients $E_2$ and $E_3$, respectively.
Figure 34A:
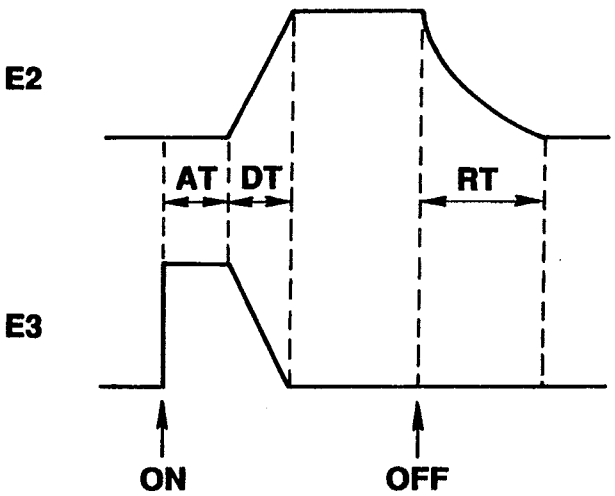

In, e.g., a harpsichord, since a mechanism presses a string of the harpsichord, which string is vibrated by a performance operation, not only at the depression of the key but also at the release of the key, a characteristic tone is generated. In this case, control can be made as follows. That is, the PCM signal generation circuit 712 stores sample tones at the depression and release of the harpsichord, so that the adder 714 can output the PCM tone signal $e_p$ in an attack time and in a release time, as shown in FIG. 34B.

After the above-mentioned tone generation operation, when the release of the depressed key is detected by the keyboard unit 717 (FIG. 28), OFF processing for muting a tone in generation is performed. More specifically, the controller 701 issues commands for disabling the modulation index data $E_1$, and the amplitude coefficient data $E_2$ and $E_3$ to the envelope generator 706. This processing is attained in such a manner that the controller 701 sequentially outputs values 1 and 8, and F (hexadecimal notation) as address data FA, and also outputs proper command data as setup data ED every time the address data is output, as shown in FIG. 32.

The fourth embodiment of the present invention will be described below.

Figure 35:
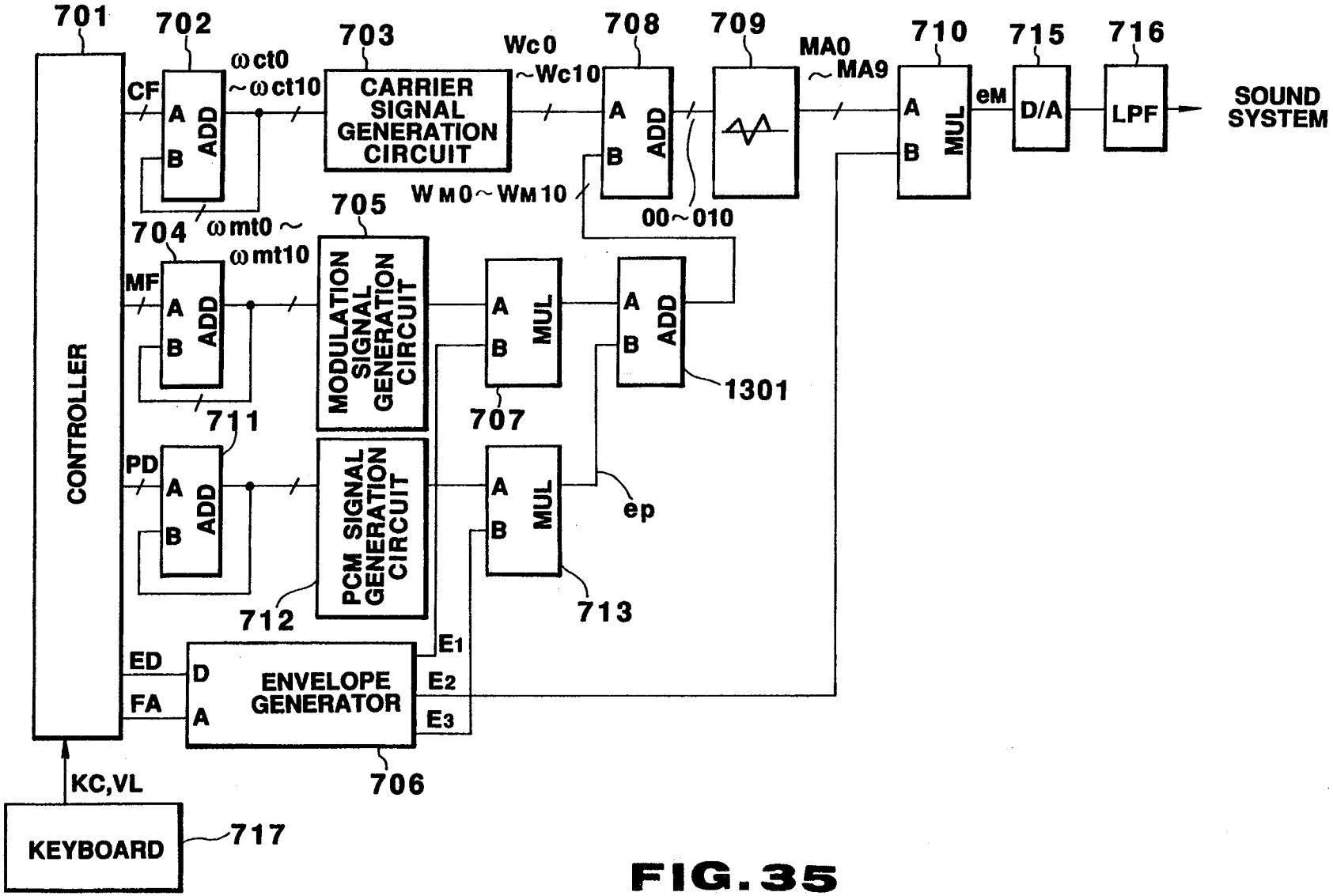
FIG. 35 is a block diagram showing the fourth embodiment of the present invention.

FIG. 35 is a block diagram showing the overall arrangement of the fourth embodiment of the present invention. A difference from the third embodiment shown in FIG. 28 mainly lies in the role of the PCM signal generation circuit 712. A PCM tone signal $e_p$ as an output from the PCM signal generation circuit 712 is added to a tone signal $e_M$ in FIG. 28. However, in this embodiment, as shown in FIG. 35, the PCM tone signal $e_p$ is added to another signal, and the sum signal is input to a triangular wave decoder.

More specifically, a PCM tone signal read out from the PCM signal generation circuit 712 is multiplied with amplitude coefficient data $E_3$ output from an envelope generator 706 by a multiplier 713 to calculate a PCM tone signal $e_p$, and the signal $e_p$ is input to a terminal B of an adder 1301. The adder 1301 adds an output from a multiplier 707 input at its terminal A, and an output from the multiplier 713 to calculate new modulation signal data $W_M0$ to $W_M10$ (11 bits). These data are input to a terminal B of an adder 708. Thereafter, the adder 708 adds the modulation signal data to carrier signal data $W_c0$ to $W_c10$ input from a carrier signal generation circuit 703 at its terminal A to calculate sum waveform data O0 to O10 (11 bits). The following operation is the same as that in the third embodiment, and a description thereof will be omitted.

As described above, a PCM waveform signal which is obtained by sampling a tone of an acoustic instrument as a sound source is used as a modulation signal, and as amplitude coefficient data $E_3$ of the modulation signal is increased, a tone signal $e_M$ having a complicated waveform can be obtained.

As described above, when a key on the keyboard unit 717 shown in FIG. 28 or 35 is depressed fast (strongly), the value of velocity data VL is increased, and the value of modulation index data $E_1$ is increased accordingly. As a result, a mixing ratio of modulation signal data $W_M0$ to $W_M10$ to carrier signal data $W_c0$ to $W_c10$ in the adder 708 (FIG. 28 or 35) is increased, and a tone to be generated can include many harmonic components of high orders. Contrary to this, when a key is depressed slowly (weakly), the value of velocity data VL is decreased, and the value of modulation index data $E_1$ is decreased accordingly. As a result, the mixing ratio of modulation signal data $W_M0$ to $W_M10$ to carrier signal data $W_c0$ to $W_c10$ in the adder 708 (FIG. 28 or 35) is decreased, and a tone to be generated can be approximate to a single sine wave.

Since amplitude coefficient data $E_3$ is changed in accordance with the speed (strength) of the depressed key, the magnitude of a PCM tone signal $e_p$ is also changed. For this reason, a unique tone in an attack time, e.g., a breath tone of a brass instrument or a mechanical impact tone of a piano can be desirably emphasized by a key depression, or a tone having a complicated waveform (i.e., harmonics) in an attack time can be generated.

In this manner, according to the present invention, control can be widely made between a state wherein a tone to be generated includes many harmonic components of high orders to a state wherein a tone includes only a single sine wave in accordance with a strength of the key depression. In addition, a tone color in, e.g., a attack time can be desirably controlled.

In FIG. 28 or 35, the characteristics of modulation index data $E_1$ and amplitude coefficient data $E_3$ are allowed to be varied in accordance with velocity data VL. For example, the characteristics of amplitude coefficient data $E_2$ may be controlled in accordance with velocity data VL, so that a tone volume of a tone is varied in accordance with a strength of the key depression.

If modulation index data $E_1$ is controlled in accordance with a key area of the keyboard unit 717 (FIG. 28 or 35) to which a depressed key belongs, when a key in a bass area is depressed, the value of modulation index data $E_1$ may be increased, and when a key in a treble area is depressed, it may be decreased. Thus, an operation suitable for simulating a tone color including many harmonic components of high orders in a bass area like a piano tone may be executed.

In the embodiment shown in FIG. 28 or 35, a circuit for outputting a single tone waveform has been exemplified. For example, the adder 702, the carrier signal generation circuit 703, the adder 704, the modulation signal generation circuit 705, the envelope generator 706, the multiplier 707, the adder 708, the triangular wave decoder 709, the multiplier 710, the adder 711, the PCM signal generation circuit 712, the multiplier 713, the adder 714, and the adder 1301 may be arranged to allow time-divisional operations, and tones in respective time-divisional channels may be accumulated in units of sampling periods at an input stage of the D/A converter 715, so that a plurality of tone waveforms may be parallelly generated.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A tone waveform generation apparatus comprising:

tone generation processing means including a plurality of tone generation channels to each of which one of (i) a first tone generation processing mode for reading out prestored waveform data at a speed corresponding to a pitch to be assigned, and for outputting the readout waveform data as a tone waveform, and (ii) a second tone generation processing mode for synthesizing a plurality of signals in accordance with a predetermined algorithm to output waveform data at an assigned pitch as a tone waveform, is selectively and independently assigned as a processing mode for generating a tone, and which one generation channels are subjected to time-divisional processing;

pitch designation means for designating a pitch of a tone;

processing designation means for designating desired tone generation processing mode from the first and second tone generation processing modes for each of said plurality of tone generation channels, and for outputting corresponding processing designation data;

pitch assignment means for assigning a pitch designated by said pitch designation means to each of the tone generation channels of said tone generation processing means; and processing assignment means for assigning processing designation data output from said processing designation means to each of the tone generation channels of said tone generation processing means.

2. An apparatus according to claim 1, wherein said processing designation means including means for setting a tone generation processing mode in units of tone generation channels in response to an instruction.

3. An apparatus according to claim 1, wherein:

said tone generation processing means comprises first waveform data storage means for storing PCM waveform data, second waveform data storage means for storing modulation waveform data, and modulation means for modulating a carrier signal to be generated an the basis of a pitch assigned by said pitch assignment means;

the first tone generation processing mode executes processing for reading out PCM waveform data from said first waveform data storage means using the carrier signal as address data, and outputting the readout waveform data as a tone waveform; and the second tone generation processing mode executes processing for causing said modulation means to modulate the carrier signal with a modulation other than PCM, reading out modulation waveform data from said second waveform data storage means in accordance with the modulated carrier signal, and outputting the readout waveform data as a tone waveform.

4. An apparatus according to claim 3, wherein said modulation means includes means for modulating a phase of the carrier signal.

5. An apparatus according to claim 3, wherein said modulation means includes means for modulating a frequency of the carrier signal.

6. An apparatus according to claim 3, wherein:

said first waveform data storage means and said second waveform data storage means comprises a common waveform memory means for storing the PCM waveform data and the modulation waveform data in different address areas; and said tone generation processing means selectively inputs the carrier signal or the modulated carrier signal as a lower address to said waveform memory means in units of tone generation channels, and inputs a selection signal for selecting an address area storing the PCM waveform data or the modulation waveform data to said waveform memory means as an upper address.

7. A tone waveform generation apparatus comprising:

tone generation processing means including a plurality of time-divisionally processed tone generation channels to each of which one of a first tone generation processing mode and a second tone generation processing mode is selectively and independently assigned, said first tone generation mode including reading out prestored waveform data at a speed corresponding to a pitch designated by input performance data and outputting the readout waveform data as a tone waveform, and said second tone generation processing mode including mixing a modulation signal with a carrier signal at an arbitrary mixing ratio based on the performance data and converting the mixed output on the basis of a predetermined functional relationship to generate a modulated tone signal, the predetermined functional relationship being neither of sine and cosine functional relationships, and the carrier signal setting the modulated tone signal to have a sine or cosine wave when the mixing ratio is controlled to be a predetermined mixing ratio, and said tone generation processing means further including generating means for generating a tone of the basis of a pitch assigned to each of the tone generation channels, and the tone generation processing mode selected by processing designation data assigned to each of the tone generation channels;

pitch designation means for designating a pitch;

processing designation means for designating desired processing mode from the first and second tone generation processing modes for each of said plurality of channels, and for outputting corresponding processing designation data;

pitch assignment means for assigning a pitch designated by said pitch designation means to each of the channels of said tone generation processing means; and processing assignment means for assigning processing designation data output from said processing designation means to a corresponding one of the channels.

8. An apparatus according to claim 7, wherein said tone generation processing means comprises first modulation signal input means for, when the second tone generation processing mode is executed in a given one of the tone generation channels, inputting the modulated tone signal generated in an immediately preceding tone generation period in the given tone generation channel as a modulation signal in a current tone generation period.

9. An apparatus according to claim 7, wherein: said tone generation processing means comprises first waveform data storage means for storing PCM waveform data; and the first tone generation processing mode executes processing for reading out PCM waveform data from said first waveform data storage means as a PCM tone signal at a speed corresponding to a pitch designated by the performance data.

10. An apparatus according to claim 7, wherein said tone generation processing means comprises signal input means for, when the second tone generation processing mode is executed in a given one of the tone generation channels, inputting one of the modulated tone signals generated in an immediately preceding tone generation period in another tone generation channel different from the given tone generation channel or a PCM tone signal as the modulation signal in a current tone generation period.

11. A tone waveform generation apparatus comprising:

tone generation means for selectively executing (i) first tone generation processing for reading out prestored waveform data at a speed corresponding to a designated pitch, and outputting the readout waveform data as a tone signal, and (ii) second tone generation processing for mixing a modulation signal with a carrier signal at an arbitrary mixing ratio based on performance data, and converting a mixed output on the basis of a predetermined functional relationship to generate a modulated tone signal, the predetermined functional relationship being neither of sine and cosine functional relationships, and the carrier signal setting the modulated tone signal to have a sine or cosine wave when the mixing ratio is controlled to be a predetermined mixing ratio; and control means for causing, on the basis of a tone generation start instruction, said tone generation means to start generation of the tone signal by the first tone generation processing or generation of the modulated tone signal by the second tone generation processing, for mixing the tone signal and the modulated tone signal in accordance with a predetermined mixing characteristic which is changeable over time, and for outputting the mixed output as a mixed tone signal.

12. An apparatus according to claim 11, wherein: said tone generation means comprises first waveform data storage means for storing PCM waveform data; and the first tone generation processing executes processing for reading out PCM waveform data from said first waveform data storage means as a PCM tone signal at a speed corresponding to a designated pitch.

13. An apparatus according to claim 1, wherein one of said first and second tone generation processing modes is PCM, and wherein the other of said first and second tone generation processing modes is a modulation other than PCM.

14. An apparatus according to claim 13, wherein said modulation other than PCM is FM modulation.

15. An apparatus according to claim 7, wherein one of said first and second tone generation processing modes is PCM, and wherein the other of said first and second tone generation processing modes is a modulation other than PCM.

16. An apparatus according to claim 15, wherein said modulation other than PCM is FM modulation.

17. An apparatus according to claim 11, wherein one of said first and second tone generation processing modes is PCM, and wherein the other of said first and second tone generation processing modes is a modulation other than PCM.

18. An apparatus according to claim 17, wherein said modulation other than PCM is FM modulation.

* * * * *